US010682744B2

(12) United States Patent
Zhang et al.

(10) Patent No.: US 10,682,744 B2
(45) Date of Patent: Jun. 16, 2020

(54) RATCHET WRENCH PROVIDING COMBINED FUNCTIONS OF ORDINARY RATCHET WRENCHES

(71) Applicants: Ming Liang Zhang, Brooklyn, NY (US); Ming Zhu Zhang, Brooklyn, NY (US)

(72) Inventors: Ming Liang Zhang, Brooklyn, NY (US); Ming Zhu Zhang, Brooklyn, NY (US)

( * ) Notice: Subject to any disclaimer, the term of this patent is extended or adjusted under 35 U.S.C. 154(b) by 389 days.

(21) Appl. No.: 15/144,344

(22) Filed: May 2, 2016

(65) Prior Publication Data

US 2016/0332284 A1 Nov. 17, 2016

Related U.S. Application Data

(60) Provisional application No. 62/162,044, filed on May 15, 2015, provisional application No. 62/175,266, filed on Jun. 13, 2015, provisional application No. 62/293,414, filed on Feb. 10, 2016.

(51) Int. Cl.
*B25B 13/46* (2006.01)
*B25B 13/48* (2006.01)

(52) U.S. Cl.
CPC ..... *B25B 13/463* (2013.01); *B25B 13/481* (2013.01)

(58) Field of Classification Search
CPC ... B25B 13/463; B25B 13/481; B25B 13/461; B25B 13/462; B25G 1/08; B25G 1/085
See application file for complete search history.

(56) References Cited

U.S. PATENT DOCUMENTS 1,807,134 A * 5/1931 Pfauser ..... B25B 13/463 81/61
2,015,031 A * 9/1935 Fischer ..... E01F 9/578 404/15
5,168,782 A * 12/1992 Cromwell ..... B25B 23/0021 81/177.2
5,507,208 A * 4/1996 Pratt ..... B25B 13/461 81/177.85
6,527,404 B2 * 3/2003 Wang ..... B25B 13/463 362/109
6,644,148 B2 * 11/2003 Hu ..... B25B 13/461 81/63
6,971,286 B2 * 12/2005 Hu ..... B25B 13/463 81/124.3
8,991,286 B2 * 3/2015 Davidson ..... B25B 23/0035 81/177.85
2015/0314426 A1 * 11/2015 Chiang ..... B25B 13/465 81/58.1

* cited by examiner

*Primary Examiner* — Bryan R Muller
*Assistant Examiner* — Joel D Crandall

(57) ABSTRACT

A ratchet wrench includes a first and a second drive members 21, 21' rotatably mounted in a first and a second heads 16, 16' extended from a first and a second ends of a handle 10. The first drive member 21 includes a square inner periphery 35 adapted to slidably retain a drive shaft 36 including a ½" drive fitting 45 and a ⅜" drive fitting 46, and the second drive member 21' includes a ¼" drive hexagonal bit holder 53 and ¼" drive fitting 54, for providing combined functions of ordinary ratchet wrenches for turning fasteners. A first and a second ratcheting mechanisms are mounted in the first and the second ends of the handle 10 for turning the first and the second drive members 21, 21', by the handle 10.

11 Claims, 38 Drawing Sheets

RATCHET WRENCH PROVIDING COMBINED FUNCTIONS OF ORDINARY RATCHET WRENCHES

CROSS-REFERENCE TO RELATED APPLICATIONS

This application is a non-provisional application claiming benefits of U.S. provisional applications with application No. 62/162,044, filed on May 15, 2015, and application No. 62/175,266, filed on Jun. 13, 2015, and application No. 62/293,414, filed on Feb. 10, 2016.

BACKGROUND OF THE INVENTION

1. Field of the Invention

The present invention relates to a hand tool, more specifically to a ratchet wrench that includes a ¼" drive hexagonal bit holder, and that has a profile of an ordinary ratchet wrench on two ends of a handle while providing combined functions of ordinary ratchet wrenches with a ½" drive, a ⅜" drive, and a ¼" drive.

2. Description of the Prior Art

Ratchet wrenches are widely used and known for their ability to turn fasteners in a speedy fashion. A conventional ratchet wrench includes a handle having two ends each including a head extended therefrom. A first drive member is rotatably received in one head on one end of the handle, and includes a ⅜" drive fitting and a ½" drive fitting respectively and integrally formed on a top end and on a bottom end thereof. A ratcheting mechanism mounted in the one head and manipulated by a switch ring mounted on the one head controls rotational direction of the first drive member. A second drive member is rotatably received in another head on another end of the handle, and includes a ¼" drive bit-holding socket and a ¼" drive fitting respectively and integrally formed on a top end and on a bottom end thereof. Another ratcheting mechanism mounted in the another head and manipulated by another switch ring mounted on the another head controls rotational direction of the second drive member. The conventional ratchet wrench can be used with sockets that have a ½" drive, a ⅜" drive, a ¼" drive, and a bit that has ¼" drive, for turning fasteners. However, the ½" drive fitting and the ⅜" drive fitting are integrally formed with the first drive member, and the ¼" drive bit-holding socket and the ¼" drive fitting are integrally formed with the second drive member, so that the conventional ratchet wrench has a high profile on two ends of the handle. Whenever such conventional ratchet wrench is used with a "socket" attached to one end of the first drive member or the second drive member, there will always be a drive fitting or a bit-holding socket on an opposite end of the first drive member or the second drive member obstructing the conventional ratchet wrench from getting into confined spaces for turning fasteners. Thus, the conventional ratchet wrench cannot be used in confined spaces for turning fasteners in most cases of applications.

SUMMARY OF THE INVENTION

The principal object of the present invention is to provide a ratchet wrench that has a ¼" drive hexagonal bit holder, and that has a profile of an ordinary ratchet wrench on two ends of a handle while providing combined functions of ordinary ratchet wrenches with a ½" drive, a ⅜" drive, and a ¼" drive, and that will not be obstructed from getting into confined spaces for turning fasteners with sockets in most cases of applications.

In accordance with one aspect of the present invention, there's provided a ratchet wrench comprising a handle having a first and a second ends each including a lowered face, an inclined through hole having a threaded portion for mounting a setscrew, and a cavity communicated with the inclined through hole.

A first and a second heads extend from the first and the second ends of the handle, and each includes a drive housing defined therein and communicated with the cavity. Each drive housing includes a U-shaped section defined in a top of the first and the second ends of the handle and communicated with the cavity respectively. The first and the second heads each further includes a groove defined in a top end for mounting a ring element.

A first and a second drive members are rotatably mounted in the drive housings, and each includes a plurality of gear teeth defined in an outer periphery thereof, and each also includes a flange on a top end of the outer periphery and located outside the top end of the first and the second heads and abutting against the top end face of the ring element respectively.

A first and a second ratcheting mechanisms are provided in the first and the second ends of the handle, and each includes a pawl having two sets of lockup teeth for selectively meshing with the gear teeth of the first and the second drive members for turning the first and the second drive members.

In further aspects, the first drive member further includes a square inner periphery adapted to receive a drive shaft having a ½" drive fitting formed on an upper portion and a ⅜" drive fitting on a lower portion thereof. The second drive member further includes a ¼" drive hexagonal bit holder formed in a top end and a ¼" drive fitting on a bottom end thereof.

Further advantages and novel features of the present invention will become more apparent from the following detailed description with appropriate reference to the accompanying drawings.

DETAILED DESCRIPTION OF THE PREFERRED EMBODIMENTS

Figure 1:
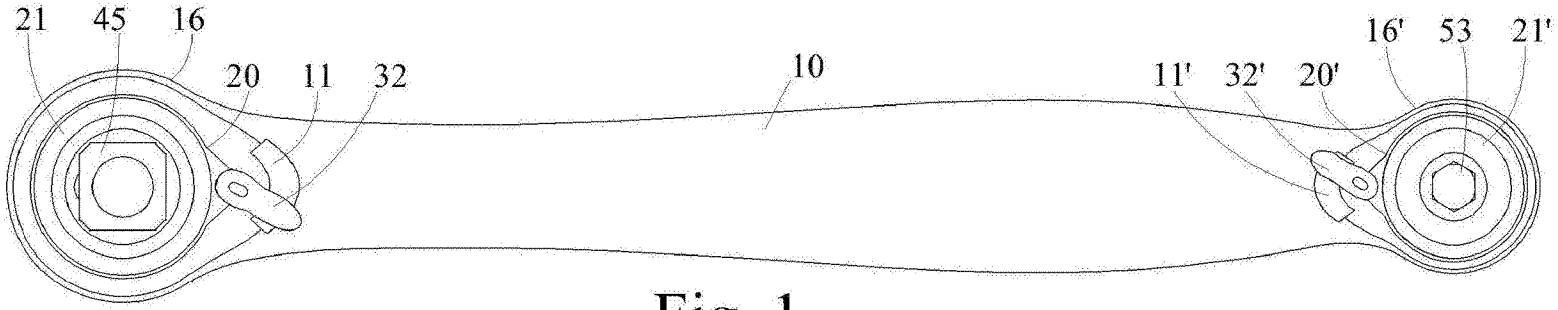
FIGS. 1, 2, and 3 respectively are a full top view, a full side view, and a full bottom view, of a first embodiment of a ratchet wrench in accordance with the present invention.
Figure 2:
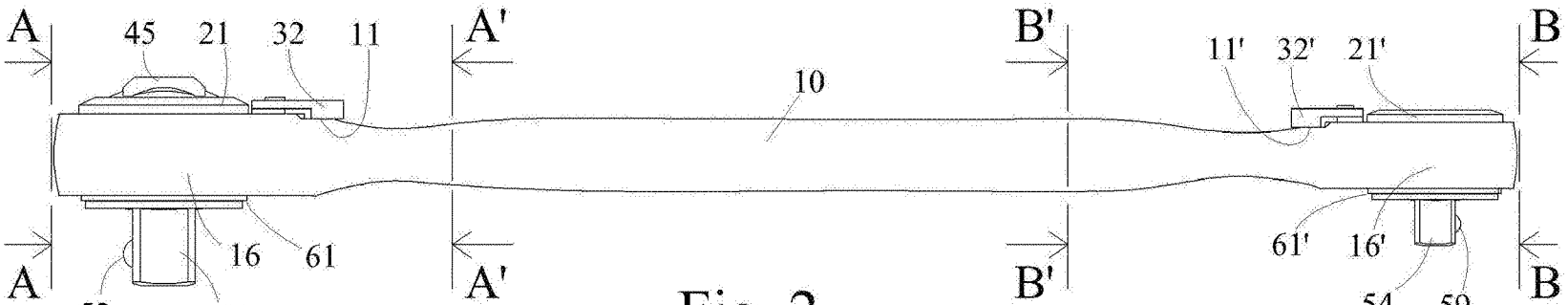
Figure 3:
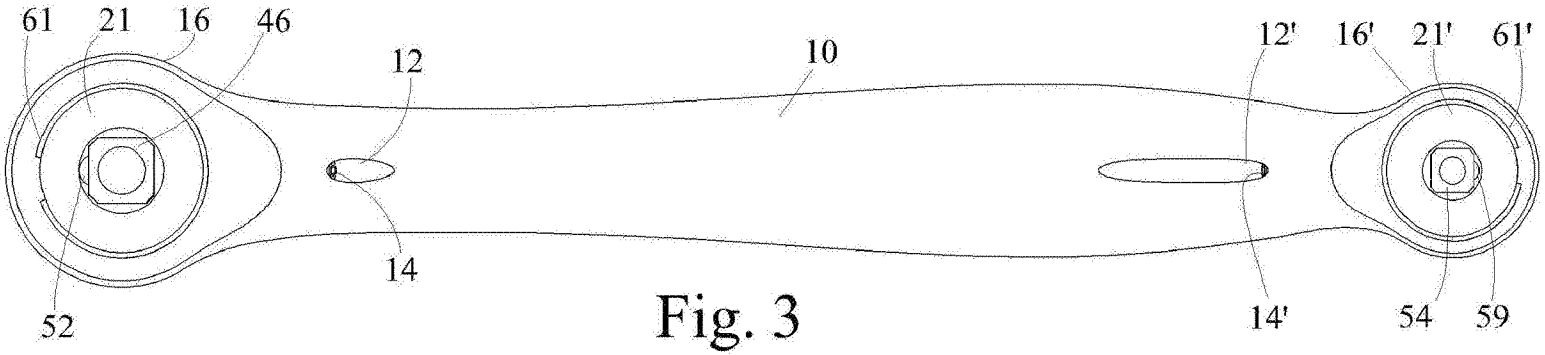
Figure 4:
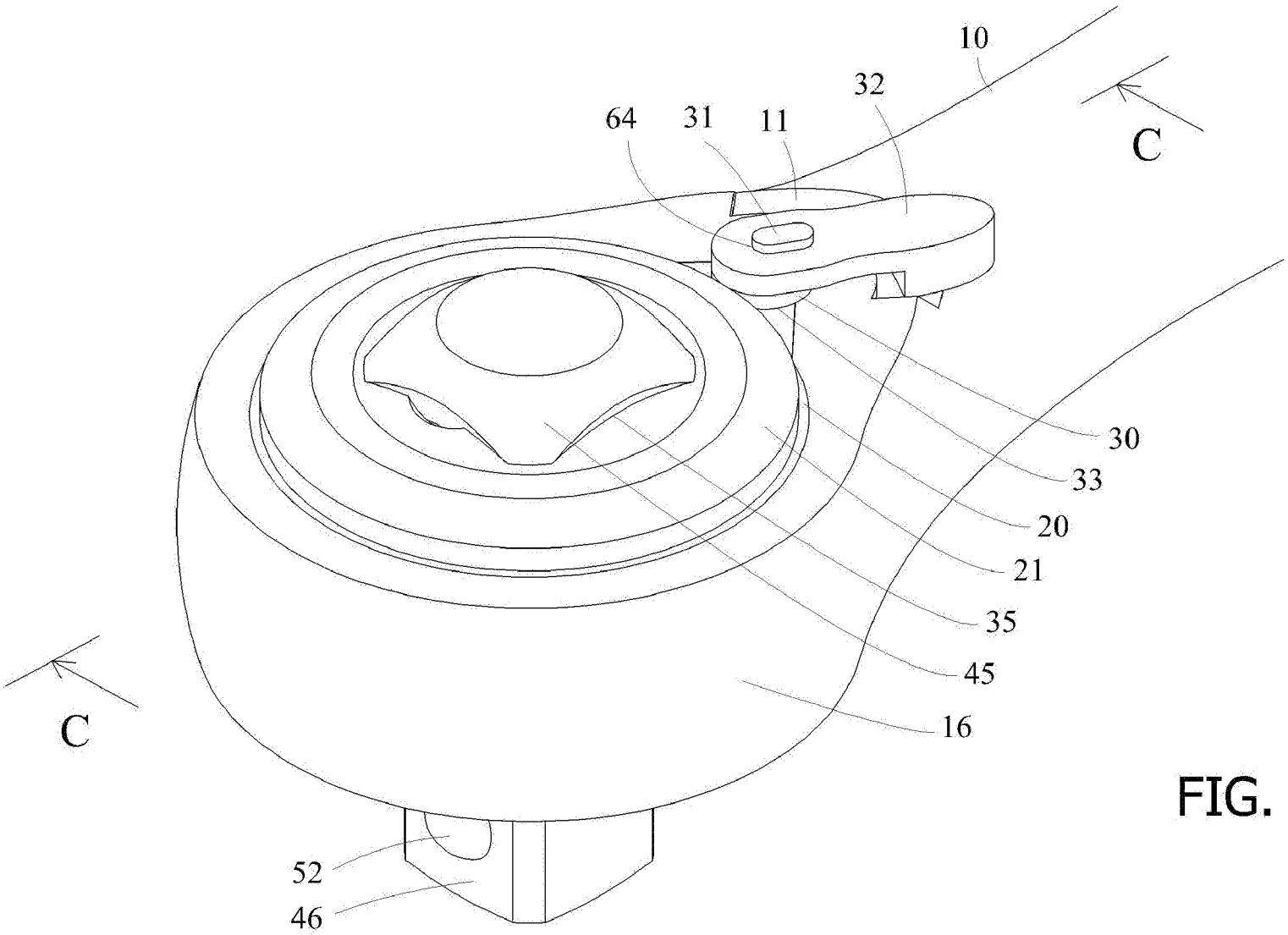
FIGS. 4, 5, and 6 respectively are a perspective view, an exploded view, and a bottom view, of a first end section between lines A-A and A'-A' in FIG. 2, of the first embodiment of the ratchet wrench.

Initially referring to FIGS. 1-14, of the drawings, a first embodiment of a ratchet wrench in accordance with the present invention comprises a handle 10 including a first and a second ends each respectively including a lowered face 11, 11', an inclined through hole 12, 12' having a threaded portion 13, 13' for mounting a setscrew 14, 14' for closing the inclined through hole 12, 12', and a cavity 15, 15' that communicates with the inclined through hole 12, 12' (FIGS. 5, 7, and 12, 14). A first and a second heads 16, 16' extend from the first and the second ends of the handle 10, and each respectively includes a drive housing 17, 17' defined therein and communicated with the cavity 15, 15'. Each drive housing 17, 17' has a U-shaped section 18, 18' (FIGS. 5, and 12) defined in a top of the first and the second ends of the handle 10 and communicated with the cavity 15, 15'. A first and a second ratcheting mechanisms are mounted in the first and the second ends of the handle 10, and each includes a pawl 24, 24' rotatably mounted in the cavity 15, 15', including an axial cylinder 30, 30' on a top end thereof. The axial cylinder 30, 30' includes a top end 65, 65' located outside the top of the first and the second ends of the handle 10 and formed with an oblong portion 31, 31' for fixedly mounting a switch lever 32, 32' having an oblong hole 64, 64' (FIGS. 5, 7, and 12, 14), for turning the pawl 24, 24' between modes of tightening and loosening fasteners. The first and the second heads 16, 16' each further includes a groove 19, 19' defined in a top end for mounting a ring element 20, 20' having a yoke 33, 33' (FIGS. 5, and 12), for restraining the axial cylinder 30, 30' of the pawl 24, 24' in the U-shaped section 18, 18' of the drive housing 17, 17' (FIGS. 6, 7, and 13, 14), thereby stabilizing pivotal movement of the pawl 24, 24' when the pawl 24, 24' is turned.

A first and a second drive members 21, 21' are rotatably held in the drive housings 17, 17', and each respectively includes a flange 34, 34' projecting radially outward from a top end of an outer periphery 23, 23' and abutting against a top end face of the ring element 20, 20' (FIGS. 5, 7, and 12, 14). The first and the second drive members 21, 21' each also includes gear teeth 22, 22' (FIGS. 5, and 12, in which part of gear teeth 22, 22' are not displayed for illustrating the internal structures formed with the first and the second drive members 21, 21' only) defined in the outer periphery 23, 23', and each also includes an annular groove 60, 60' defined in a bottom end of the outer periphery 23, 23' and located outside a bottom end of the first and the second heads 16, 16'. Two C-retainers such as C-clips 61, 61' each is received in the annular groove 60, 60' and abuts against a face of the bottom end of the first and the second heads 16, 16' (FIGS. 5, 7 and 12, 14), thereby preventing the first and the second drive members 21, 21' from falling out of the drive housings 17, 17'.

Figure 5:
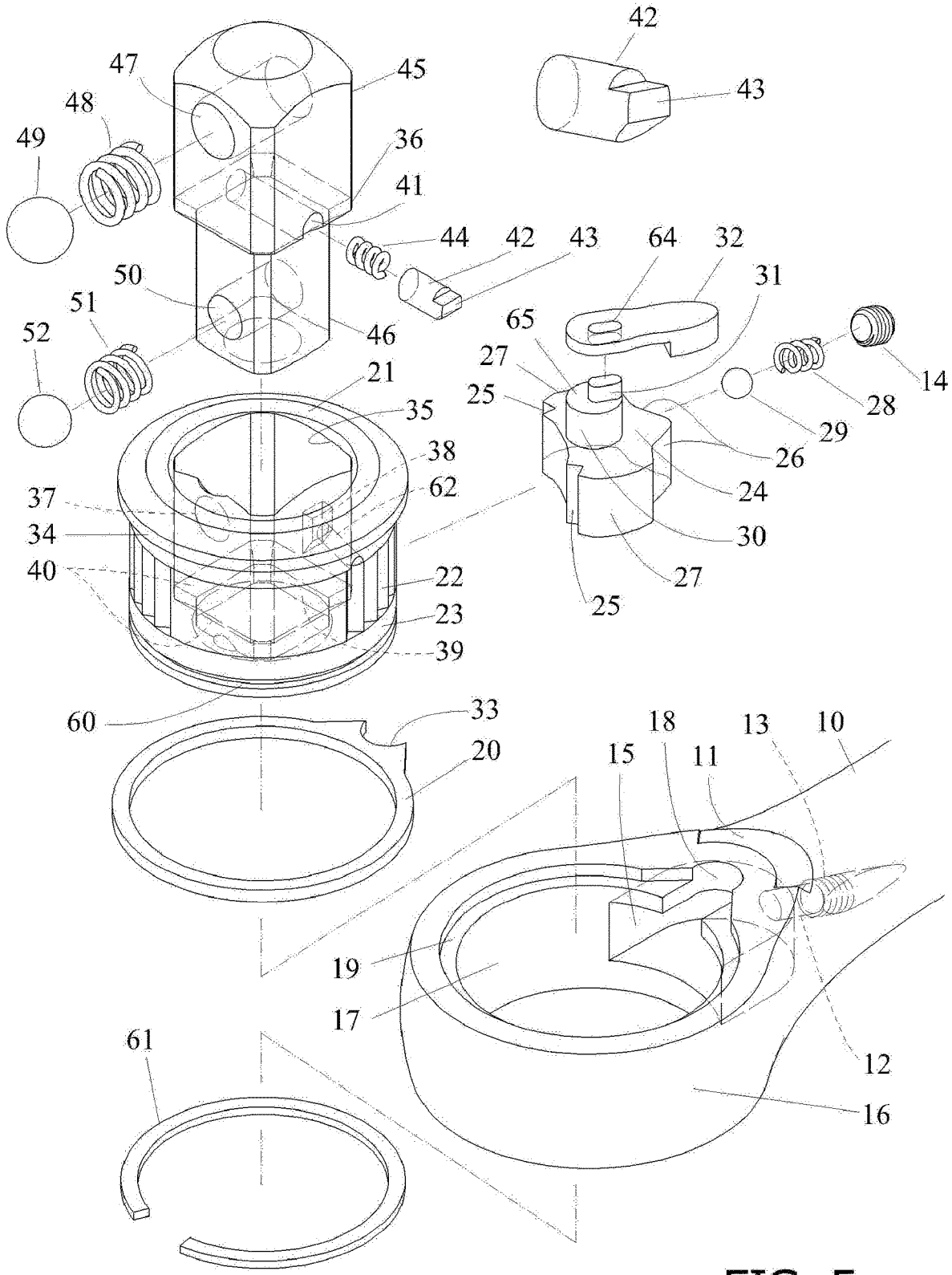
Figure 6:
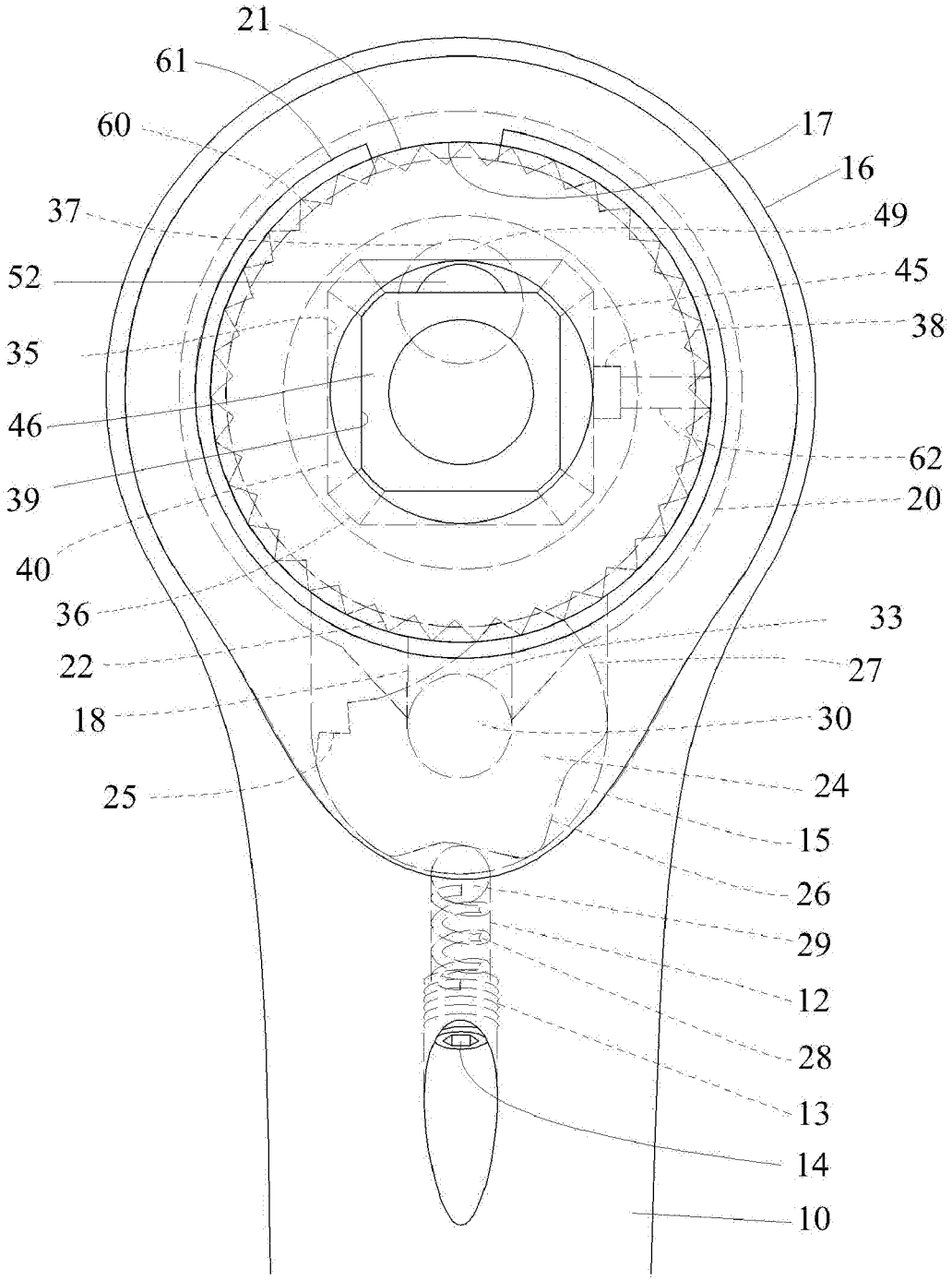
Figure 7:
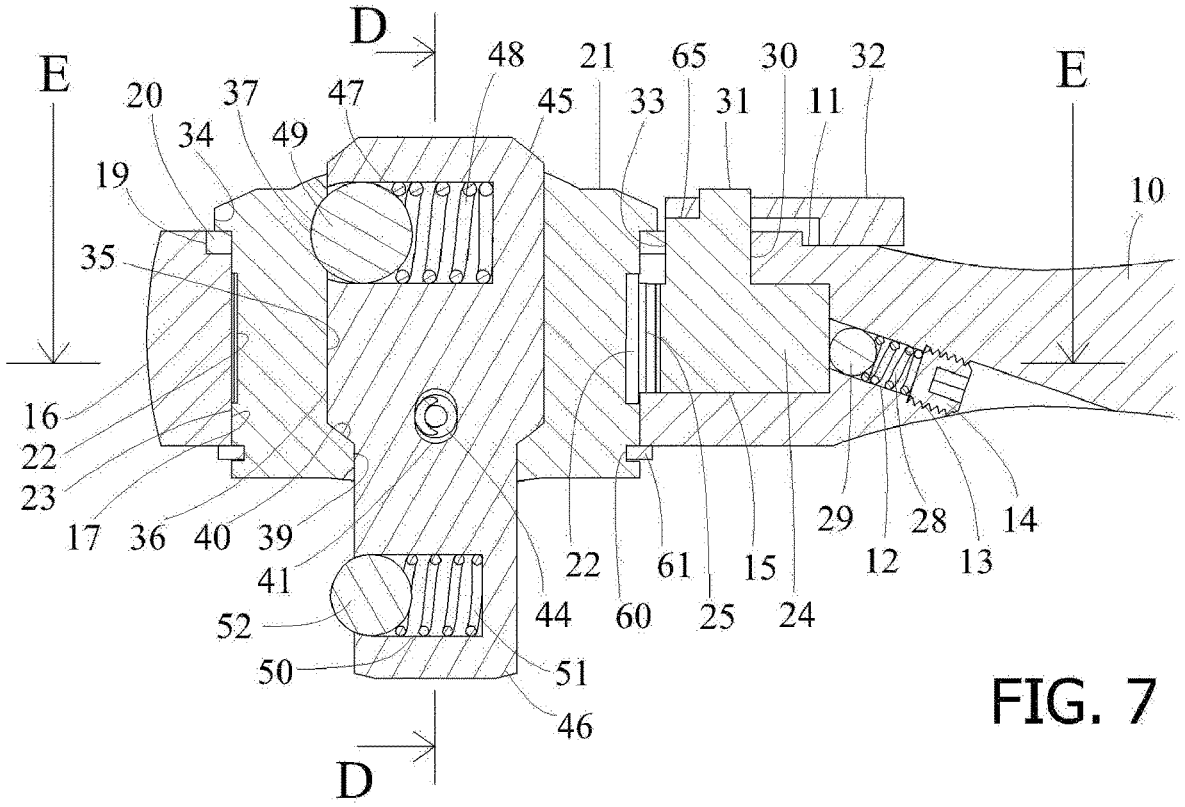
FIG. 7 is a cross sectional view taken along lines C-C in FIG. 4.
Figure 8:
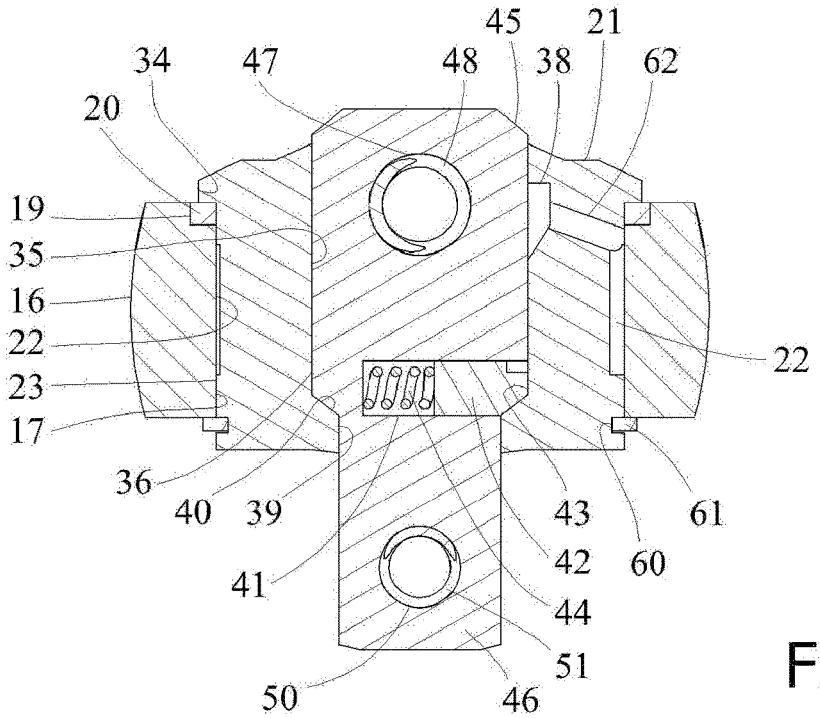
FIG. 8 is a sectional view taken along lines D-D in FIG. 7.

The first drive member 21 further includes a substantially square inner periphery 35 adapted to receive a drive shaft 36 therein, including a detent 37 and a notch 38 defined therein and spaced apart perpendicularly. The square inner periphery 35 includes a square flange 39 integrally formed and inwardly projecting from a bottom end thereof and having beveled faces 40 (FIGS. 5, 6, 7, 8). The drive shaft 36 includes an oval hole 41 for receiving a oval pin 42 and a spring 44. The drive shaft 36 also includes an upper portion formed with a ½" drive fitting 45 and a lower portion formed with a ⅜" drive fitting 46 each respectively including a bore 47, 50 for retaining a spring 48, 51 and a retention ball 49, 52 (FIGS. 5, 7, 8). The drive shaft 36 is turned jointly with the first drive member 21 when the first drive member 21 is turned, and is prevented from dropping out of the square inner periphery 35 by the oval pin 42 with an engagement end 43 biased by the spring 44 to engage with the notch 38 (FIG. 10), thereby being retained in the square inner periphery 35. The first drive member 21 further includes a through orifice 62 communicated with the notch 38 (FIGS. 5, 6, 8), for insertion of a pin 63 with which the oval pin 42 may be disengaged from the notch 38 by poking the oval pin 42 in the engagement end 43 (FIGS. 10, 10A), for disassembling the drive shaft 36 from the first drive member 21 through the top end of the square inner periphery 35.

The drive shaft 36 may be urged to slide downward in the square inner periphery 35, and forces the oval pin 42 to fully rest in the oval hole 41 by friction, and is stopped by the square flange 39 (FIGS. 7, 8) when a thumb pressure (not indicated) is applied to an upper end of the drive shaft 36, which causes the retention ball 49 biased by the spring 48 to engage with the detent 37 (FIG. 7), thereby holding and recessing the ½" drive fitting 45 in the square inner periphery 35 for maintaining a profile of an ordinary ratchet wrench on the first end of the handle 10 and thereby setting the ⅜" drive fitting 46 in position outside the bottom end of the first drive member 21 (FIGS. 7, 8). Thus, when the first drive member 21 is turned, the ⅜" drive fitting 46 may be turned jointly with the first drive member 21, and thus may turn fasteners with a fastener-driving element (e.g., a socket with a ⅜" drive, not shown) releasably engaged with the ⅜" drive fitting 46, such that the ratchet wrench of the present invention may be used to function as an ordinary ratchet wrench with a ⅜" drive for turning fasteners and will not be affected or obstructed by the ½" drive fitting 45 (FIGS. 7, 8) from getting into confined spaces for turning fasteners with the socket in most cases of applications.

Figure 9:
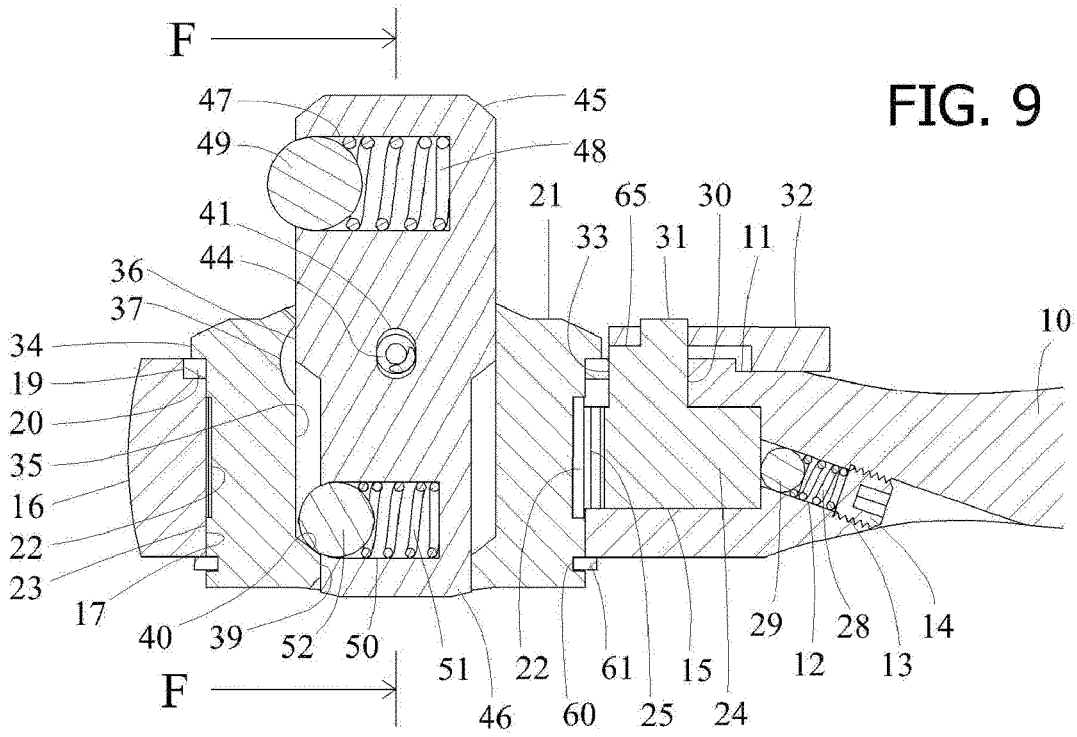
FIG. 9 is a cross sectional view similar to FIG. 7.
Figure 10:
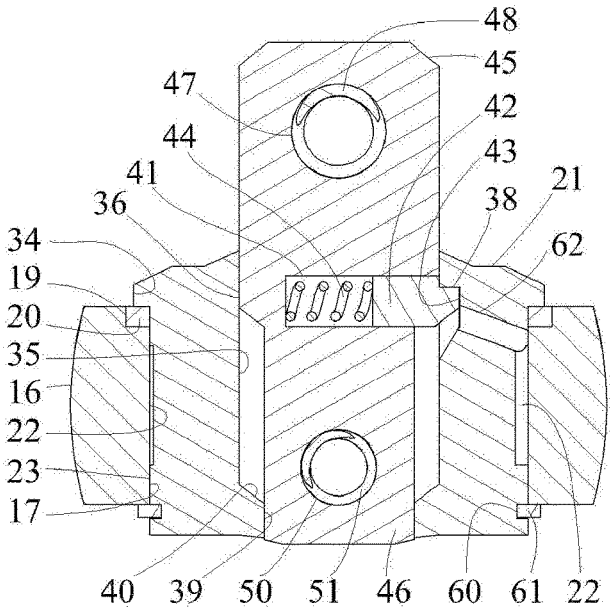
FIG. 10 is a sectional view taken along lines F-F in FIG. 9.
Figure 10A:
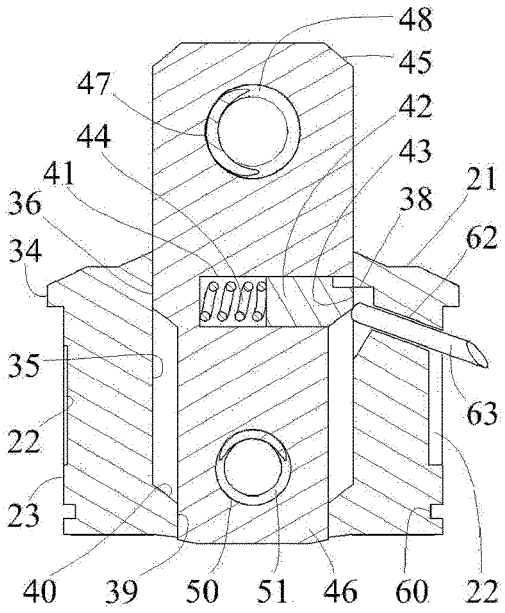
FIG. 10A is a sectional view similar to FIG. 10, illustrating a method of disassembling a drive shaft from a first drive member of the first embodiment of the ratchet wrench.

The drive shaft 36 may also be urged to slide upward in the square inner periphery 35 (FIGS. 9, 10) when a thumb pressure (not indicated) is applied to a lower end of the drive shaft 36, which causes the retention ball 52 biased by the spring 51 to press against one of the beveled faces 40 of the square flange 39 (FIG. 9), and the oval pin 42 to release by the spring 44 and lock into the notch 38 (FIG. 10), thereby holding and recessing the ⅜" drive fitting 46 in the square inner periphery 35 for maintaining a profile of an ordinary ratchet wrench on the first end of the handle 10 and thereby setting the ½" drive fitting 45 in position outside the top end of the first drive member 21 (FIGS. 9, 10). Thus, when the first drive member 21 is turned, the ½" drive fitting 45 may be turned jointly with the first drive member 21, and thus may turn fasteners with a fastener-driving element (e.g., a socket with a ½" drive, not shown) releasably engaged with the ½" drive fitting 45, such that the ratchet wrench of the present invention may be used to function as an ordinary ratchet wrench with a ½" drive for turning fasteners and will not be affected or obstructed by the ⅜" drive fitting 46 (FIGS. 9, 10) from getting into confined spaces for turning fasteners with the socket in most cases of applications.

Figure 11:
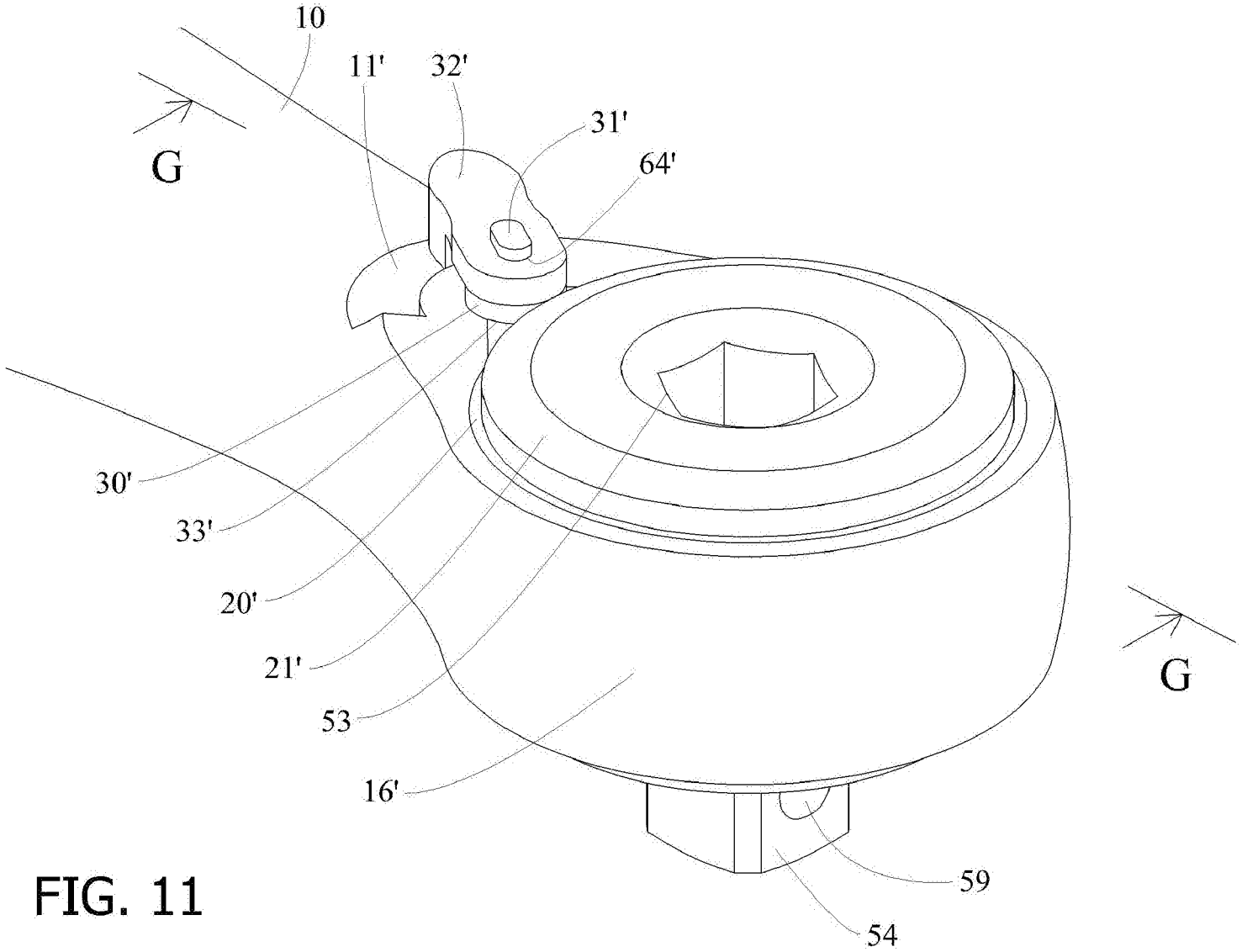
FIGS. 11, 12, and 13 respectively are a perspective view, an exploded view, and a bottom view, of a second end section between lines B-B and B'-B' in FIG. 2, of the first embodiment of the ratchet wrench.
Figure 12:
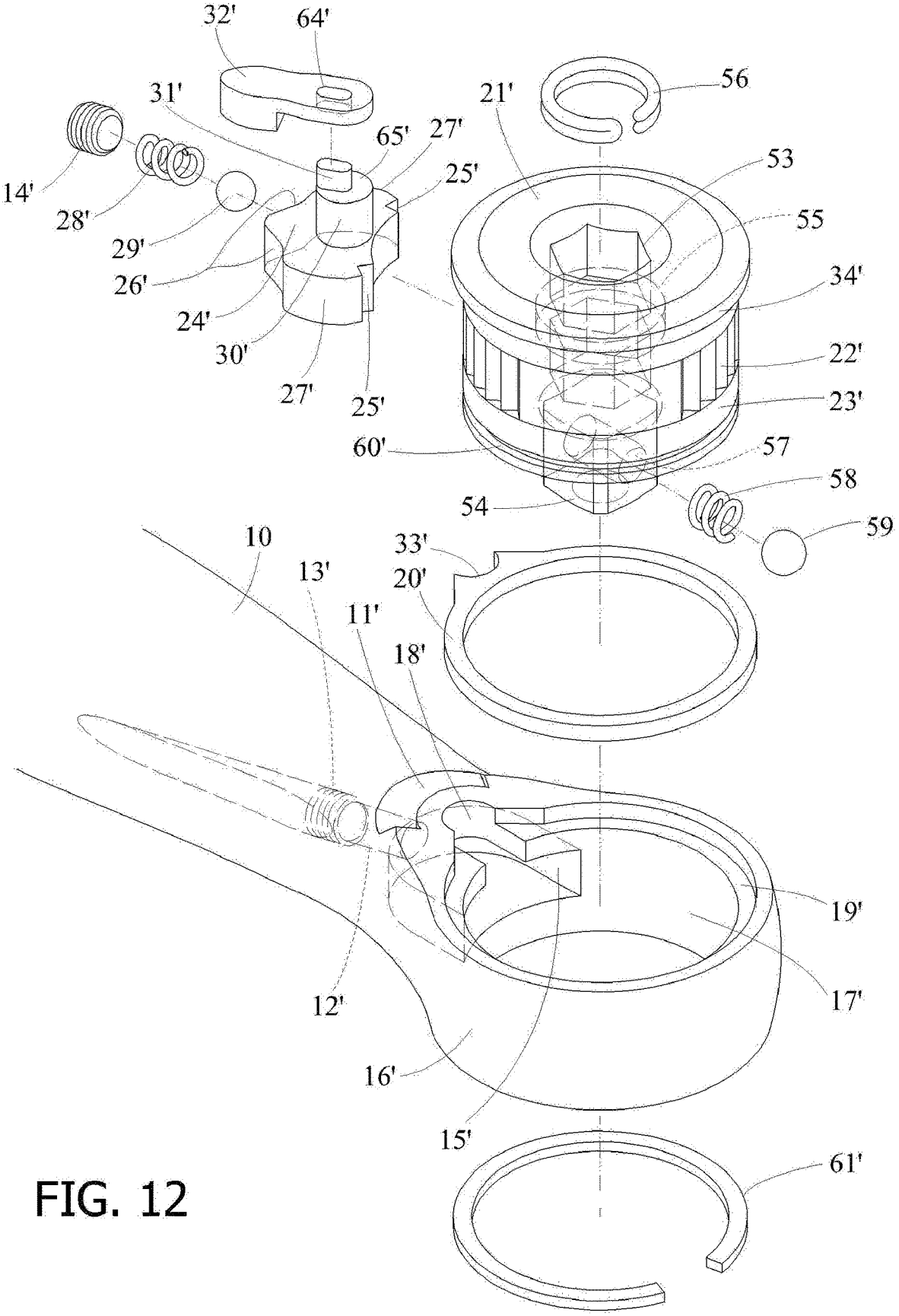
Figure 13:
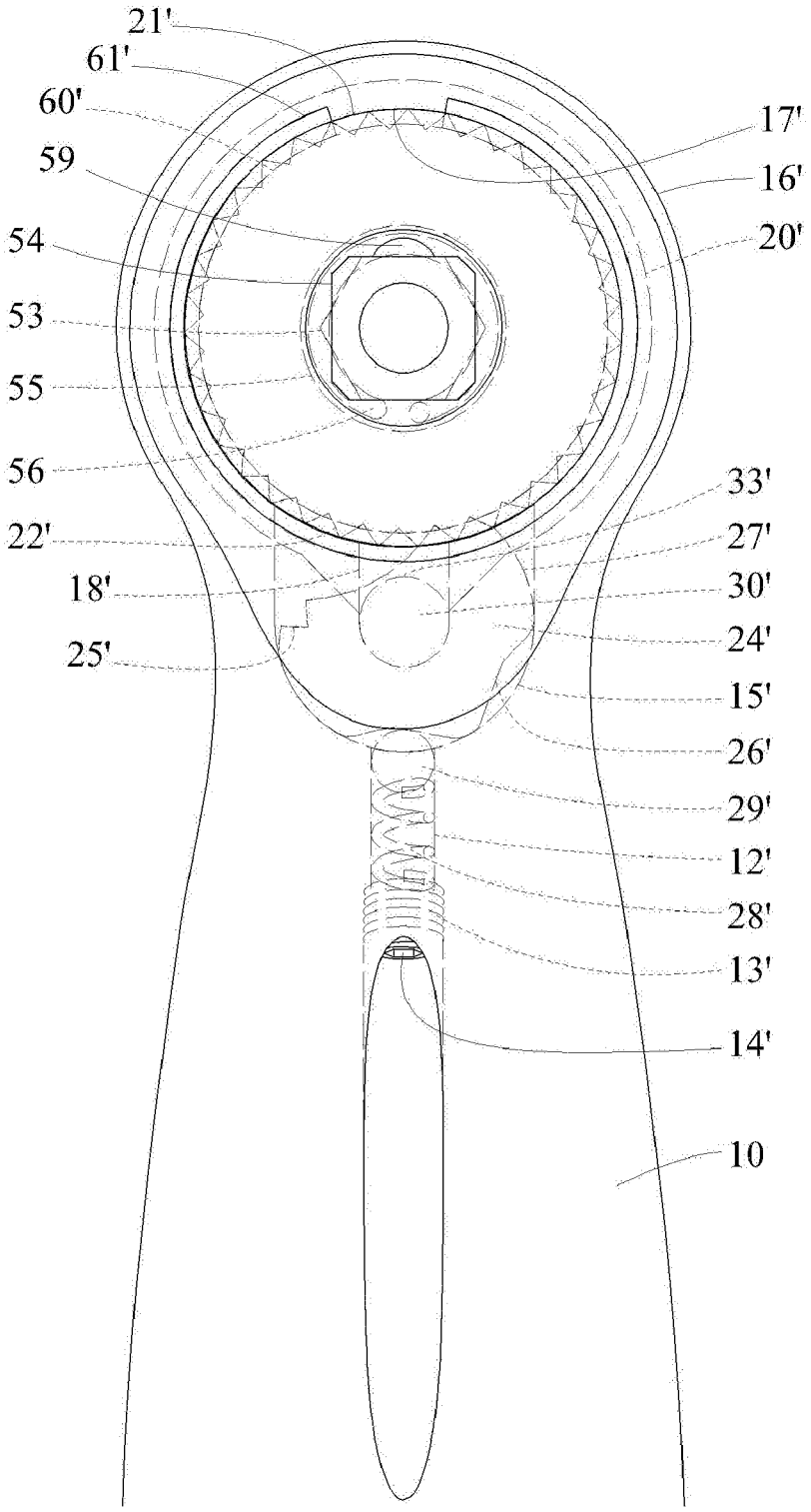
Figure 14:
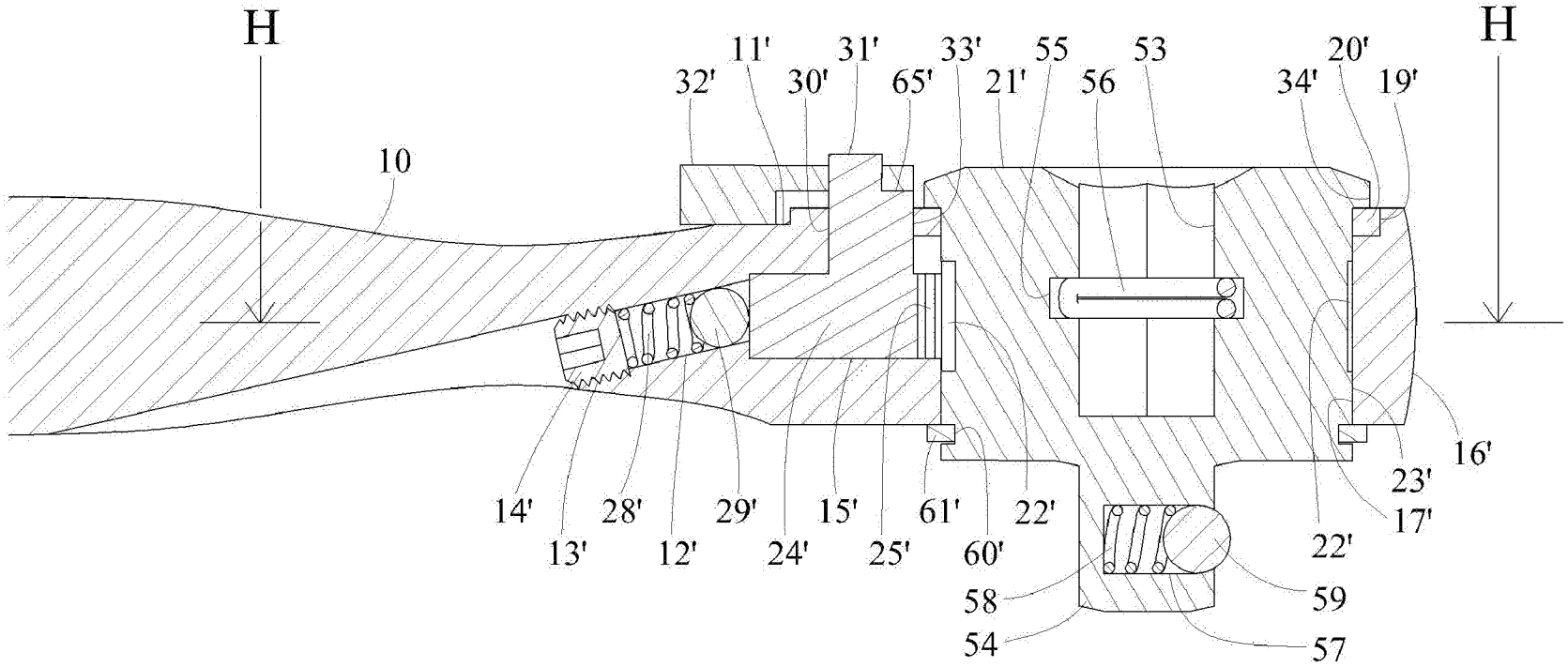
FIG. 14 is a cross sectional view taken along lines G-G in FIG. 11.

The second drive member 21' further includes a ¼" drive hexagonal bit holder 53 formed and recessed in a top end thereof to thereby maintain a profile of an ordinary ratchet wrench on the second end of the handle 10. The second drive member 21' further includes a ¼" drive fitting 54 integrally formed on a bottom end thereof, including a bore 57 for retaining a spring 58 and a retention ball 59 (FIGS. 11, 12, 14). The ¼" drive fitting 54 may be turned when the second drive member 21' is turned, and thus may turn fasteners with a fastener-driving element (e.g., a socket with a ¼" drive, not shown) releasably engaged with the ¼" drive fitting 54, such that the ratchet wrench of the present invention may be used to function as an ordinary ratchet wrench with a ¼" drive for turning fasteners and will not be affected or obstructed by the ¼" drive hexagonal bit holder 53 (FIG. 14) from getting into confined spaces for turning fasteners with the socket in most cases of applications. The ¼" drive hexagonal bit holder 53 includes an annular groove 55 defined therein for partially receiving a double C retainer 56 (FIGS. 12, 14) that releasably holds a fastener-driving element (e.g., a bit with a ¼" drive, not shown) in the ¼" drive hexagonal bit holder 53 by grasping the bit. The fastener-driving element (the bit) may be turned jointly with the ¼" drive hexagonal bit holder 53 when the second drive member 21' is turned, and thus may turn fasteners engaged with the bit, and thus the ratchet wrench of the present invention may also be used to provide a function of the ¼" drive hexagonal bit holder 53 for turning fasteners with the bit.

The pawls 24, 24' each further includes two inclined faces 26, 26' and two sets of lockup teeth 25, 25' each set including one or more lockup teeth 25, 25' for selectively meshing with the gear teeth 22, 22' of the first and the second drive members 21, 21'. The pawls 24, 24' each further includes two pressing faces 27, 27' for selectively pressing against a wall of the cavity 15, 15' for turning the first and the second drive members 21, 21' (FIGS. 15, 16, and 19, 20). A friction ball 29, 29' and a spring 28, 28' are received in the inclined through hole 12, 12', with one end of the spring 28, 28' attached to the setscrew 14, 14' and with the other end of the spring 28, 28' attached to the friction ball 29, 29', for biasing the friction ball 29, 29' to butt against the pawl 24, 24' (FIGS. 7, and 14).

Figure 16:
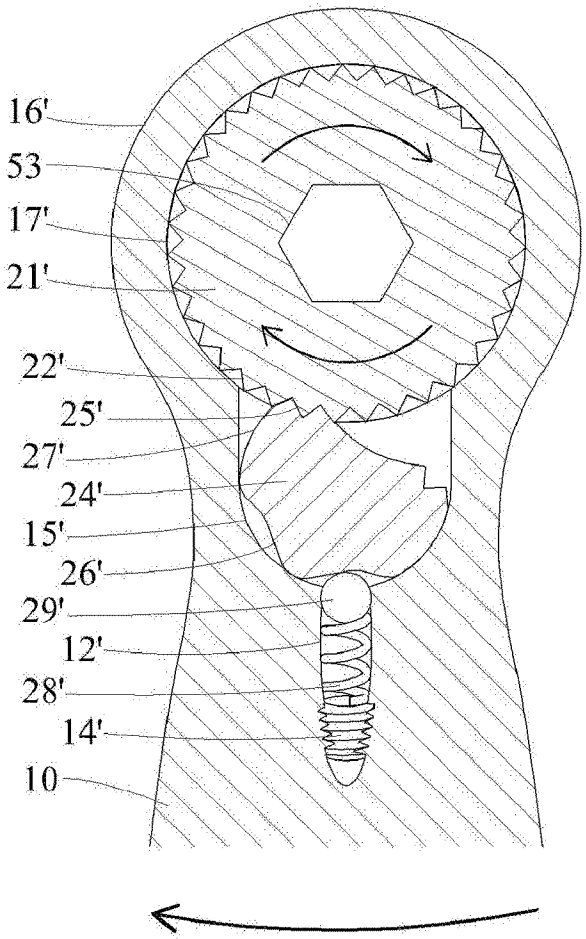
FIGS. 15 and 16 are sectional views which are taken respectively along lines E-E in FIG. 7 and alone lines H-H in FIG. 14, for illustrating tightening mode operation of the first embodiment of the ratchet wrench.
Figure 15:
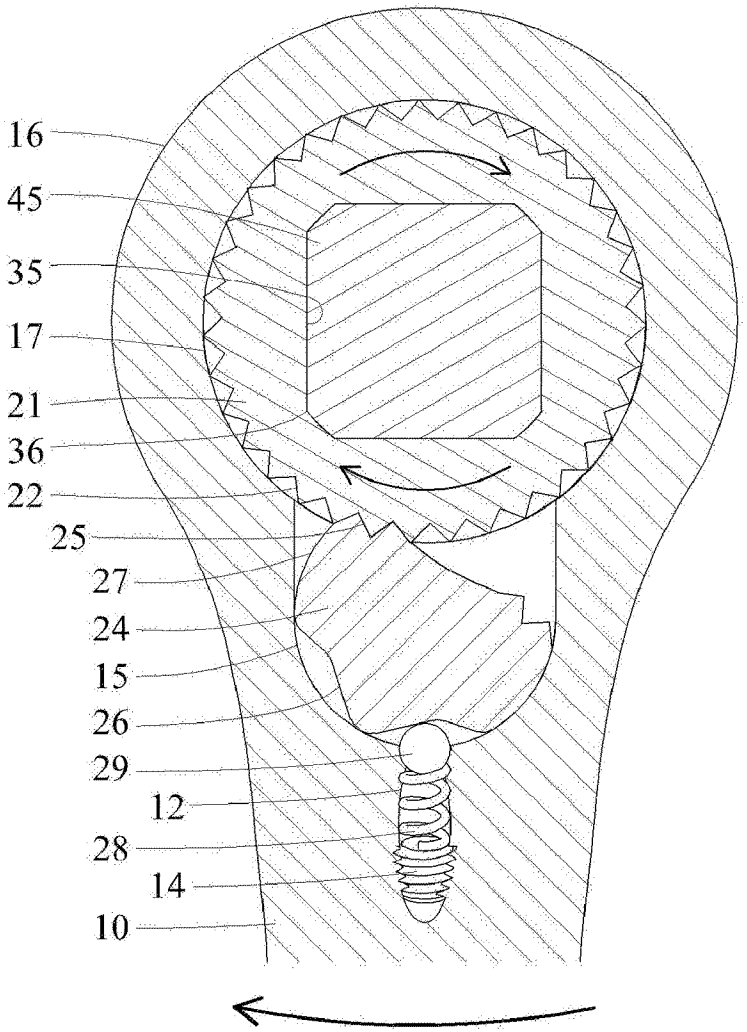
Figure 17:
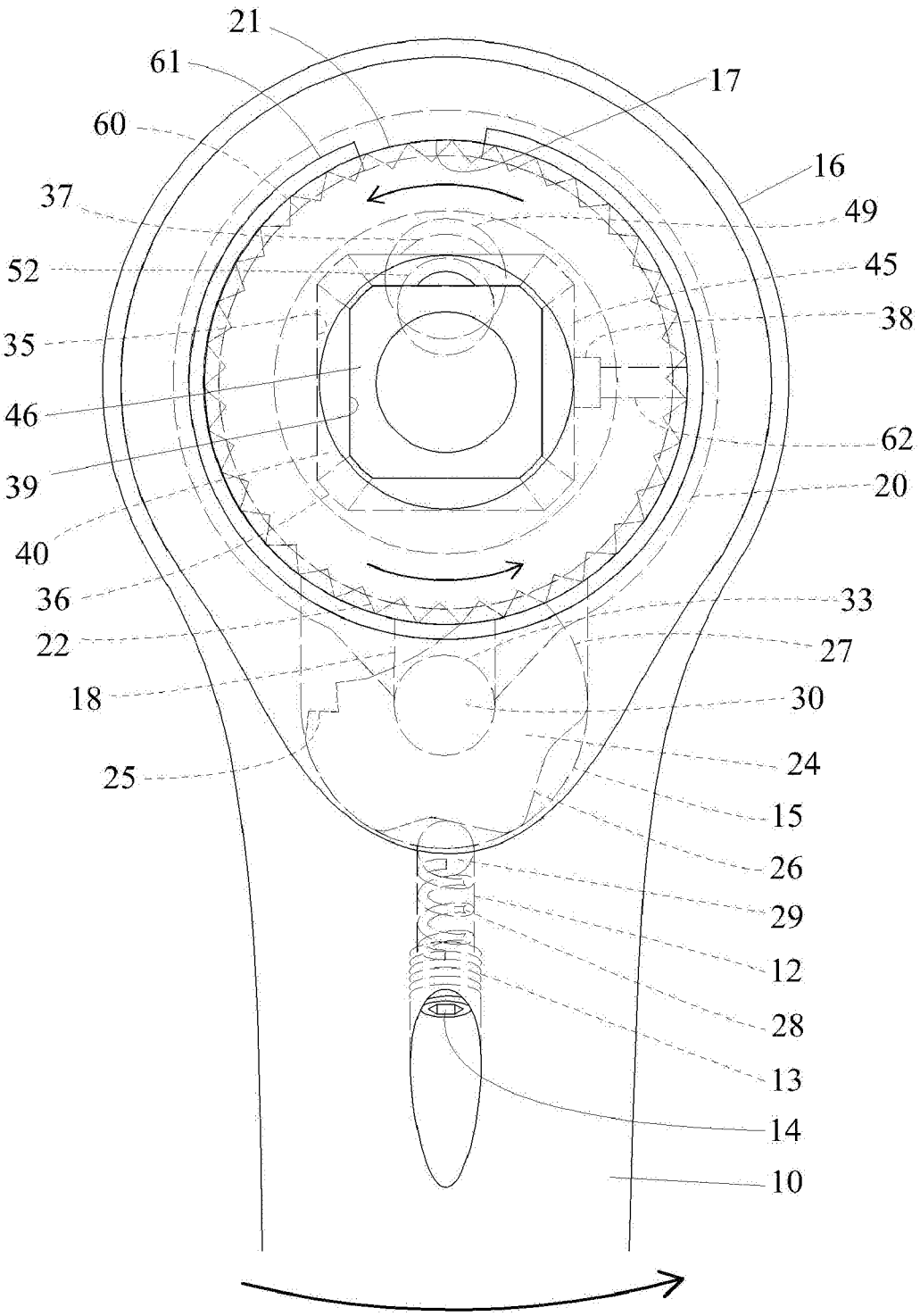
FIGS. 17 and 18 are bottom views, similar to FIGS. 6 and 13, for illustrating operation of the first embodiment of the ratchet wrench.
Figure 18:
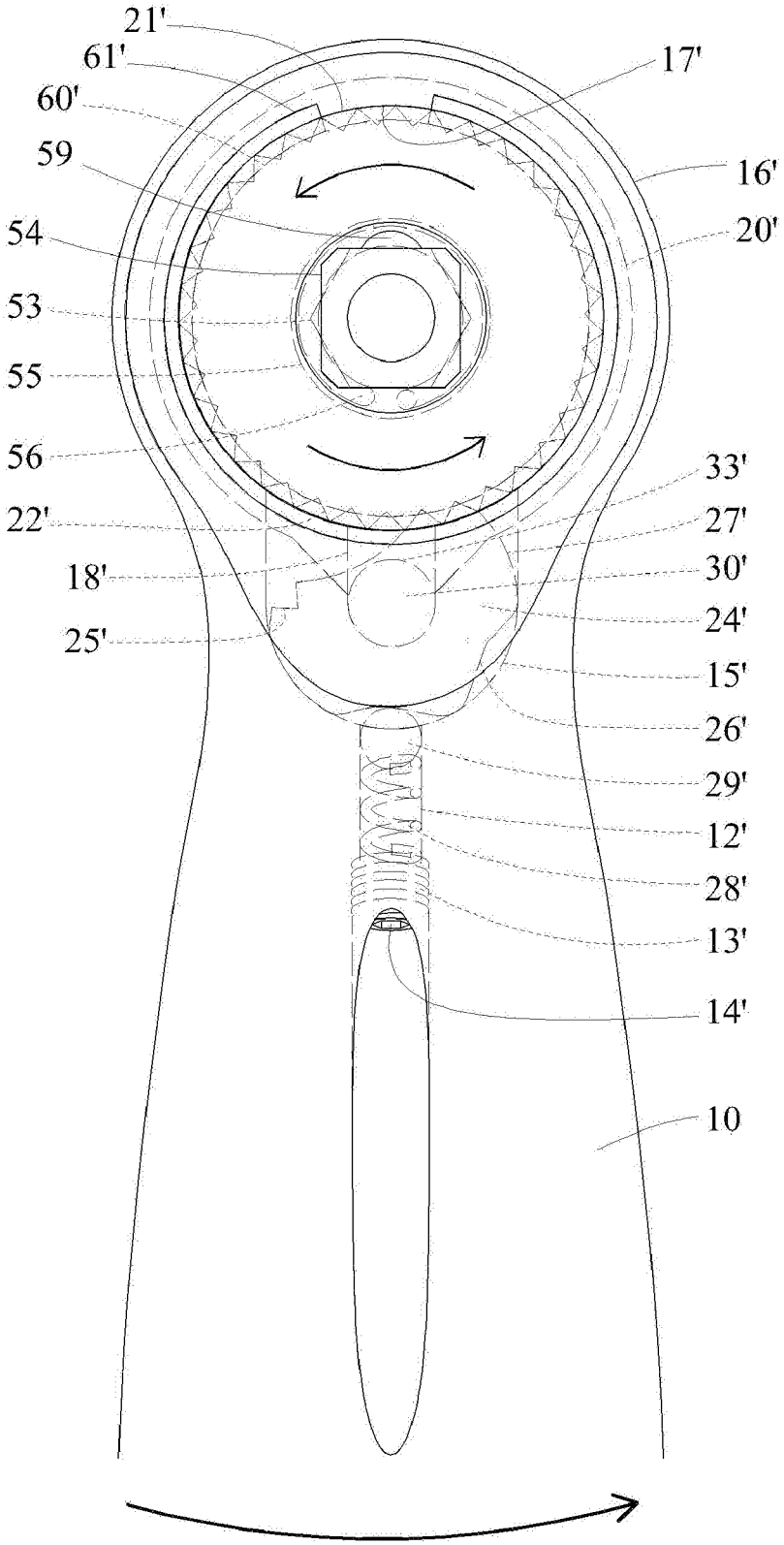

In operation, as shown in FIGS. 15 and 16, the spring 28, 28' biases the friction ball 29, 29' to butt against one of the two inclined faces 26, 26' of the pawl 24, 24' to thereby urge one set of the lockup teeth 25, 25' of the pawl 24, 24' to releasably mesh with the gear teeth 22, 22' of the first and the second drive members 21, 21'. In this case, when the handle 10 is swung counterclockwise, the first and the second drive members 21, 21' may not be turned, but may be turned clockwise when the handle 10 is swung clockwise. At this moment, if the ⅜" drive fitting 46 of the drive shaft 36 (FIG. 7) and the ¼" drive fitting 54 of the second drive member 21' (FIG. 14) are to be applied for turning fasteners, the ⅜" drive fitting 46 and the ¼" drive fitting 54 will be turned clockwise for tightening fasteners, but if the ½" drive fitting 45 of the drive shaft 36 (FIG. 9) and the ¼" drive hexagonal bit holder 53 of the second drive member 21' (FIG. 14) are to be applied for turning fasteners, the ½" drive fitting 45 and the ¼" drive hexagonal bit holder 53 will be turned counterclockwise (FIGS. 17, 18) for loosening fasteners. It is noted that one of the two pressing faces 27, 27' of the pawl 24, 24' presses against the wall of the cavity 15, 15' when the first and the second drive members 21, 21' are turned.

Figure 20:
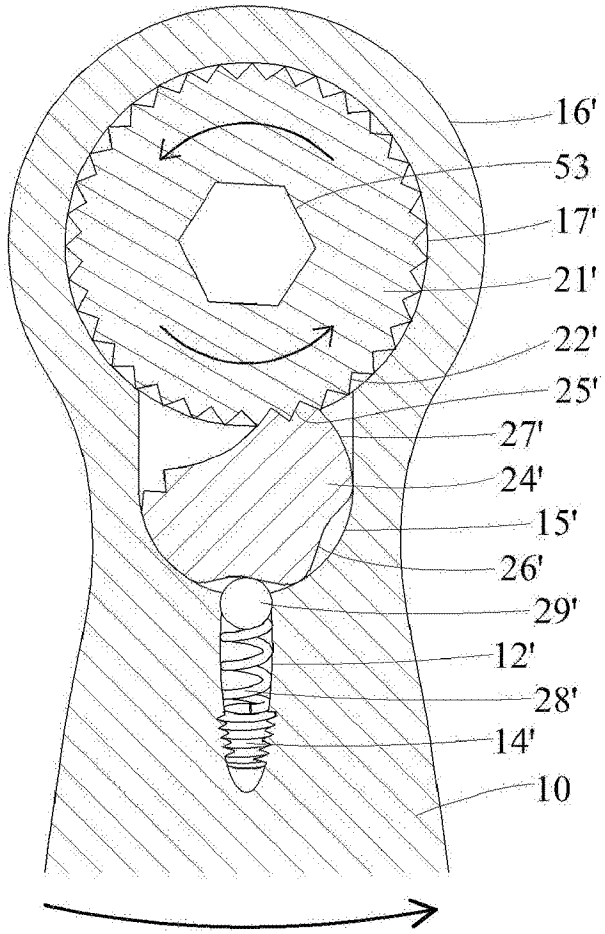
FIGS. 19 and 20 are sectional views, similar to FIGS. 15 and 16, for illustrating loosening mode operation of the first embodiment of the ratchet wrench.
Figure 19:
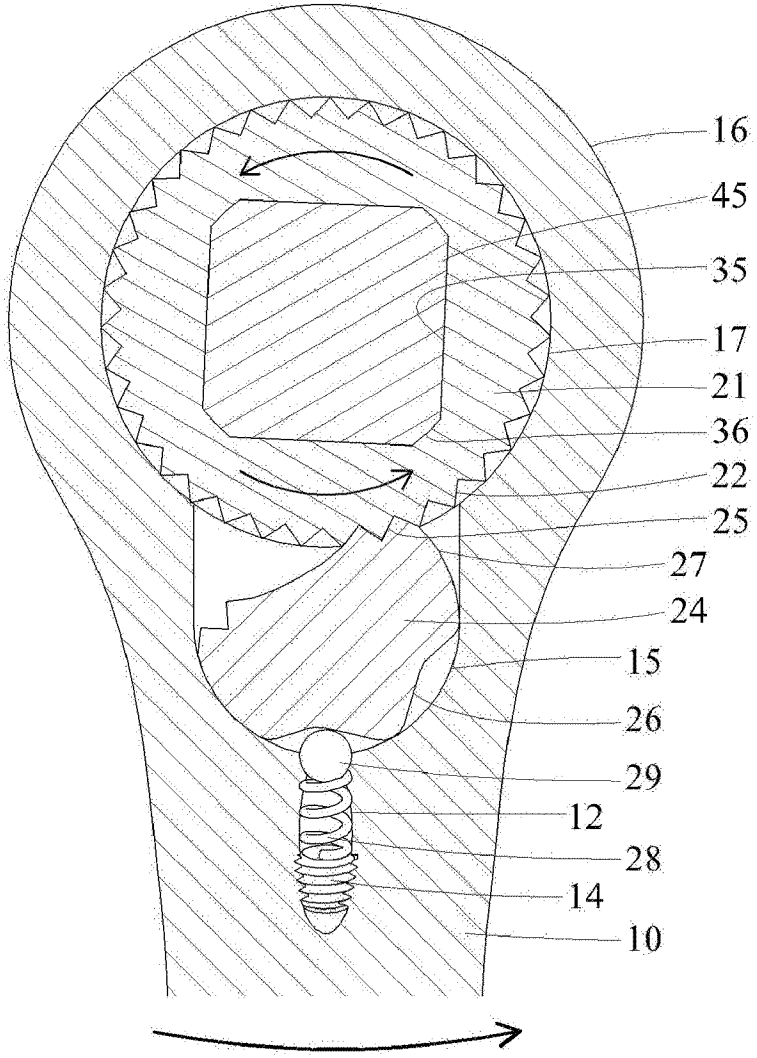
Figure 21:
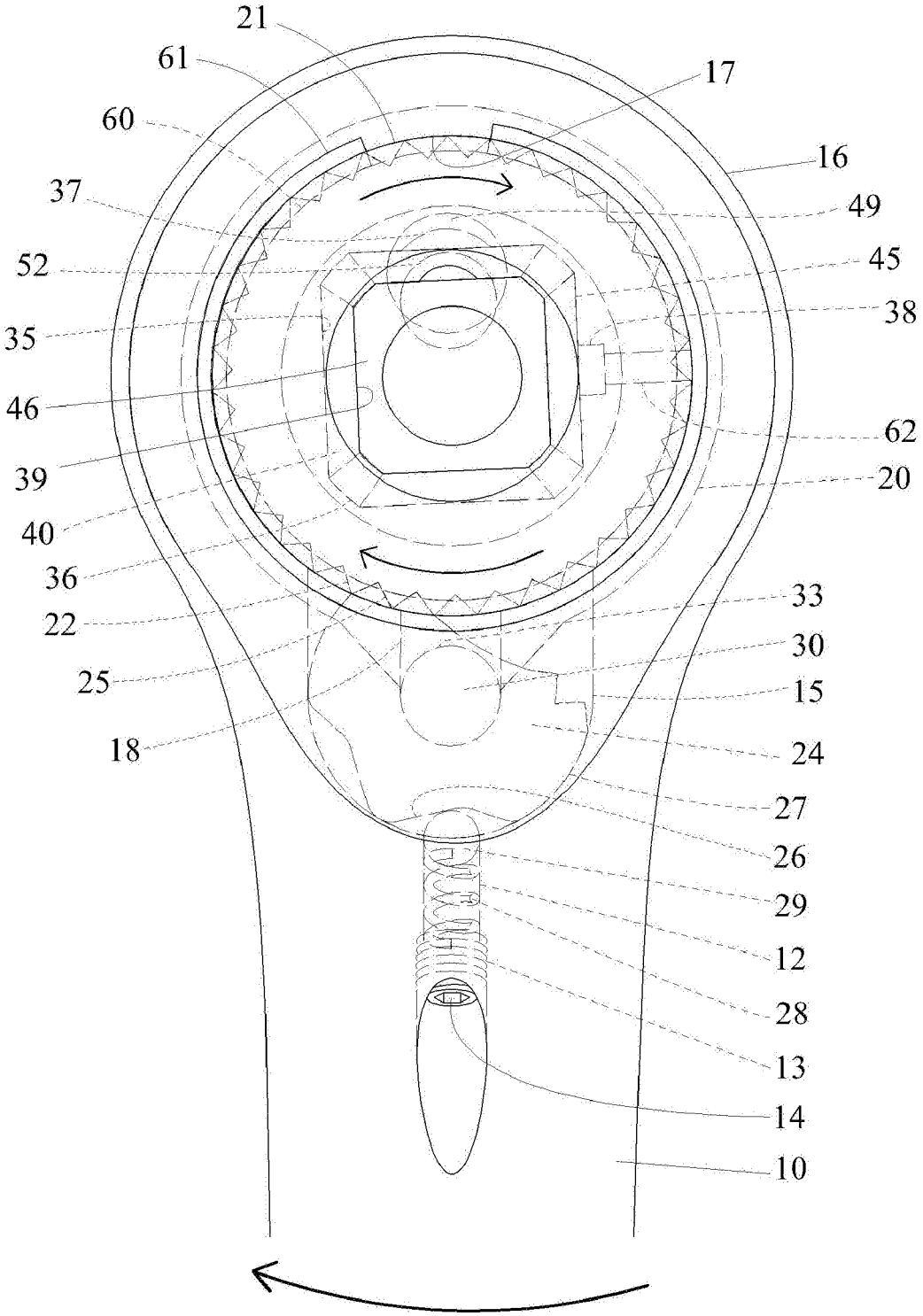
FIGS. 21 and 22 are bottom views, similar to FIGS. 6 and 13, for illustrating operation of the first embodiment of the ratchet wrench.
Figure 22:
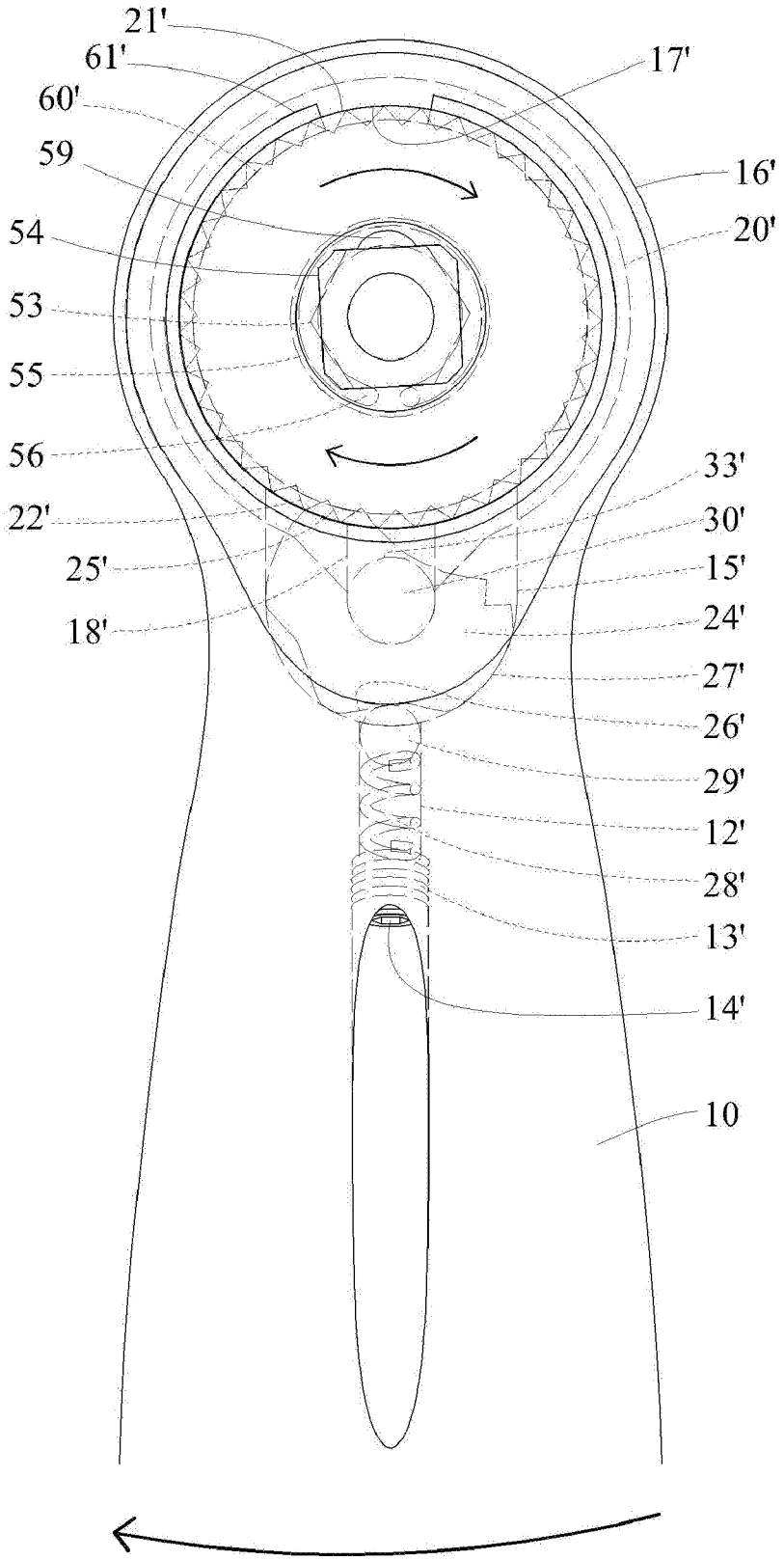
Figure 23:
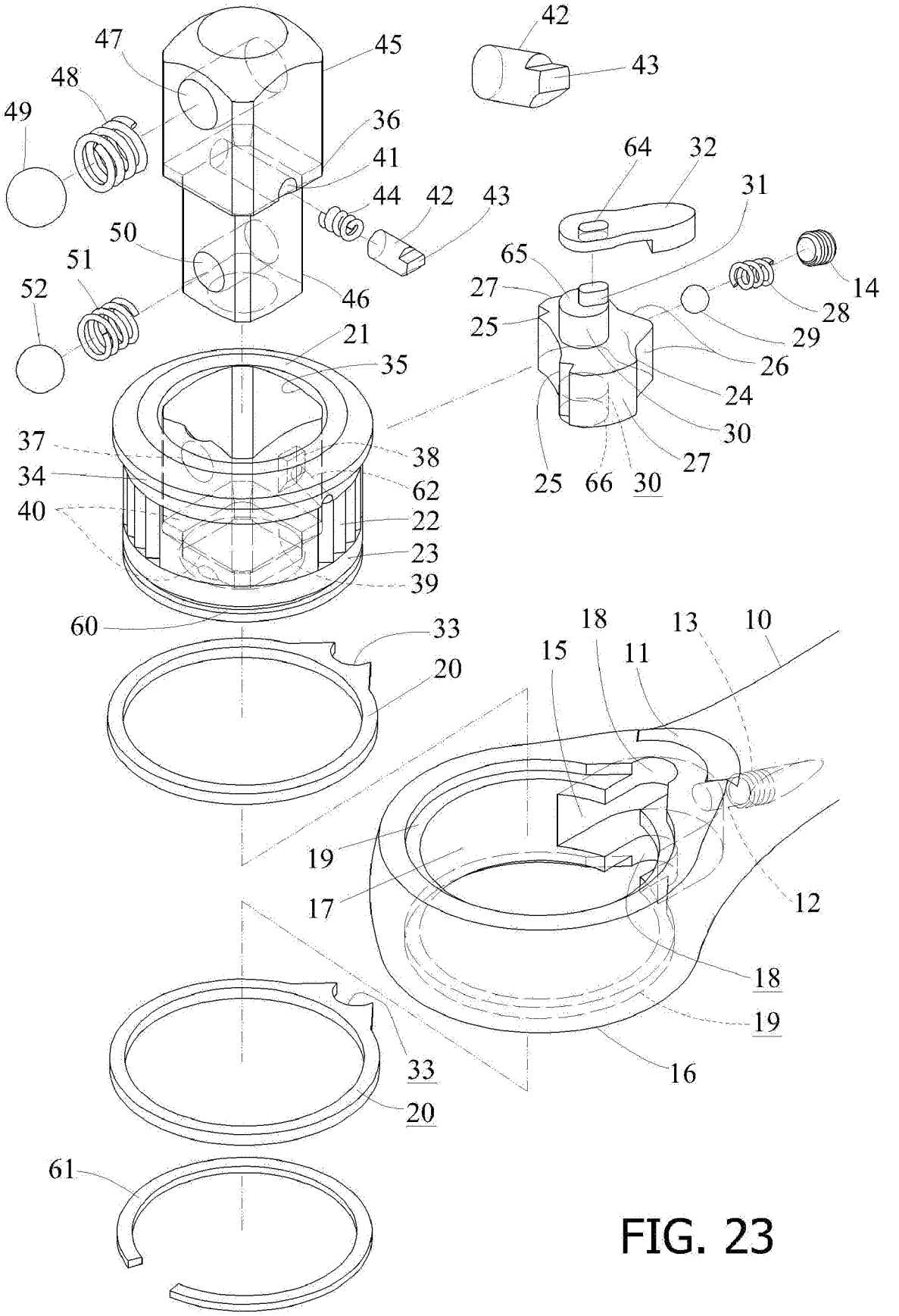
FIGS. 23 and 24 respectively are an exploded view, and a cross sectional view, of a first end section of a second embodiment derived from the first embodiment of the ratchet wrench, which are similar to FIGS. 5 and 7.
Figure 24:
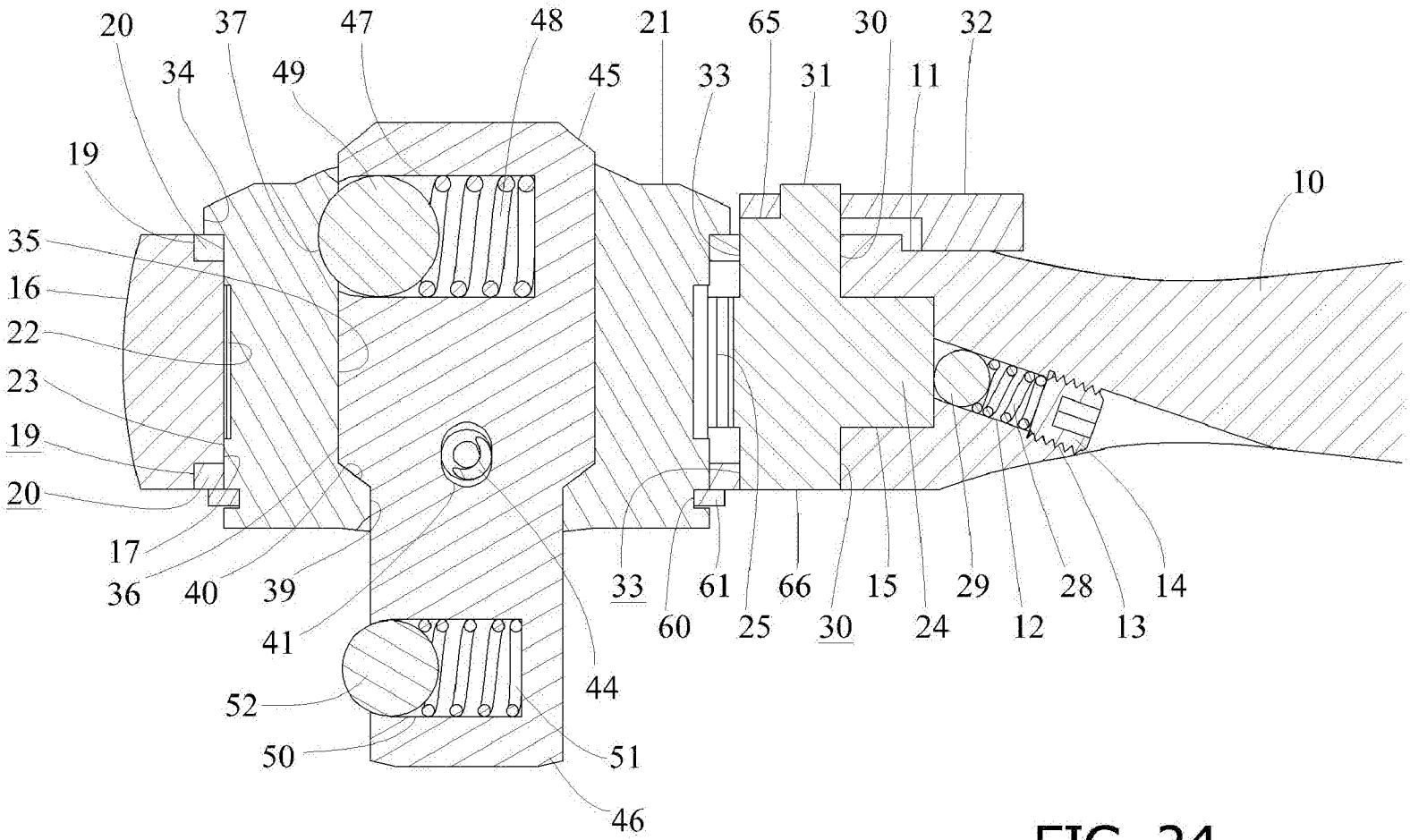
Figure 25:
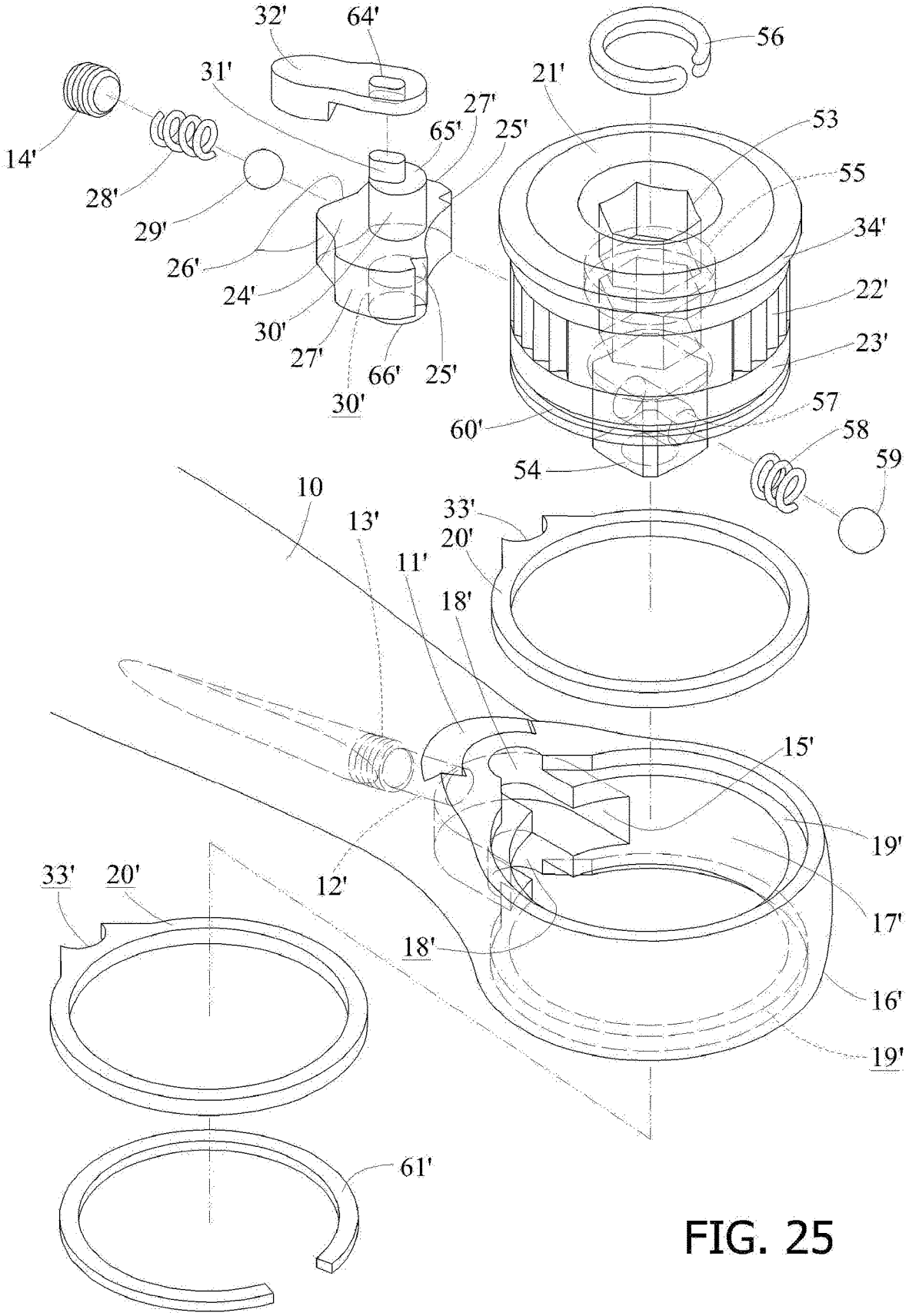
FIGS. 25 and 26 respectively are an exploded view, and a cross sectional view, of a second end section of the second embodiment derived from the first embodiment of the ratchet wrench, which are similar to FIGS. 12 and 14.
Figure 26:
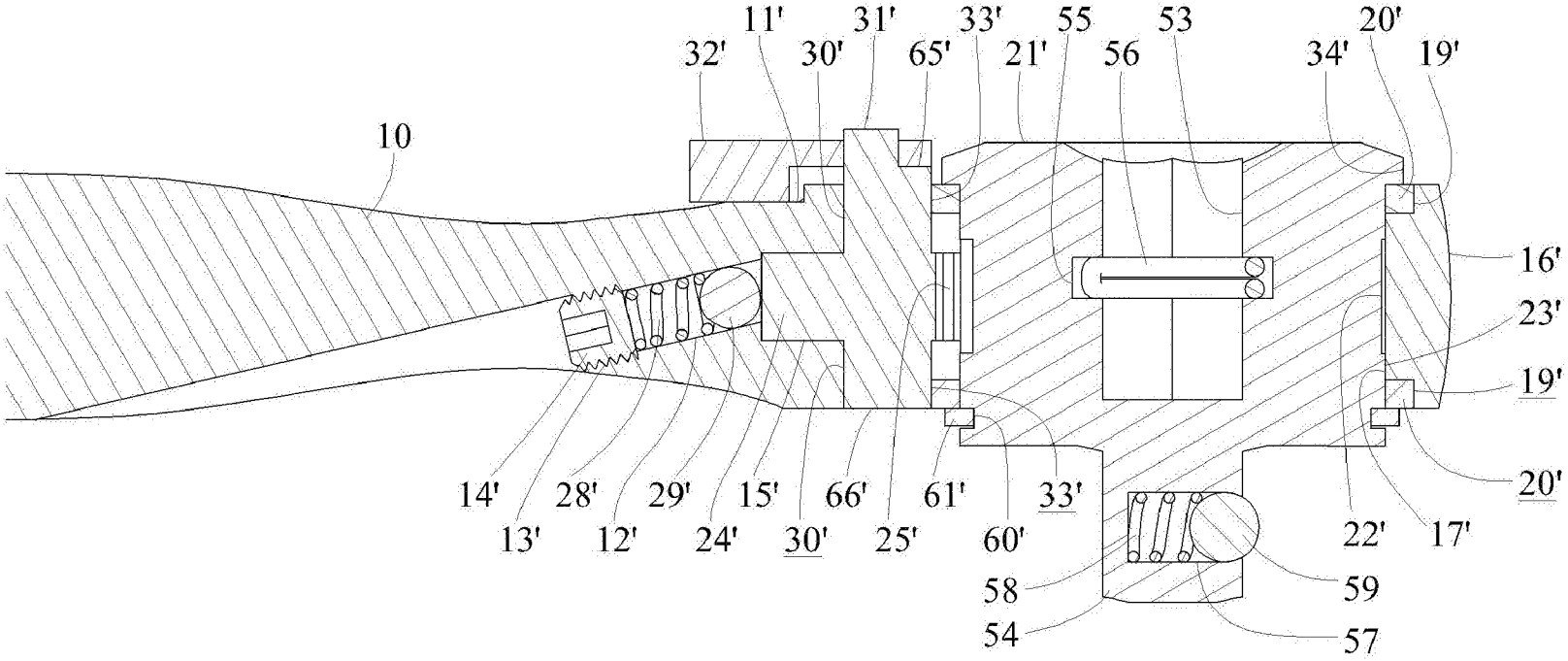
Figure 27:
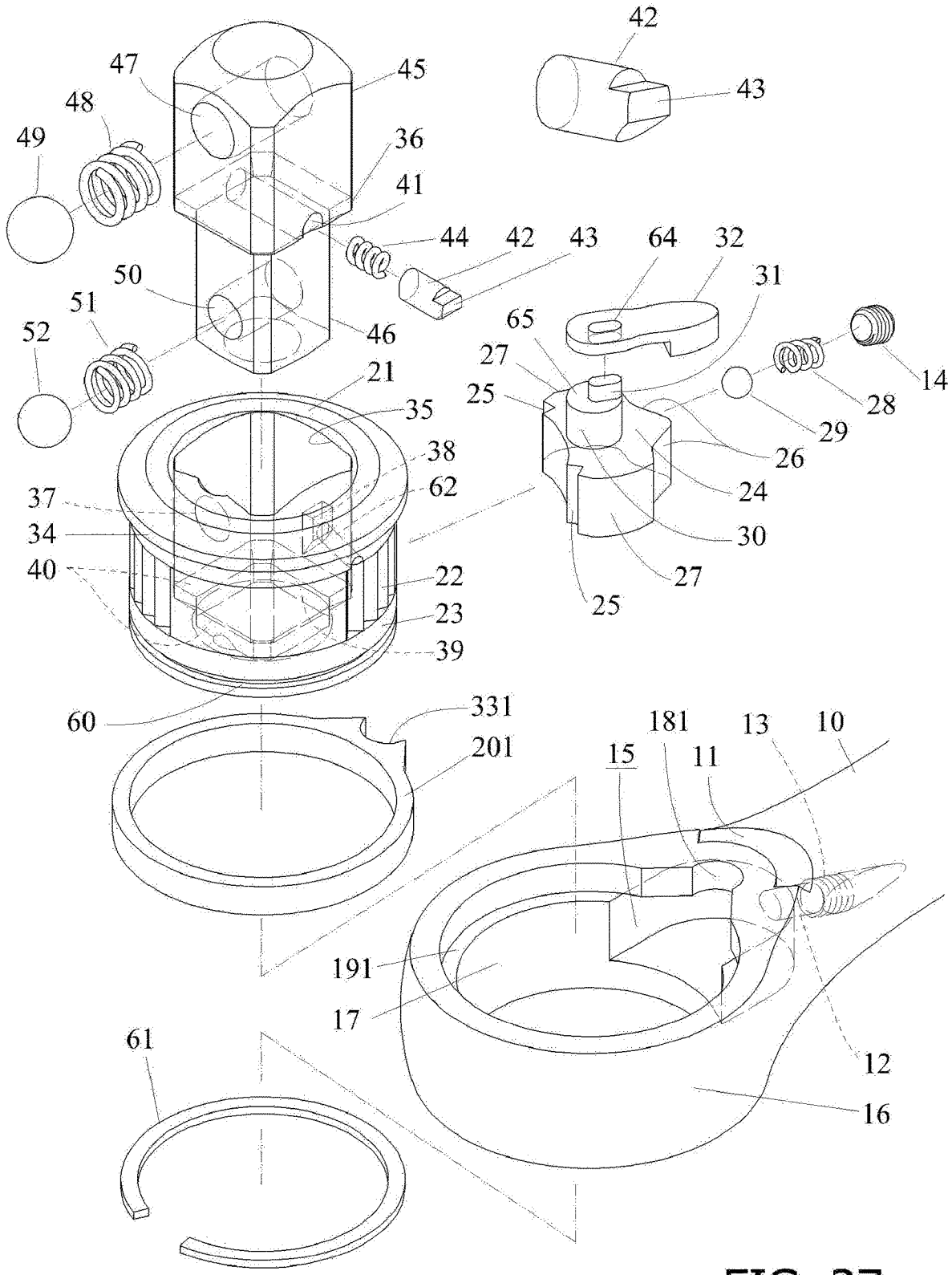
FIGS. 27 and 28 respectively are an exploded view and a side cross sectional view, of a first end section of a third embodiment derived from the first embodiment of the ratchet wrench, which are similar to FIGS. 5 and 7.
Figure 28:
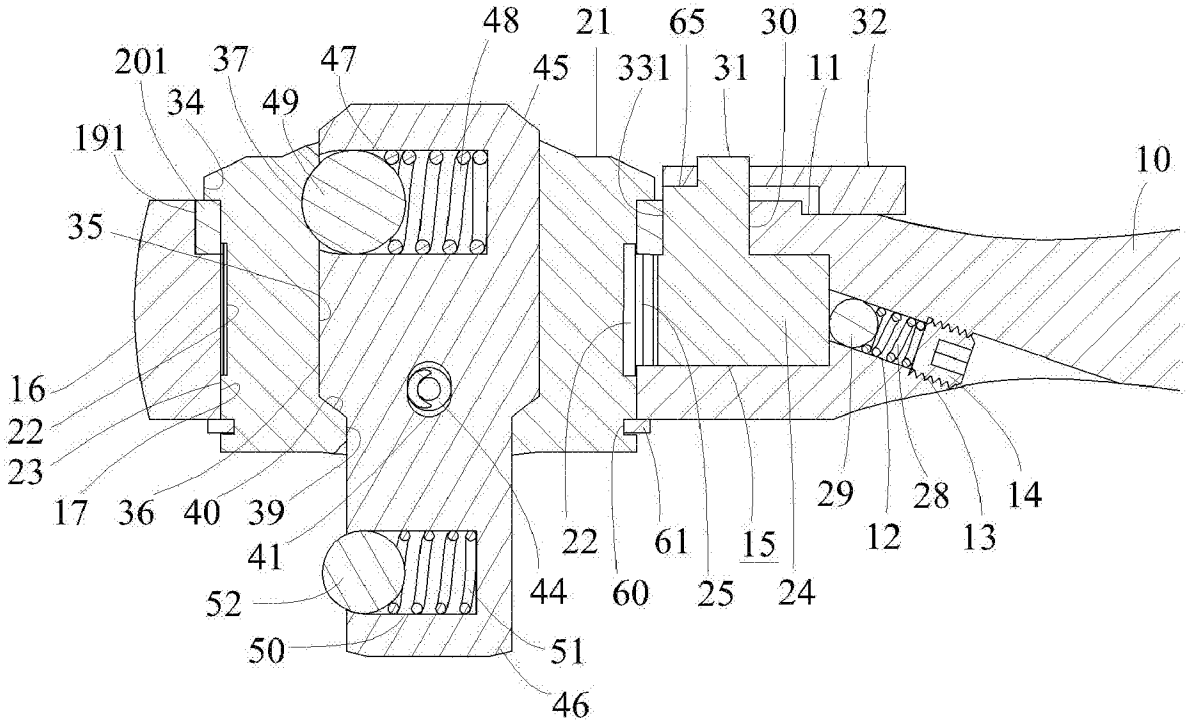
Figure 29:
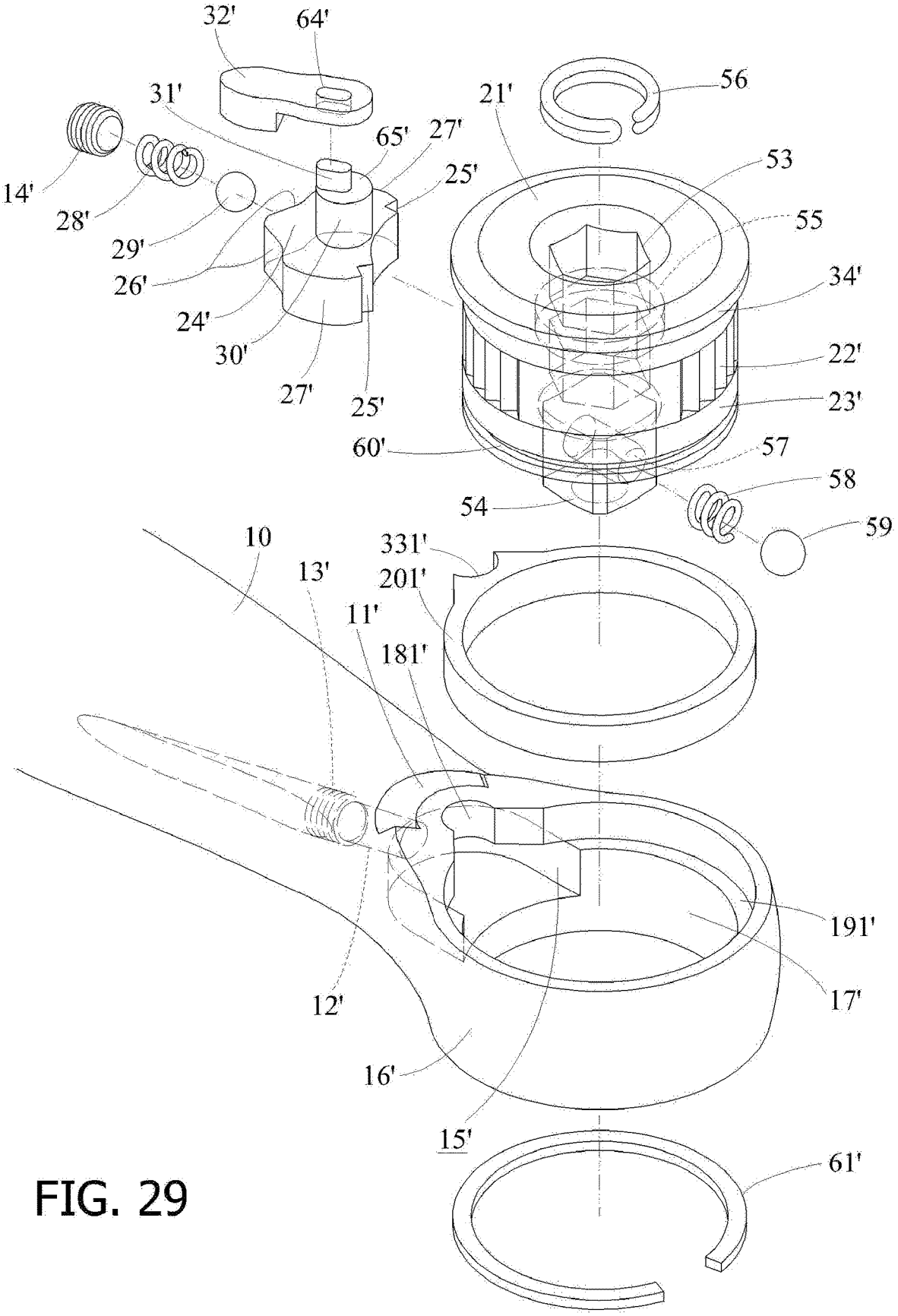
FIGS. 29 and 30 respectively are an exploded view and a side cross sectional view, of a second end section of the third embodiment derived from the first embodiment of the ratchet wrench, which are similar to FIGS. 12 and 14.
Figure 30:
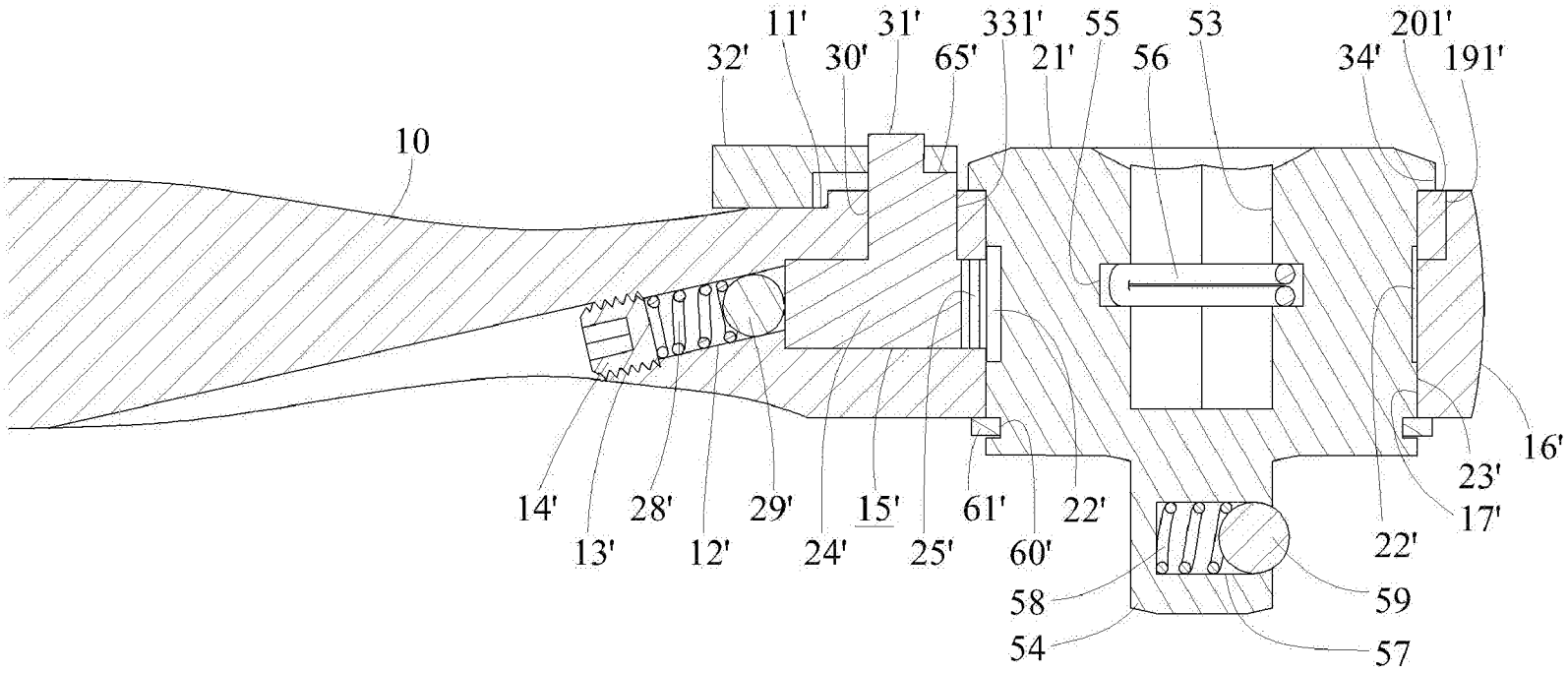

As shown in FIGS. 19 and 20, the friction ball 29, 29' is shifted to butt against the other one of the two inclined faces 26, 26' of the pawl 24, 24' to thereby urge the other set of the lockup teeth 25, 25' of the pawl 24, 24' to mesh with the gear teeth 22, 22' of the first and the second drive members 21, 21'. In this case, when the handle 10 is swung clockwise, the first and the second drive members 21, 21' may not be turned, but may be turned counterclockwise when the handle 10 is swung counterclockwise. At this moment, if the ⅜" drive fitting 46 of the drive shaft 36 (FIG. 7) and the ¼" drive fitting 54 of the second drive member 21' (FIG. 14) are to be applied for turning fasteners, the ⅜" drive fitting 46 and the ¼" drive fitting 54 will be turned counterclockwise for loosening fasteners, but if the ½" drive fitting 45 of the drive shaft 36 (FIG. 9) and the ¼" drive hexagonal bit holder 53 of the second drive member 21' (FIG. 14) are to be applied for turning fasteners, the ½" drive fitting 45 and the ¼" drive hexagonal bit holder 53 will be turned clockwise (FIGS. 21, 22) for tightening fasteners. It is noted that the other one of the two pressing faces 27, 27' of the pawl 24, 24' presses against the wall of the cavity 15, 15' when the first and the second drive members 21, 21' are turned.

FIGS. 23-26 illustrate a second embodiment derived from the first embodiment of the ratchet wrench in accordance with the present invention, wherein like numerals of designation represent like elements. In this embodiment, the pawls 24, 24' each further includes another axial cylinder (designated by 30, 30' now) on a bottom end, including a bottom end 66, 66' that is flush with a bottom of the first and the second ends of the handle 10. The drive housings 17, 17' each further includes another U-shaped section (designated by 18, 18' now) defined in the bottom of the first and the second ends of the handle 10 and communicated with the cavity 15, 15'. The first and the second heads 16, 16' each further includes another groove (designated by 19, 19' now) defined in the bottom end for mounting another ring element (designated by 20, 20' now) having a yoke (designated by 33, 33' now), for restraining the another axial cylinder 30, 30' of the pawl 24, 24' in the another U-shaped section 18, 18' of the drive housing 17, 17', for further stabilizing pivotal movement of the pawl 24, 24' when the pawl 24, 24' is turned. The another ring element 20, 20' is held in the another groove 19, 19' by the C-retainer 61, 61' that abuts against a bottom end face of the another ring element 20, 20' for preventing the first and the second drive members 21, 21' from falling out of the drive housings 17, 17'. Operation of the ratchet wrench disclosed in FIGS. 23-26 is substantially the same as that of the ratchet wrench in FIGS. 1-22.

FIGS. 27-30 illustrate a third embodiment derived from the first embodiment of the ratchet wrench in accordance with the present invention, wherein like numerals of designation represent like elements. In this embodiment, the cavity 15, 15' in the first embodiment (FIGS. 5, 7 and 12, 14) is replaced with cavity (designated by 15, 15' now). The U-shaped section 18, 18' of the drive housing 17, 17' is replaced with U-shaped section (designated by 181, 181' now). The groove 19, 19' is replaced with groove (designated by 191, 191' now). The ring element 20, 20' is replaced with ring element (designated by 201, 201' now). The ring element 201, 201' is mounted in the groove 191, 191' with the flange 34, 34' of the first and the second drive members 21, 21' abutting against a top end face of the ring element 201, 201'. The ring element 201, 201' includes a yoke (designated by 331, 331' now) that abuts against a top end face of the pawl 24, 24' and restrains the axial cylinder 30, 30' of the pawl 24, 24' in the U-shaped section 181, 181' of the drive housing 17, 17', for stabilizing the pivotal movement of the pawl 24, 24'.

Figure 31:
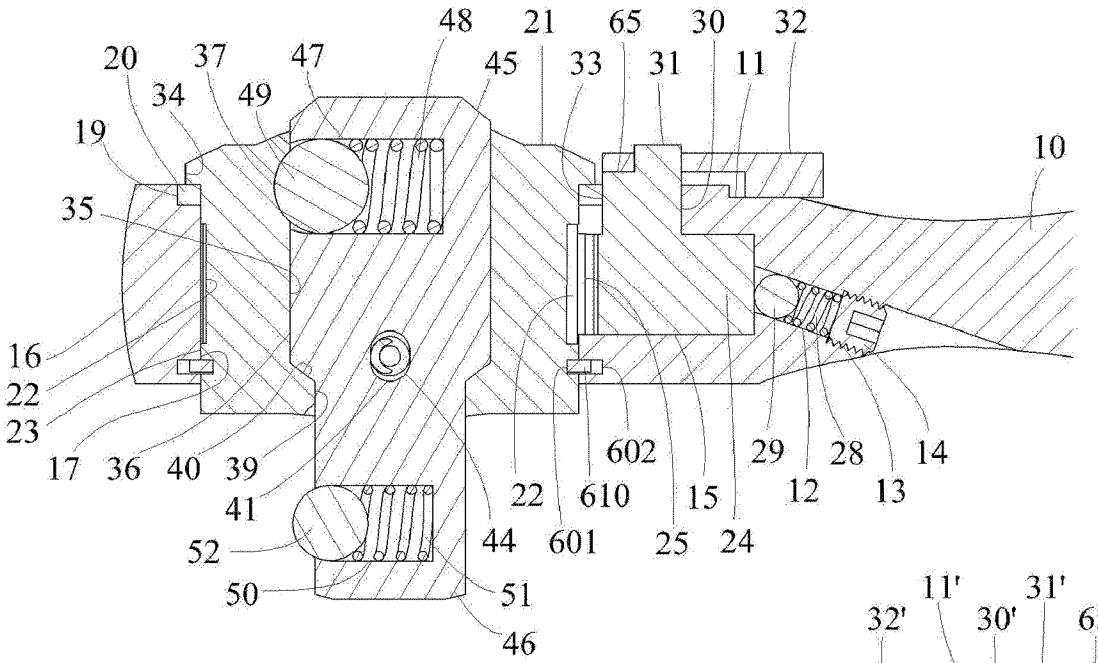
FIGS. 31 and 32 are side cross sectional views, of a first end section and a second end section, of a fourth embodiment derived from the first embodiment of the ratchet wrench, similar to FIGS. 7 and 14.
Figure 32:
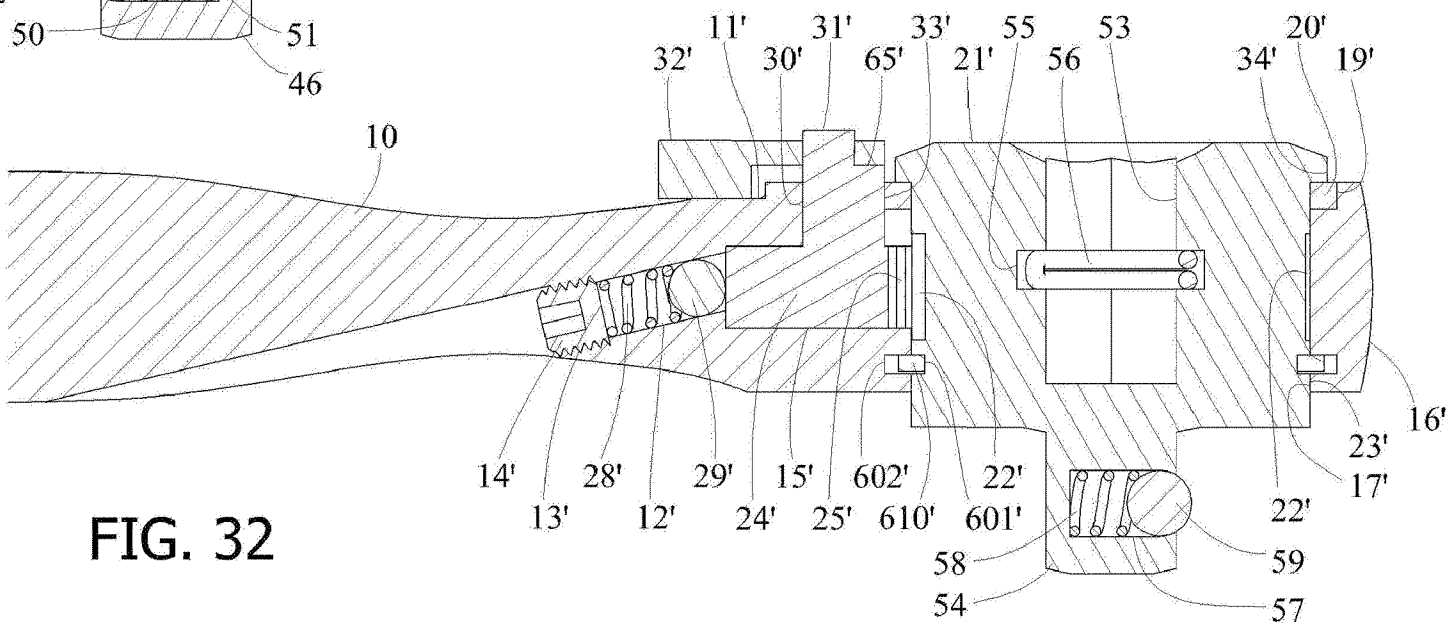

FIGS. 31 and 32 illustrate a fourth embodiment derived from the first embodiment of the ratchet wrench in accordance with the present invention, wherein like numerals of designation represent like elements. In this embodiment, the C-retainer 61, 61' and the annular groove 60, 60' in the first embodiment (FIGS. 7, 14) are deleted. An annular groove 601, 601' is defined in the bottom end of the outer periphery 23, 23' of the first and the second drive members 21, 21'. An annular groove 602, 602' is defined in a bottom end wall of the drive housing 17, 17' and aligns with the annular groove 601, 601' of the first and the second drive members 21, 21'. A C-retainer 610, 610' such as a C-clip is partially received in the annular groove 601, 601' of the first and the second drive members 21, 21' and partially received in the annular groove 602, 602' of the drive housing 17, 17', for rotatably securing the first and the second drive members 21, 21' in the drive housings 17, 17'.

Figure 33:
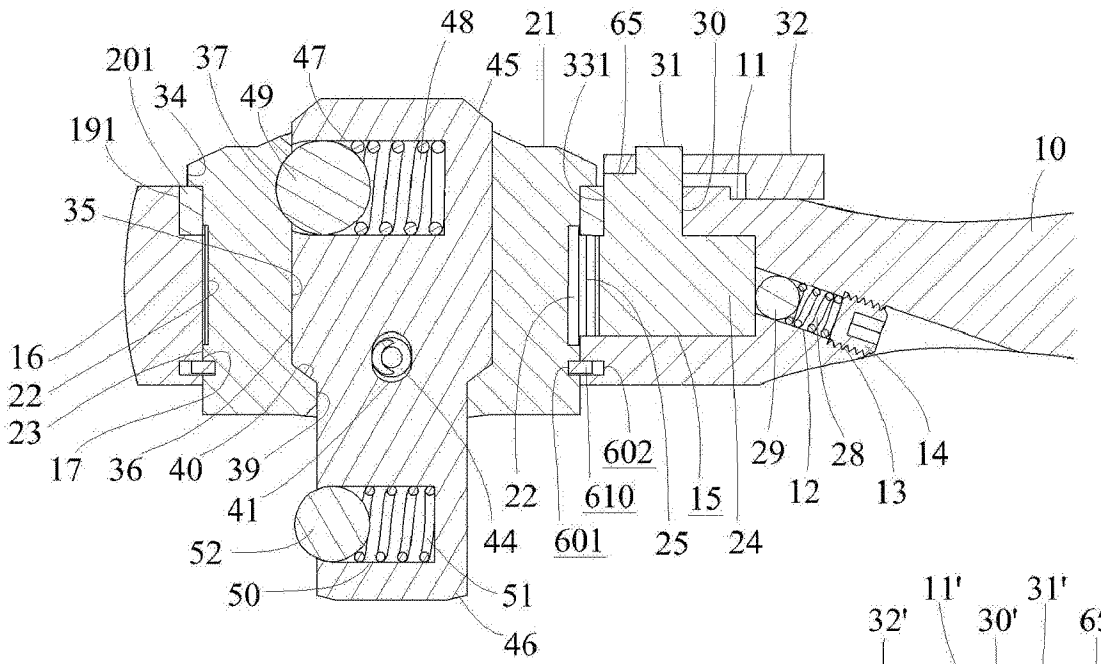
FIGS. 33 and 34 are side cross sectional views, of a first end section and a second end section, of a fifth embodiment derived from the third embodiment of the ratchet wrench, similar to FIGS. 28 and 30.
Figure 34:
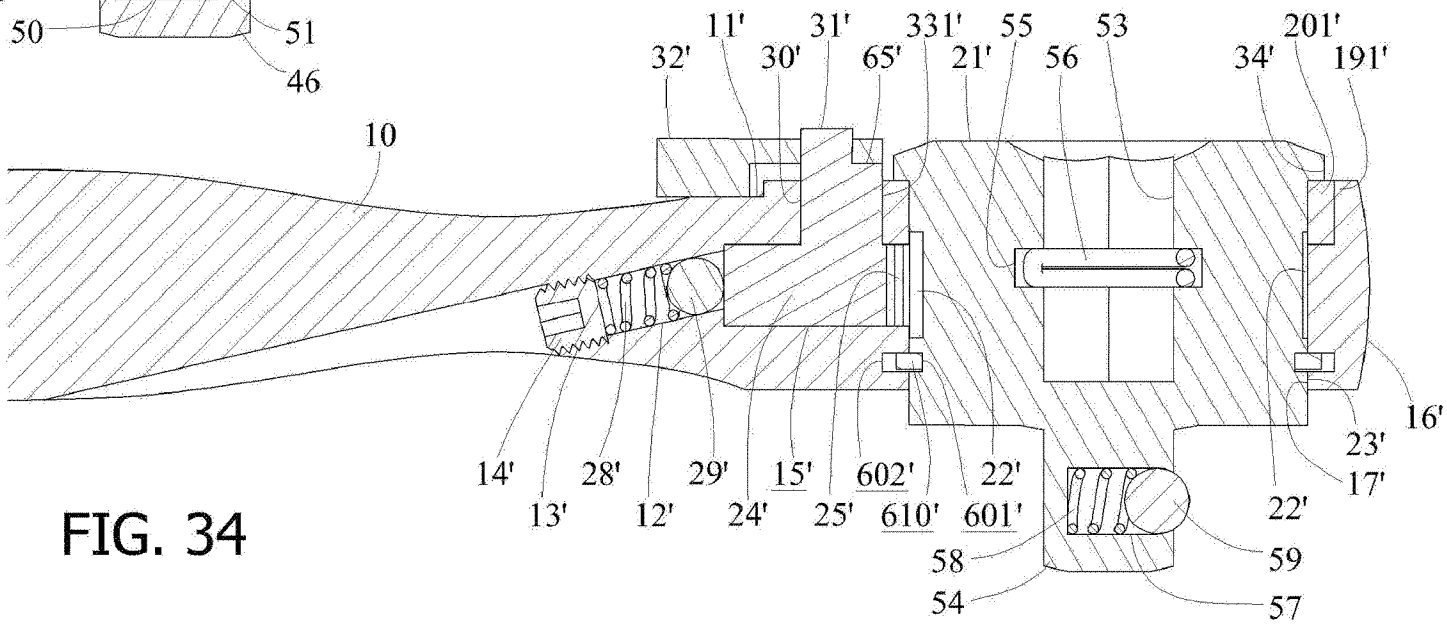

FIGS. 33 and 34 illustrate a fifth embodiment derived from the third embodiment of the ratchet wrench in accordance with the present invention, wherein like numerals of designation represent like elements. In this embodiment, the C-retainer 61, 61' and the annular groove 60, 60' in the third embodiment (FIGS. 28, 30) are deleted. An annular groove 602, 602' is formed in a bottom end wall of the drive housing 17, 17' and aligns with an annular groove (designated by 601, 601') that is defined in the bottom end of the outer periphery 23, 23' of the first and the second drive members 21, 21'. A C-retainer 610, 610' such as a C-clip is partially received in the annular groove 602, 602' of the drive housing 17, 17' and partially received in the annular groove 601, 601' of the first and the second drive members 21, 21', for rotatably retaining the first and the second drive members 21, 21' in the drive housings 17, 17'.

Figure 35:
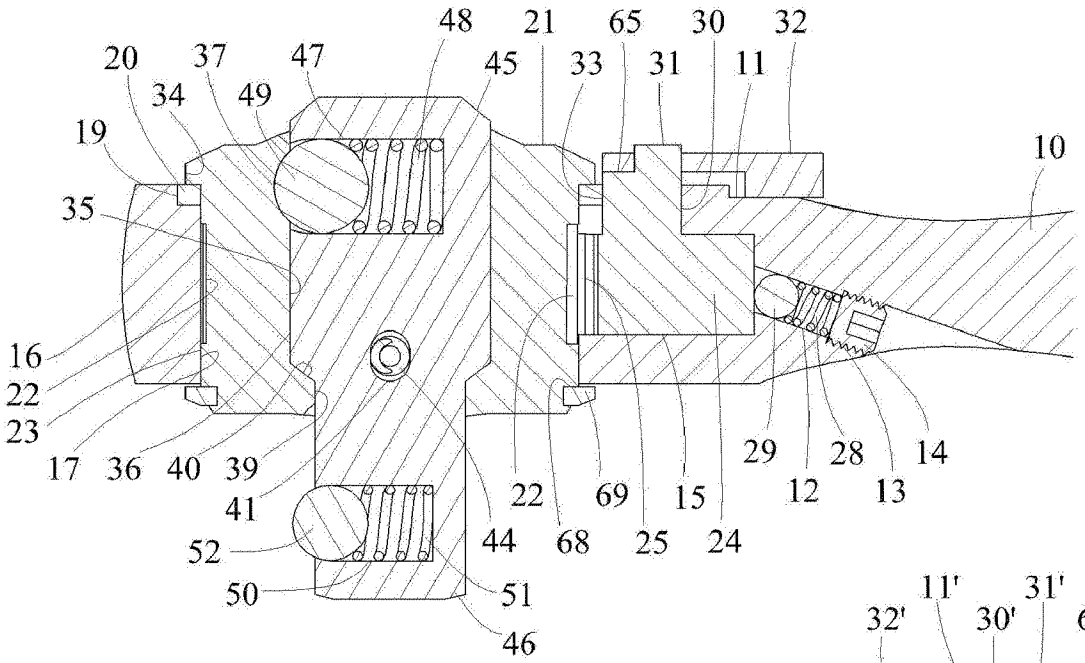
FIGS. 35 and 36 are side cross sectional views, of a first end section and a second end section, of a sixth embodiment derived from the first embodiment of the ratchet wrench, similar to FIGS. 7 and 14.
Figure 36:
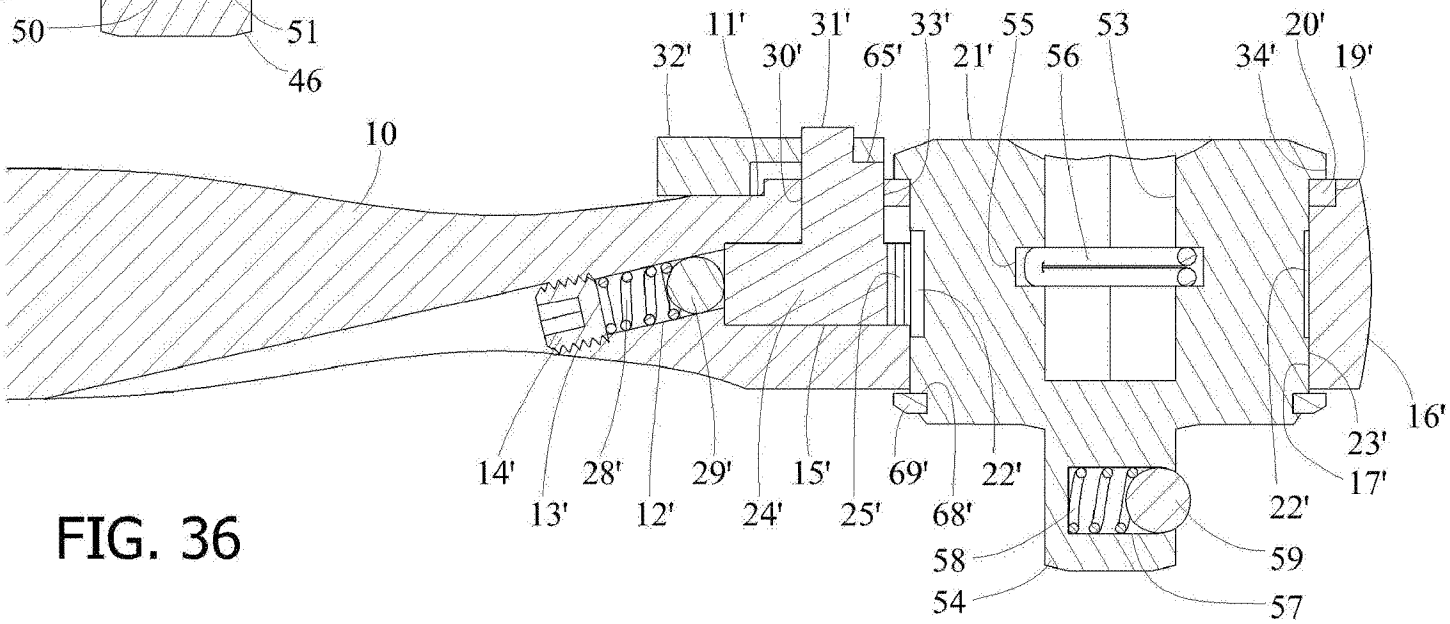

FIGS. 35 and 36 illustrate a sixth embodiment derived from the first embodiment of the ratchet wrench in accordance with the present invention, wherein like numerals of designation represent like elements. In this embodiment, the C-retainer 61, 61' and the annular groove 60, 60' in the first embodiment (FIGS. 7, 14) are deleted. A shoulder 68, 68' is formed on the bottom end of the outer periphery 23, 23' of the first and the second drive members 21, 21' and is located in a position outside the bottom of the first and the second heads 16, 16'. A ring 69, 69' is mounted around the bottom end of the outer periphery 23, 23' of the first and the second drive members 21, 21' and is held in place by method of riveting and abuts against the shoulder 68, 68'. Thus, the first and the second drive members 21, 21' are rotatably retained in the drive housings 17, 17'.

Figure 37:
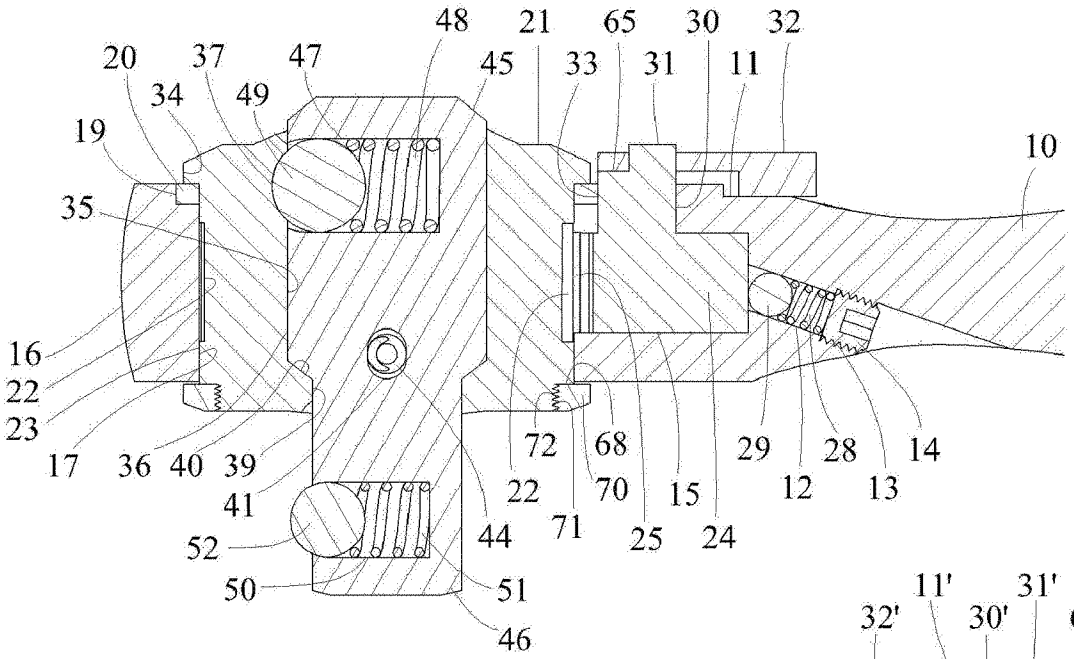
FIGS. 37 and 38 are side cross sectional views, of a first end section and a second end section, of a seventh embodiment derived from the sixth embodiment of the ratchet wrench.
Figure 38:
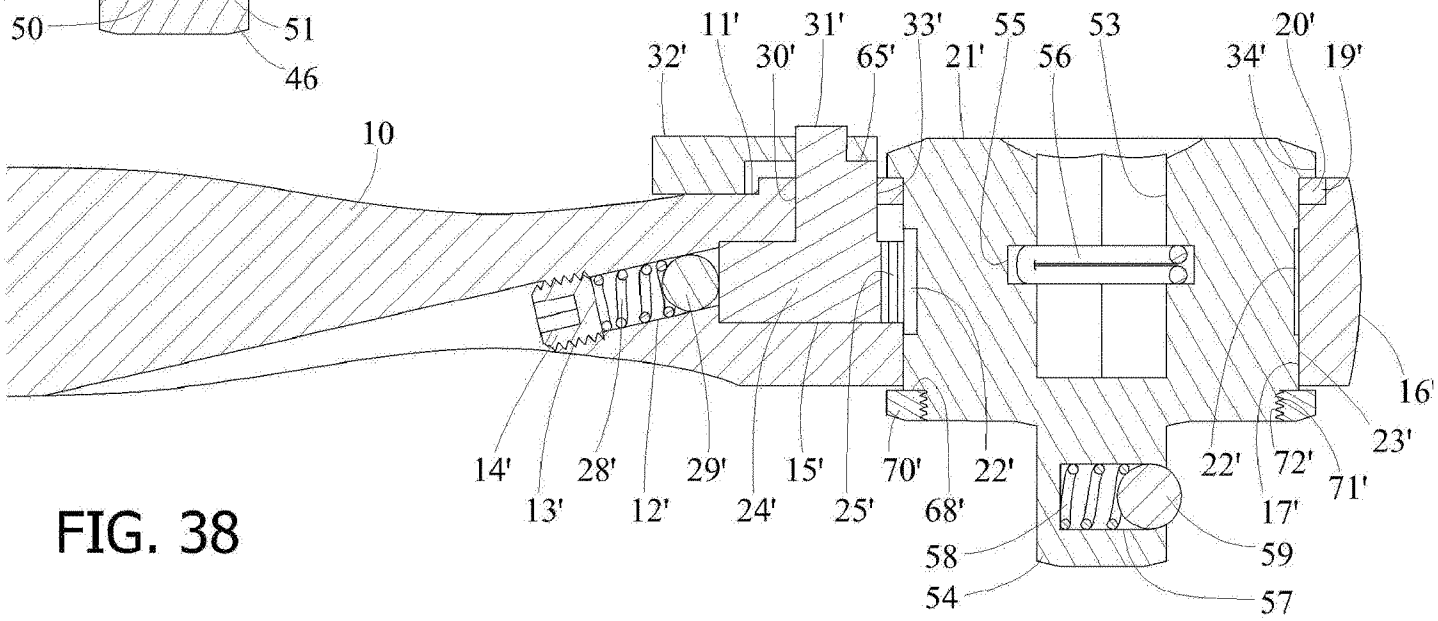

FIGS. 37 and 38 illustrate a seventh embodiment derived from the sixth embodiment of the ratchet wrench in accordance with the present invention, wherein like numerals of designation represent like elements. In this embodiment, the bottom end of the outer periphery 23, 23' of the first and the second drive members 21, 21' in the sixth embodiment (FIGS. 35, 36) is formed with helical external thread 71, 71' located in a position just below the shoulder 68, 68'. The ring 69, 69' is replaced with a ring (designated by 70, 70' now). The ring 70, 70' includes an inner periphery formed with helical internal thread 72, 72' and is preferably to have an embossed outer periphery (not shown) for grasping and turning the ring 70, 70' with ease. The ring 70, 70' is screwed onto the bottom end of the first and the second drive members 21, 21' and abuts against the shoulder 68, 68', for rotatably and removably retaining the first and the second drive members 21, 21' in the drive housings 17, 17'.

Figure 39:
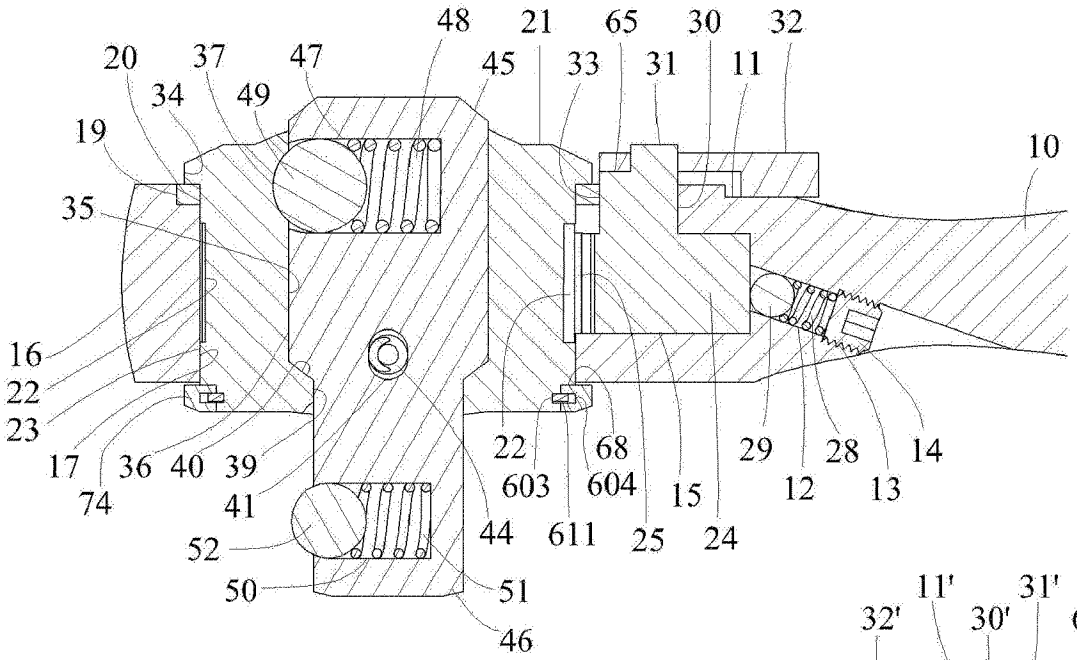
FIGS. 39 and 40 are side cross sectional views, of a first end section and a second end section, of an eighth embodiment derived from the sixth embodiment of the ratchet wrench.
Figure 40:
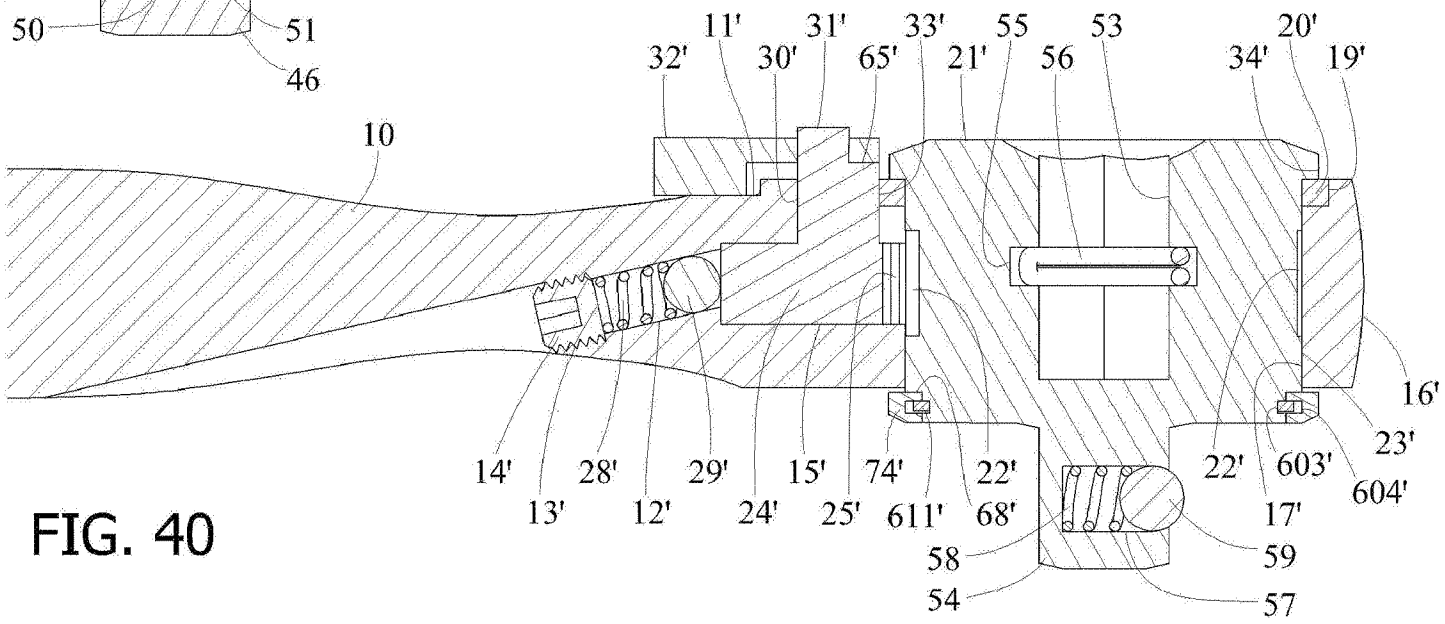

FIGS. 39 and 40 illustrate an eighth embodiment derived from the sixth embodiment of the ratchet wrench in accordance with the present invention, wherein like numerals of designation represent like elements. In this embodiment, the bottom end of the outer periphery 23, 23' of the first and the second drive members 21, 21' in the sixth embodiment (FIGS. 35, 36) is formed with an annular groove 603, 603' that is located in a position below the shoulder 68, 68'. The ring 69, 69' is replaced with a ring (designated by 74, 74'). The ring 74, 74' is mounted around the bottom end of the outer periphery 23, 23' of the first and the second drive members 21, 21' and includes an annular groove 604, 604' defined in an inner periphery and located in a position in line with the annular groove 603, 603' of the first and the second drive members 21, 21'. A C-retainer 611, 611' such as a C-clip is partially received in the annular groove 604, 604' of the ring 74, 74' and partially received in the annular groove 603, 603' of the first and the second drive members 21, 21', for holding the ring 74, 74' in place and against the shoulder 68, 68', for rotatably retaining the first and the second drive members 21, 21' in the drive housings 17, 17'.

Figure 41:
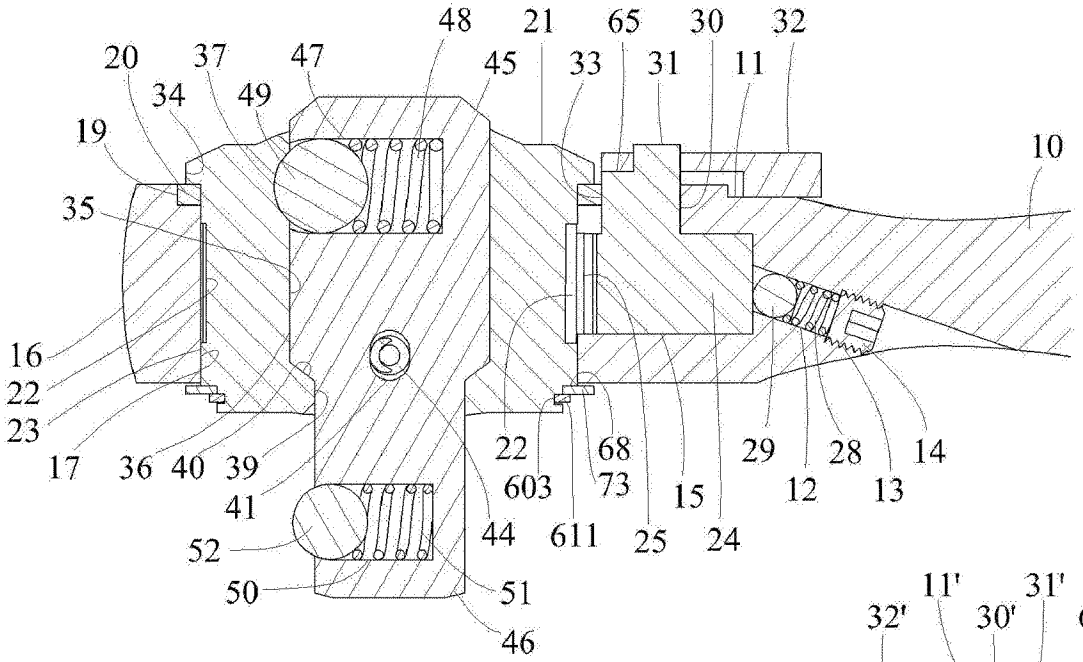
FIGS. 41 and 42 are side cross sectional views, of a first end section and a second end section, of a ninth embodiment derived from the eighth embodiment of the ratchet wrench.
Figure 42:
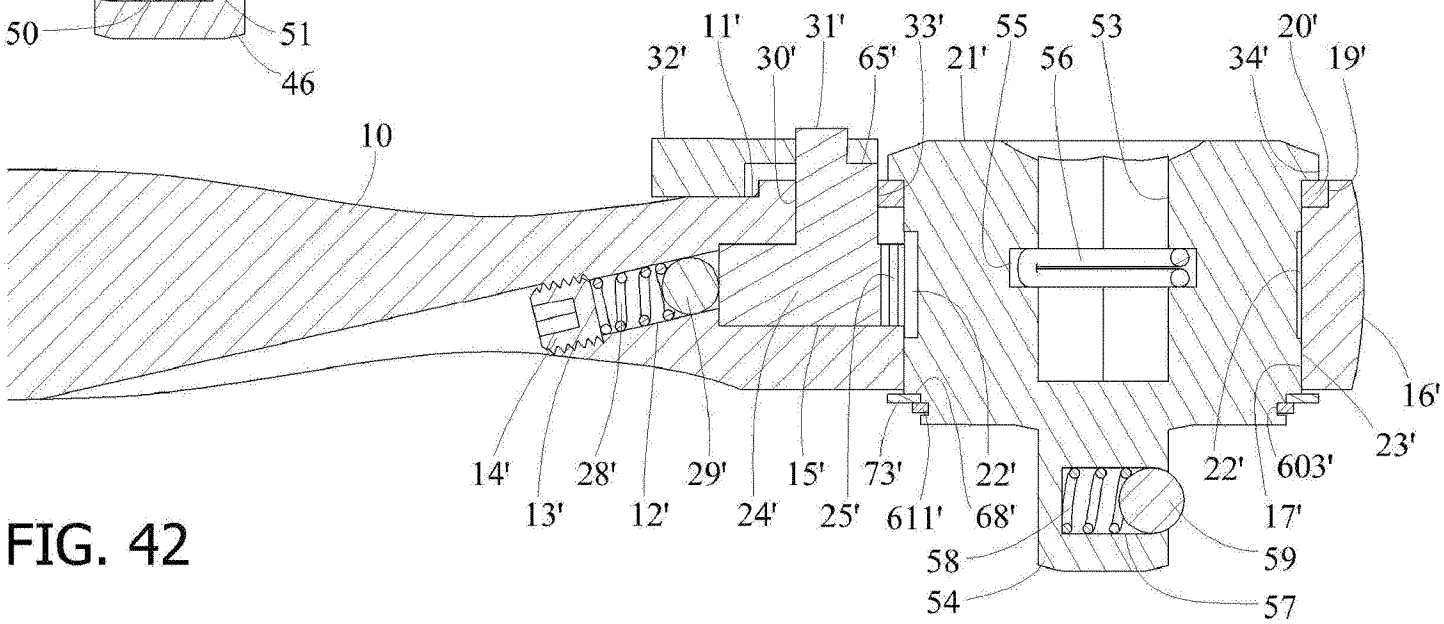

FIGS. 41 and 42 illustrate a ninth embodiment derived from the eighth embodiment of the ratchet wrench in accordance with the present invention, wherein like numerals of designation represent like elements. In this embodiment, the ring 74, 74' in the eighth embodiment (FIGS. 39, 40) is replaced with a ring (designated by 73, 73'). The ring 73, 73' is mounted around the bottom end of the outer periphery 23, 23' of the first and the second drive members 21, 21' and is sandwiched between the shoulder 68, 68' and the C-retainer 611, 611' and abuts against the C-retainer 611, 611' and the shoulder 68, 68', thereby removably and rotatably retaining the first and the second drive members 21, 21' in the drive housings 17, 17'.

Figure 43:
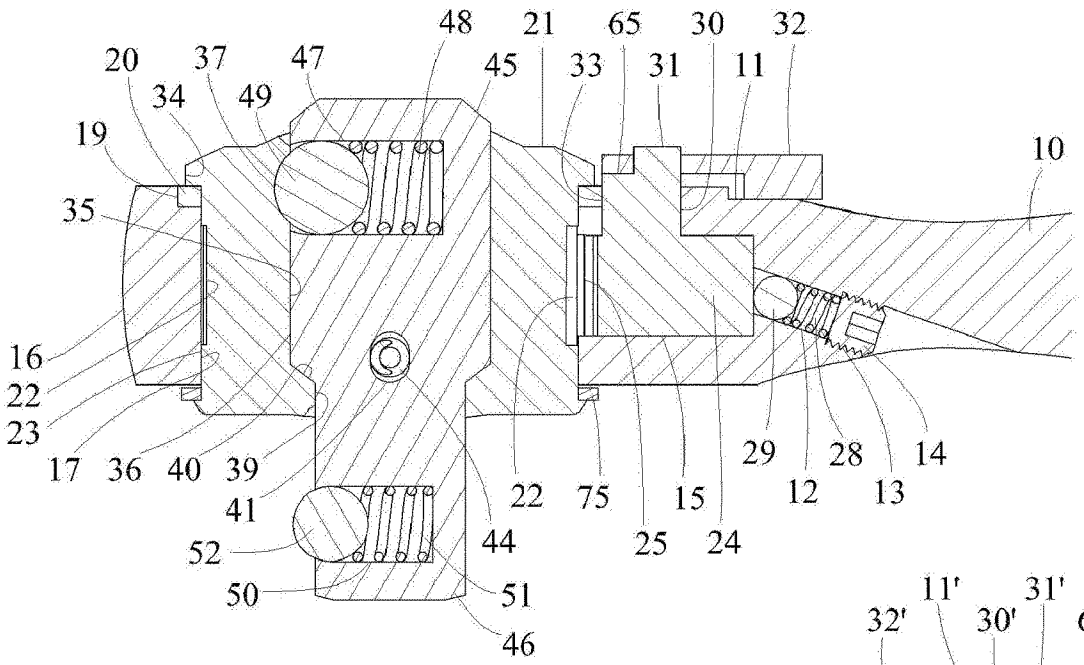
FIGS. 43 and 44 are side cross sectional views, of a first end section and a second end section, of a tenth embodiment derived from the first embodiment of the ratchet wrench.
Figure 44:
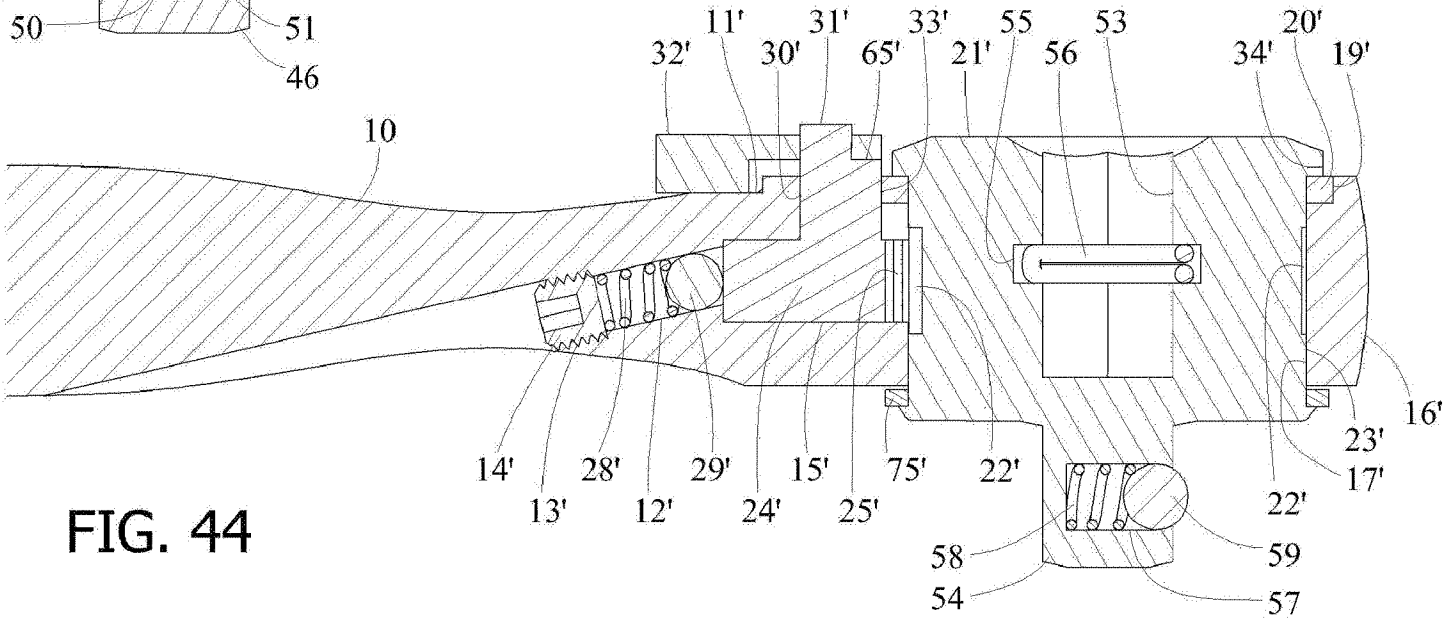

FIGS. 43 and 44 illustrate a tenth embodiment derived from the first embodiment of the ratchet wrench in accordance with the present invention, wherein like numerals of designation represent like elements. In this embodiment, the annular groove 60, 60' and the C-retainer 61, 61' in the first embodiment (FIGS. 7, 14) are deleted. A spacing ring 75, 75' is mounted around the bottom end of the outer periphery 23, 23' of the first and the second drive members 21, 21' and is located outside the bottom of the first and the second heads 16, 16'. The spacing ring 75, 75' is held in place by method of riveting.

Figure 45:
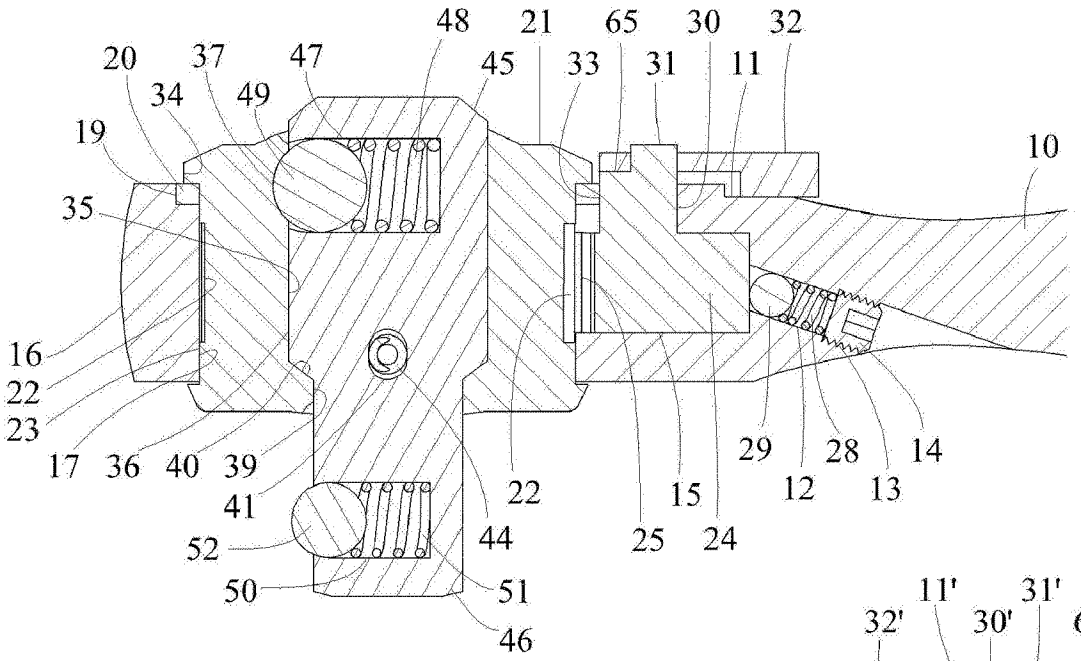
FIGS. 45 and 46 are side cross sectional views, of a first end section and a second end section, of an eleventh embodiment derived from the first embodiment of the ratchet wrench.
Figure 46:
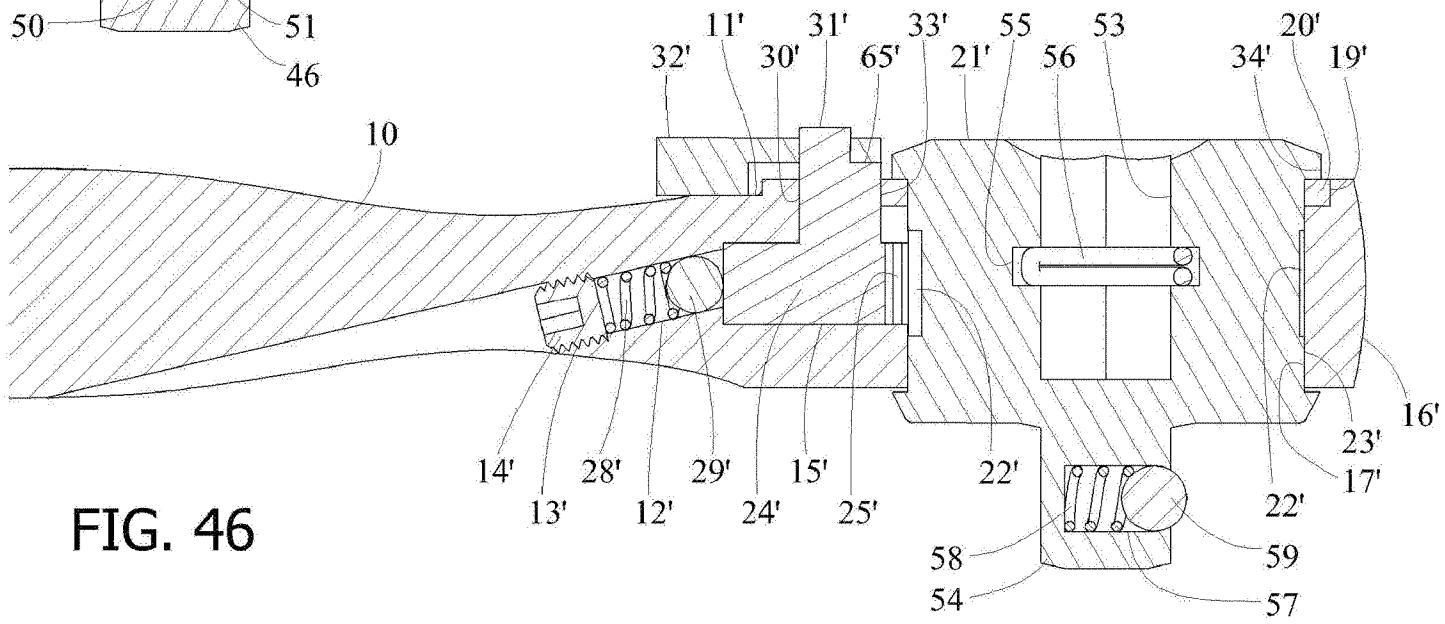

FIGS. 45 and 46 illustrate an eleventh embodiment derived from the first embodiment of the ratchet wrench in accordance with the present invention, wherein like numerals of designation represent like elements. In this embodiment, the C-retainer 61, 61' and the annular groove 60, 60' in the first embodiment (FIGS. 7, 14) are deleted. The first and the second drive members 21, 21' are rotatably retained in the drive housings 17, 17' by method of riveting.

Figure 47:
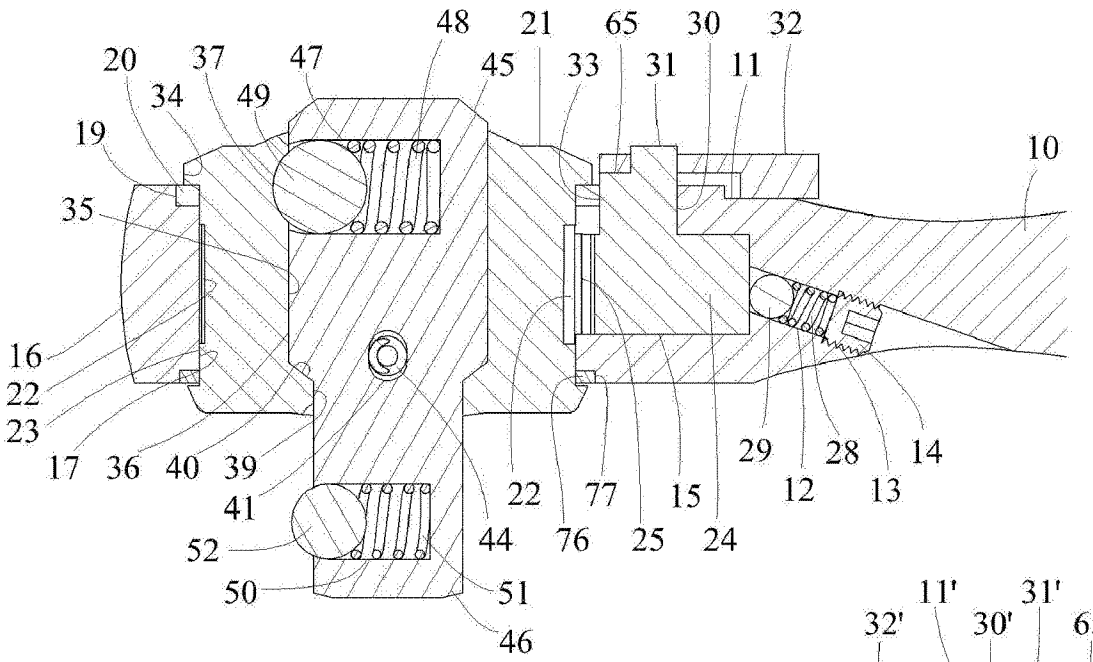
FIGS. 47 and 48 are side cross sectional views, of a first end section and a second end section, of a twelfth embodiment derived from the first embodiment of the ratchet wrench.
Figure 48:
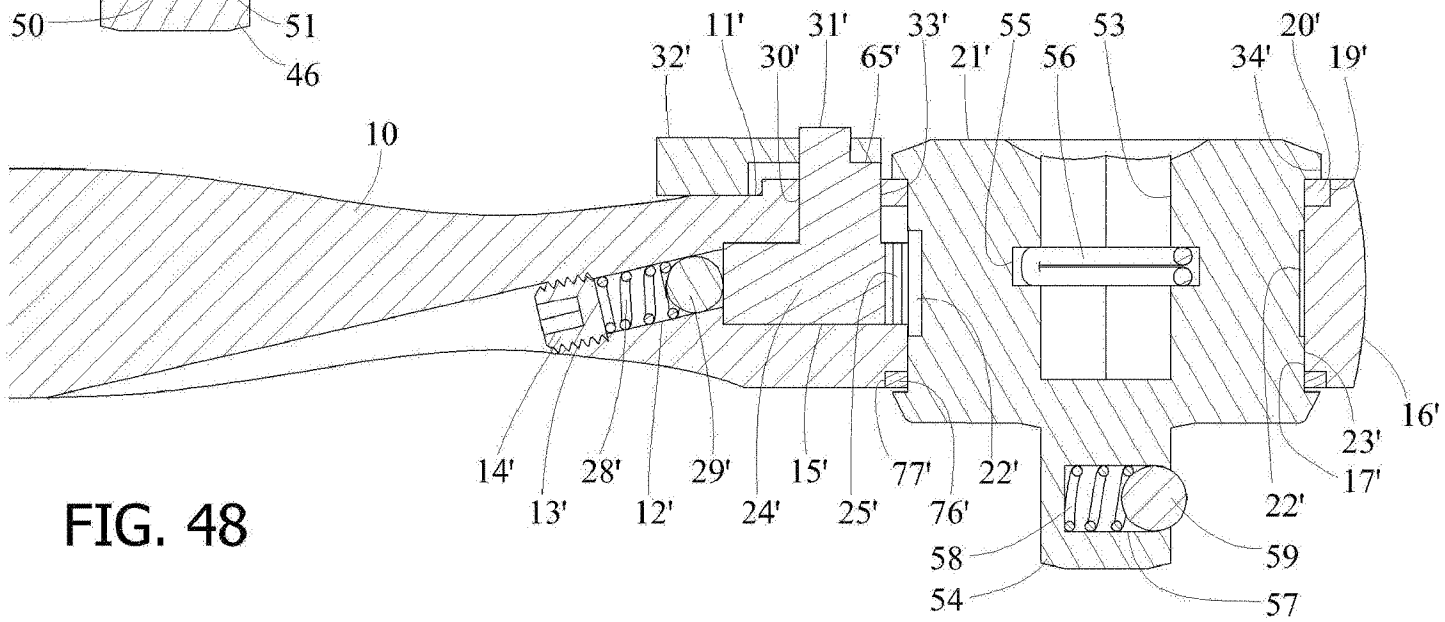

FIGS. 47 and 48 illustrate a twelfth embodiment derived from the first embodiment of the ratchet wrench in accordance with the present invention, wherein like numerals of designation represent like elements. In this embodiment, the C-retainer 61, 61' and the annular groove 60, 60' of the first embodiment (FIGS. 7, 14) are deleted. A circular groove 77, 77' is defined in the bottom end of the first and the second heads 16, 16'. A ring 76, 76' is received and held in the circular groove 77, 77' by method of riveting.

Figure 49:
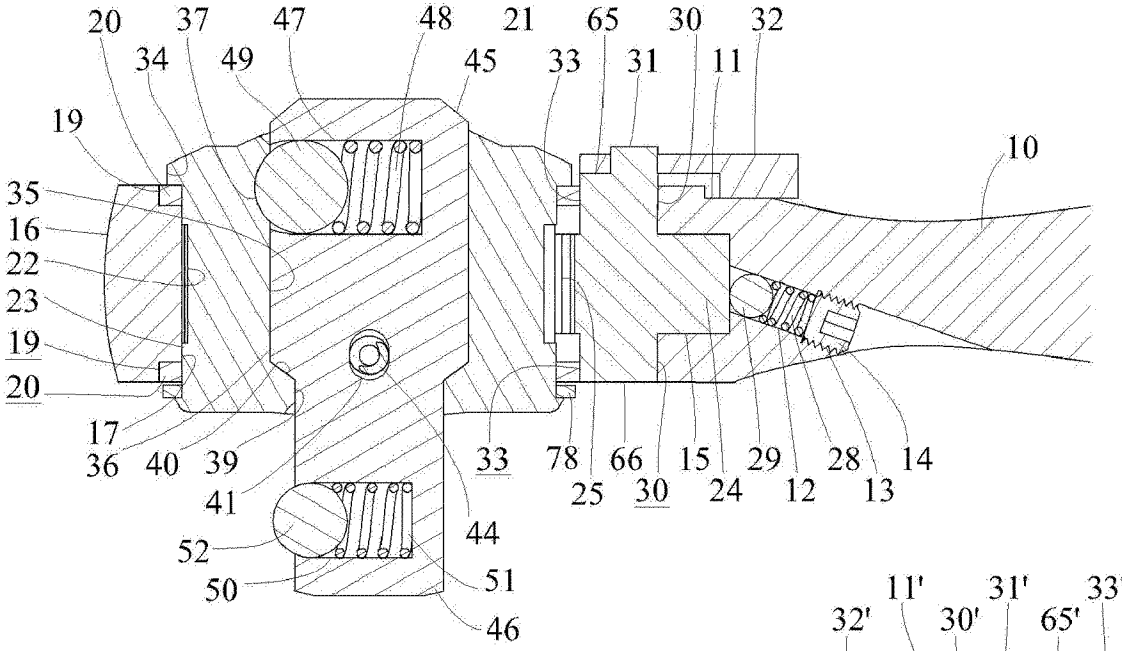
FIGS. 49 and 50 are side cross sectional views, of a first end section and a second end section, of a thirteenth embodiment derived from the second embodiment of the ratchet wrench.
Figure 50:
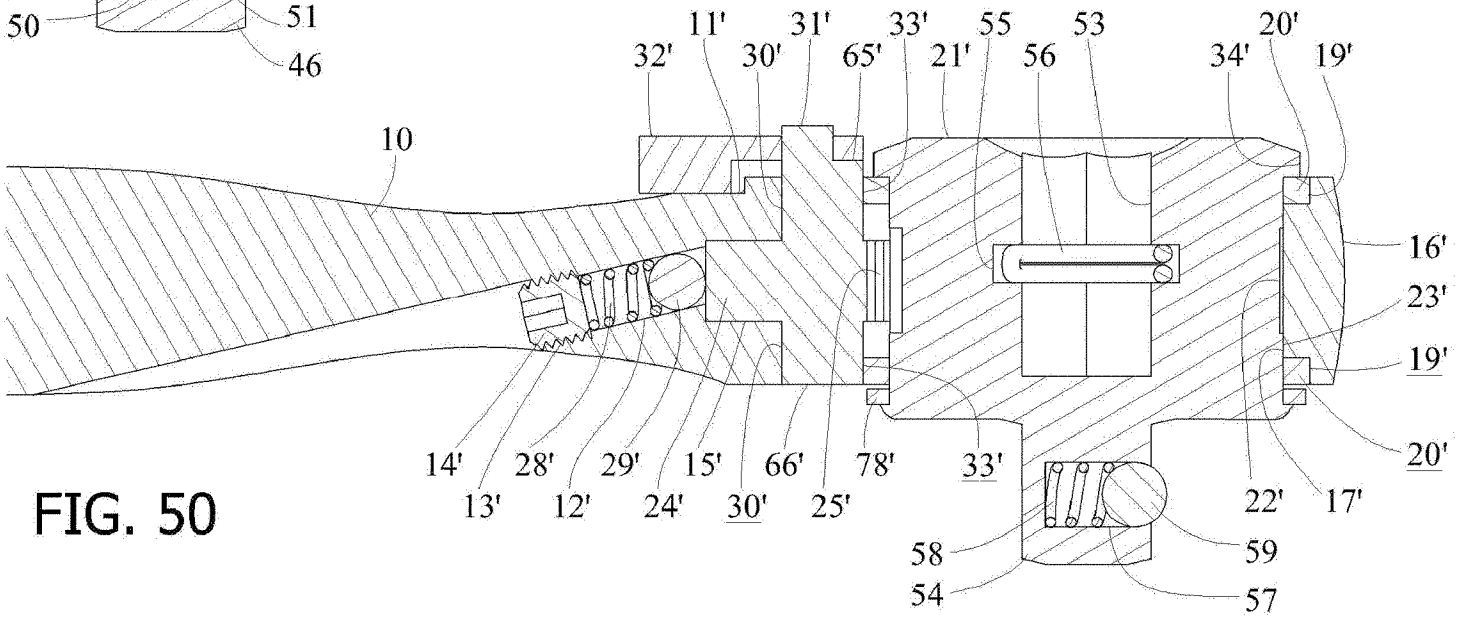

FIGS. 49 and 50 illustrate a thirteenth embodiment derived from the second embodiment of the ratchet wrench in accordance with the present invention, wherein like numerals of designation represent like elements. In this embodiment, the C-retainer 61, 61' and the annular groove 60, 60' of the second embodiment (FIGS. 24, 26) are deleted. A spacing ring 78, 78' is mounted around the bottom end of the outer periphery 23, 23' of the first and the second drive members 21, 21' and is located outside the bottom of the first and the second heads 16, 16'. The spacing ring 78, 78' is held in place by method of riveting.

Figure 51:
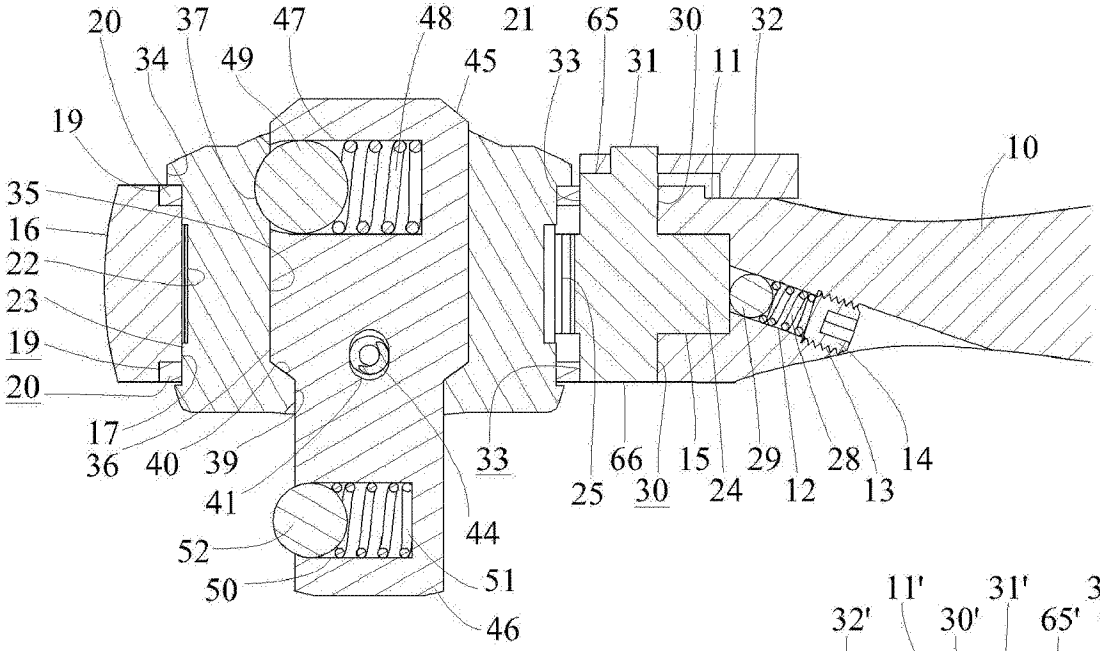
FIGS. 51 and 52 are side cross sectional views, of a first end section and a second end section, of a fourteenth embodiment derived from the second embodiment of the ratchet wrench.
Figure 52:
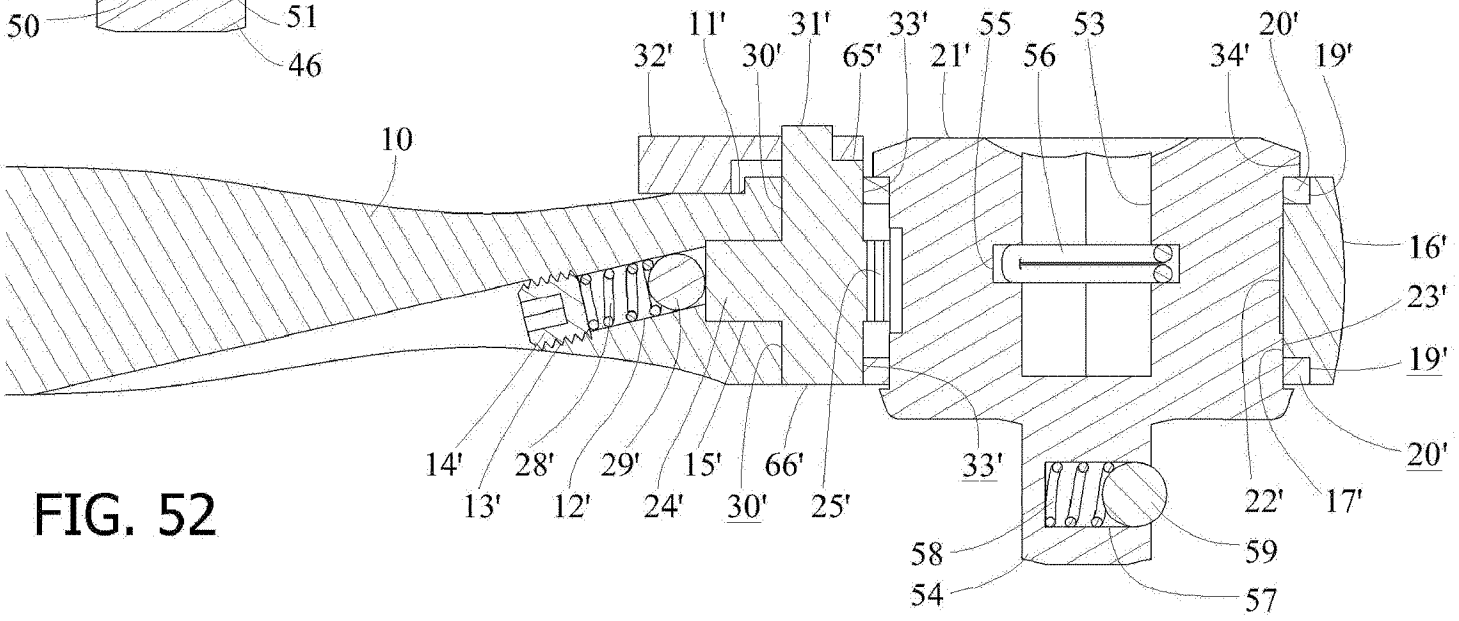

FIGS. 51 and 52 illustrate a fourteenth embodiment derived from the second embodiment of the ratchet wrench in accordance with the present invention, wherein like numerals of designation represent like elements. In this embodiment, the annular groove 60, 60' and the C-retainer 61, 61' in the second embodiment (FIGS. 24, 26) are deleted. The first and the second drive members 21, 21' are rotatably retained in the drive housings 17, 17' by method of riveting.

Figure 53:
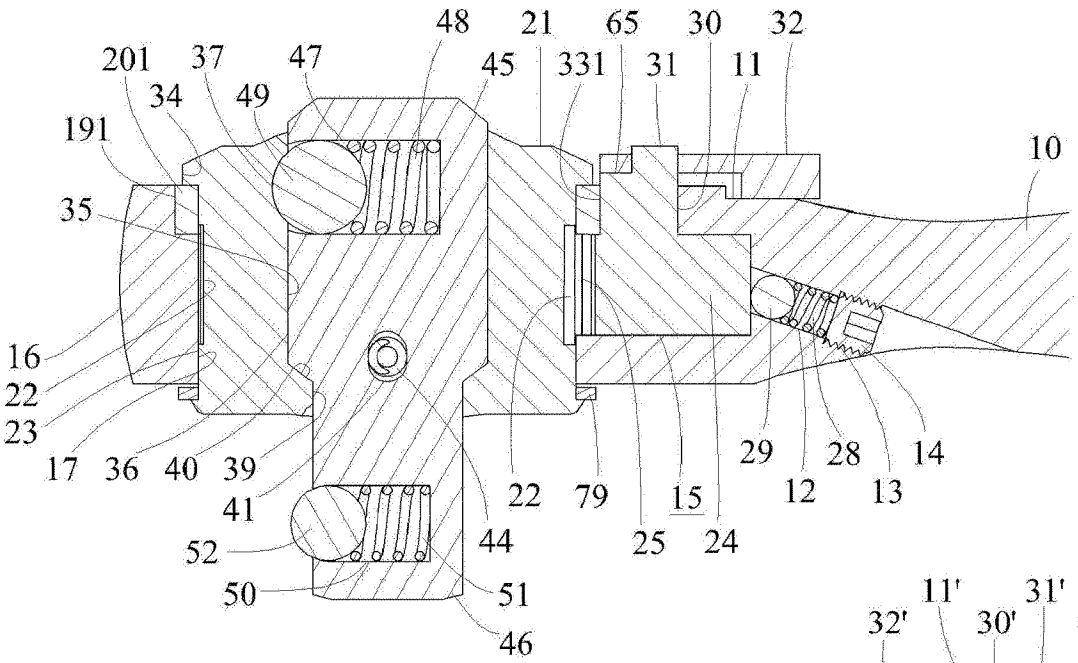
FIGS. 53 and 54 are side cross sectional views, of a first end section and a second end section, of a fifteenth embodiment derived from the third embodiment of the ratchet wrench.
Figure 54:
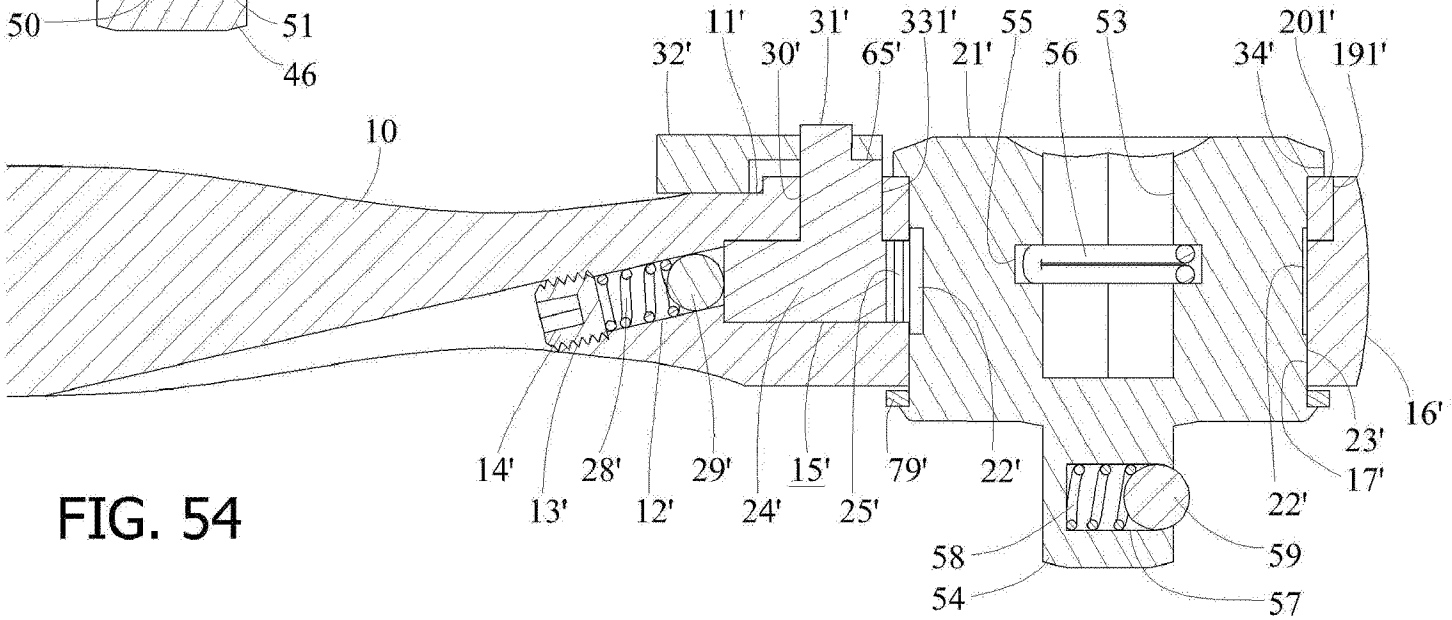

FIGS. 53 and 54 illustrate a fifteenth embodiment derived from the third embodiment of the ratchet wrench in accordance with the present invention, wherein like numerals of designation represent like elements. In this embodiment, the annular groove 60, 60' and the C-retainer 61, 61' of the third embodiment (FIGS. 28, 30) are deleted. A spacing ring 79, 79' is mounted around the bottom end of the outer periphery 23, 23' of the first and the second drive members 21, 21' and is located outside the bottom of the first and the second heads 16, 16'. The spacing ring 79, 79' is held in place by method of riveting.

Figure 55:
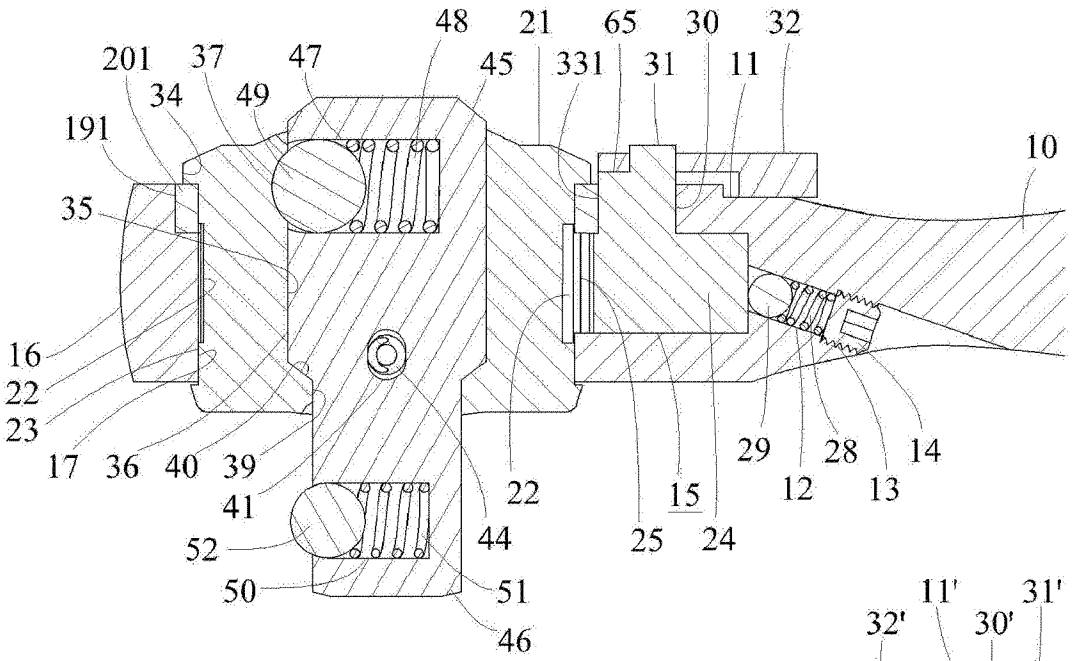
FIGS. 55 and 56 are side cross sectional views, of a first end section and a second end section, of a sixteenth embodiment derived from the third embodiment of the ratchet wrench.
Figure 56:
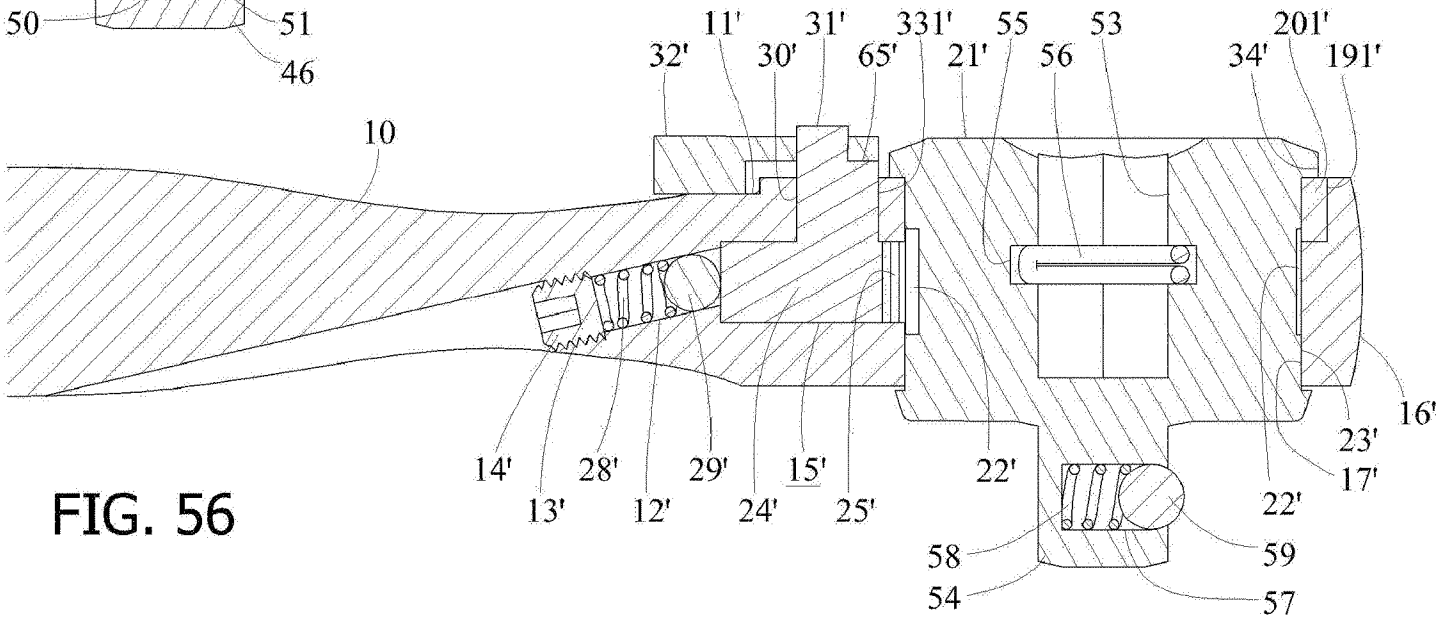

FIGS. 55 and 56 illustrate a sixteenth embodiment derived from the third embodiment of the ratchet wrench in accordance with the present invention, wherein like numerals of designation represent like elements. In this embodiment, the annular groove 60, 60' and the C-retainer 61, 61' of the third embodiment (FIGS. 28, 30) are deleted. The first and the second drive members 21, 21' are rotatably retained in the drive housings 17, 17' by method of riveting.

Figure 57:
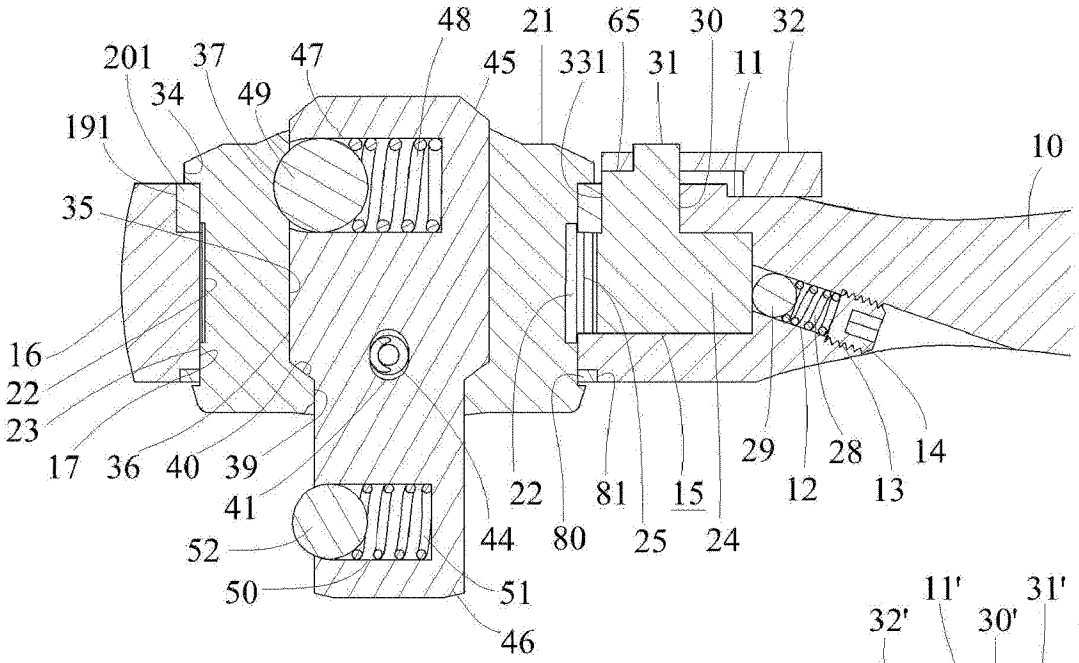
FIGS. 57 and 58 are side cross sectional views, of a first end section and a second end section, of a seventeenth embodiment derived from the third embodiment of the ratchet wrench.
Figure 58:
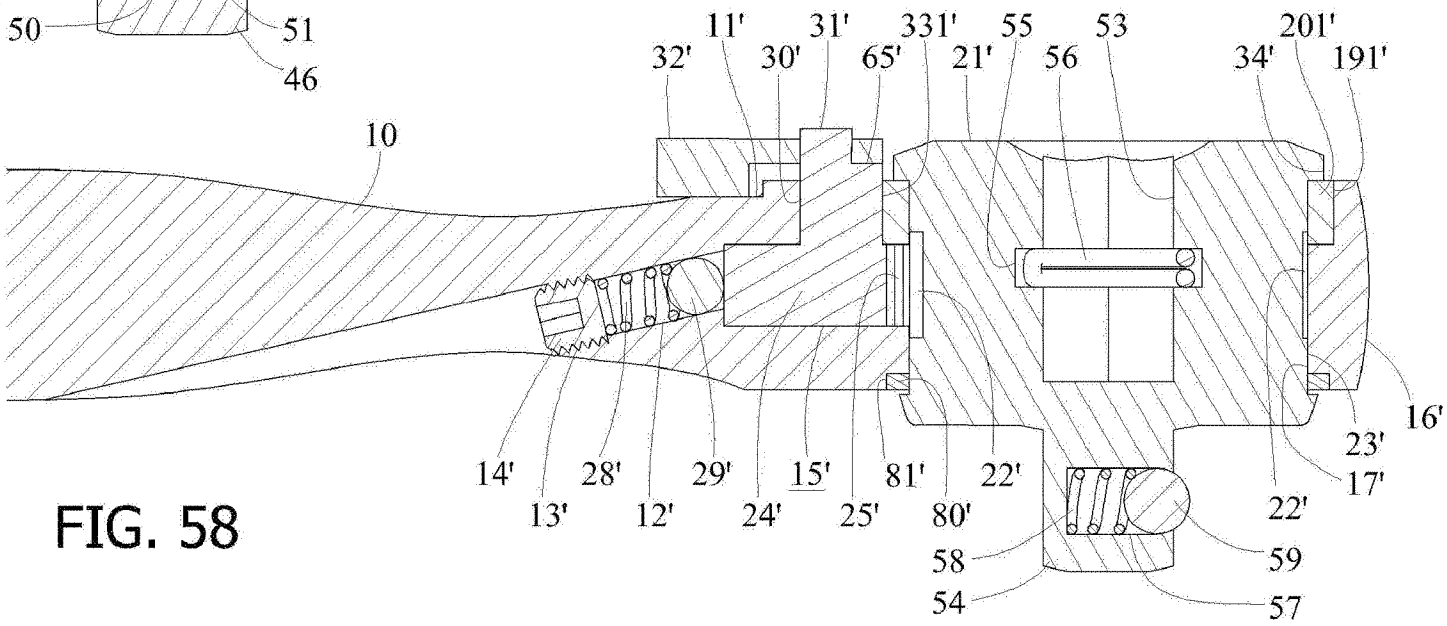

FIGS. 57 and 58 illustrate a seventeenth embodiment derived from the third embodiment of the ratchet wrench in accordance with the present invention, wherein like numerals of designation represent like elements. In this embodiment, the annular groove 60, 60' and the C-retainer 61, 61' of the third embodiment (FIGS. 28, 30) are deleted. A circular groove 81, 81' is defined in the bottom end of the first and the second heads 16, 16'. A ring 80, 80' is received and held in the circular groove 81, 81' by method of riveting.

It is noted that the ratchet wrench in accordance with the present invention as described above and revealed in the accompanying drawings may be modified/varied within the conceivable scope of the present invention. Thus, in both the first and the second embodiments (FIGS. 5, 7, 12, 14 and 23-26), and the third through the seventeenth embodiments (FIGS. 27-58), the profile of the handle 10 may be heightened within a reasonable extent, or the handle 10 may come with a layer of material (such as fiberglass, rubber, or both) molded on it, for increasing gripping comfort of the handle 10 when proceeding operation of tightening/loosening fasteners, thereby lessening hand fatigue from gripping the handle 10 to a minimum; the inclined through hole 12, 12', threaded portion 13, 13', and setscrew 14, 14' may be removed and replaced with a blind hole (not shown) formed in the first and the second ends of the handle 10 and communicated with the cavity 15, 15'/15, 15'(the cavity 15, 15' in FIGS. 27-30, 33, 34, 53-58), for receiving the friction ball 29, 29' and the spring 28, 28' biasing the friction ball 29, 29' to selectively butt against one of the two inclined faces 26, 26' of the pawl 24, 24'; the first and the second ratcheting mechanisms may be replaced with any similar structures that allow the handle 10 to selectively swing in a direction in which the first and the second drive members 21, 21' are turned for tightening/loosening fasteners and in a reversed direction in which the first and the second drive members 21, 21' are not turned; the size and number (of each set) of the lockup teeth 25, 25' of the pawl 24, 24' may vary, and this also requires the size and number of the gear teeth 22, 22' of the first and the second drive members 21, 21' to be adjusted accordingly to such variation if any, for ensuring precise tooth to tooth meshing between the pawls 24, 24' and the first and the second drive members 21, 21', for transmitting torque from the handle 10 to the first and the second drive members 21, 21' for turning fasteners when the handle 10 is swung in a force-loaded direction; for closing the inclined through hole 12, 12', the threaded portion 13, 13' and the setscrew 14, 14' may be replaced with a steel ball (not shown) that may be permanently friction-fitted in the inclined through hole 12, 12' in the location of the setscrew 14, 14'; the notch 38, the oval hole 41, the spring 44 and the oval pin 42 that all work together to act as a mechanical means for slidably retaining the drive shaft 36 in the square inner periphery 35 of the first drive member 21 (as illustrated in FIGS. 8, 10) may be replaced with any other similar structures/means as long as they effectively serve the purpose of slidably retaining the drive shaft 36 in the square inner periphery 35; and the double C retainer 56 and the annular groove 55 may be replaced by a single C retainer (e.g., a C-clip, or a C-strip, not shown) and an annular groove (not shown) partially receiving the single C retainer in the ¼" drive hexagonal bit holder 53 for holding the fastener-driving element (the bit) in the ¼" drive hexagonal bit holder 53, or the double C retainer 56 and the annular groove 55 may be removed and substituted with a cylindrical mass (not shown) magnetized and fixed in the bottom of the ¼" drive hexagonal bit holder 53 by means of friction fitting, for holding the bit in the ¼" drive hexagonal bit holder 53 by magnetic force. In the second embodiment (FIGS. 23-26), the bottom of the first and the second ends of the handle 10 may also be formed with another lowered face 11, 11'(not shown), and the bottom end 66, 66' of the another axial cylinder 30, 30' of the pawl 24, 24' may be extended to a position outside the bottom of the first and the second ends of the handle 10 and may also be formed with another oblong portion 31, 31'(not shown) for fixedly mounting another switch lever 32, 32'(not shown) for turning the pawl 24, 24'.

Moreover, in the third embodiment (FIGS. 27-30), the bottom of the first and the second ends of the handle 10 may be modified to include another lowered face 11, 11'(not shown), and to include another U-shaped section 181, 181' (not shown) of the drive housing 17, 17' that communicates with the cavity 15, 15'. Another axial cylinder 30, 30'(not shown) may be formed on the bottom end of the pawl 24, 24' and may include another oblong portion 31, 31'(not shown) to be formed on a bottom end that is located in a position outside the bottom of the first and the second ends of the handle 10, for fixedly mounting another switch lever 32, 32'(not shown) for turning the pawl 24, 24'. The first and the second heads 16, 16' may be modified to include another groove 191, 191'(not shown) defined in the bottom end. Another ring element 201, 201' with a yoke 331, 331'(not shown) may be mounted in the another groove 191, 191', with the C-retainer 61, 61' abutting against a bottom end face of the another ring element 201, 201' and with the yoke 331, 331' abutting against a bottom end face of the pawl 24, 24' and restraining the another axial cylinder 30, 30' of the pawl 24, 24' in the another U-shaped section 181, 181' of the drive housing 17, 17' to further stabilize the pivotal movement of the pawl 24, 24'. From a standpoint of reducing manufacturing costs, some of the modifications made to the third embodiment as pointed out in this paragraph may actually be waived if desired for saving labor and material. These modifications that may be waived include the another lowered face 11, 11', the another oblong portion 31, 31'(on the bottom end of the another axial cylinder 30, 30' of the pawl 24, 24') along with the another switch lever 32, 32'. Thus, manufacturing costs may be reduced.

By carefully comparing the first embodiment (FIGS. 5, 12') to the second and third embodiments (FIGS. 23, 25, 27, 29), it is evident that the three embodiments have uniform structural features formed with the first and the second drive members 21, 21', and resort to a same retention method that relies on the annular groove 60, 60' and the C-retainer 61, 61'(FIGS. 7, 14, 24, 26, 28, 30) for carrying out such retention method, for rotatably retaining the first and the second drive members 21, 21' in the drive housings 17, 17'. However, comparing to the first, second, and third embodiments, the sixth through ninth embodiments (FIGS. 35-42) each resorts to a different retention method that relies on slightly different structural feature/features formed on the bottom end of the outer periphery 23, 23' of the first and the second drive members 21, 21' and different part/parts of their own (referring to FIGS. 35-42, in conjunction with their detailed description), for carrying out their retention methods, for rotatably retaining the first and the second drive members 21, 21' in the drive housings 17, 17'. Despite these differences named among these embodiments referred to in this paragraph, it is obvious and should be understood by those skilled in the field that the first and the second drive members 21, 21' and the retention method that relies on the annular groove 60, 60' and the C-retainer 61, 61' in the first, second, and third embodiments may be replaced/interchanged with those in any of the sixth through ninth embodiments when desired. And it is obvious that the sixth through ninth embodiments (FIGS. 35-42) each may be modified to include a circular groove such as the circular groove 77, 77'(see FIGS. 47, 48) to be defined in the bottom end of the first and the second heads 16, 16'. A ring such as the ring 76, 76'(see FIGS. 47, 48) may be received and held in the circular groove (not shown) with the retention method used in each of the sixth through ninth embodiments. Furthermore, it is observed that new embodiments based on the second or third embodiment (FIGS. 24, 26, 28, 30) may arise from replacing/interchanging the first and the second drive members 21, 21' and the retention method used in the second or third embodiment with those in each of the sixth through ninth embodiments (FIGS. 35-42). Although these new embodiments mentioned above are neither described herein nor shown in the accompanying drawings, yet they are considered to be a part of the present invention. Therefore, they are herein incorporated into the present invention, and they may adopt those modifications/variations made to the second or third embodiment as specified in related paragraphs above, without departing from the scope of the present invention.

It is also noted that the ratchet wrench of the present invention may also be used with other fastener-driving elements besides the aforementioned sockets and the bit for turning fasteners. These other fastener-driving elements include socket extensions and socket adapters that have same drives as those of the sockets, and also include universal bit holders and nut driver bits that have a same drive as that of the bit, and still include any other fastener-driving elements not mentioned herein but may be compatibly used with the ratchet wrench of the present invention for turning fasteners.

Based upon the detailed description provided hereinbefore, it is to be understood that the ratchet wrench in accordance with the present invention may include a function of a ¼" drive hexagonal bit holder, and has a profile of an ordinary ratchet wrench on two ends of a handle while providing combined functions of ordinary ratchet wrenches with a ½" drive, a ⅜" drive, and a ¼" drive, and will not be obstructed from getting into confined spaces for turning fasteners with sockets in most cases of applications.

Although the present invention has been described with relation to its preferred embodiments and disclosed by way of examples only, it is to be appreciated that many other modifications and changes may be made to the detailed construction and the combination and arrangement of parts without departing from the scope of the invention as hereinbelow claimed.

What is claimed is:

1. A ratchet wrench comprising:

a handle (10) including a first end, the first end of the handle (10) including a lowered face (11), the first end of the handle (10) further including an inclined through hole (12) that is formed with a threaded portion (13) for mounting a setscrew (14), the first end of the handle (10) further including a pawl compartment (15) that communicates with the inclined through hole (12);

pear-shaped head (16) extending from the first end of the handle (10), the pear-shaped head (16) including a drive housing (17) that communicates with the pawl compartment (15) of the first end of the handle (10), the drive housing (17) of the pear-shaped head (16) including a U-shaped section (18) that communicates with the pawl compartment (15) of the first end of the handle (10), the pear-shaped head (16) further including a C-shaped shoulder (19) in a top end for mounting a ring element (20); and a drive member (21) rotatably mounted in the drive housing (17) of the pear-shaped head (16), the drive member (21) including a plurality of gear teeth (22) in an outer periphery (23), the drive member (21) further including a flange (34) that is formed on a top end of the outer periphery (23) for abutting against the ring element (20);

the drive member (21) further including a square inner periphery (35) that is adapted to receive a drive shaft (36) therein, the square inner periphery (35) of the drive member (21) including a detent (37) and a notch (38) defined therein and spaced apart, the square inner periphery (35) of the drive member (21) further including a square flange (39), the square flange (39) of the drive member (21) including beveled faces (40), the drive member (21) further including a through orifice (62) that communicates with the notch (38) of the square inner periphery (35) for inserting a pin (63) to thereby disassemble the drive shaft (36) from the drive member (21);

the drive shaft (36) including an oval hole (41) for receiving a pin-biasing spring (44) and an oval pin (42) with an engagement end (43), the pin-biasing spring (44) in the oval hole (41) of the drive shaft (36) biasing the oval pin (42) to engage with the notch (38) in the square inner periphery (35) of the drive member (21) for retaining the drive shaft (36) in the square inner periphery (35) of the drive member (21) and allowing the drive shaft (36) to slide in the square inner periphery (35) of the drive member (21), the drive shaft (36) further including a ½" drive fitting (45), the ½' drive fitting (45) of the drive shaft (36) including a large bore (47) for receiving a large spring (48) and a large retention ball (49), the drive shaft (36) further including a ⅜' drive fitting (46), the ⅜' drive fitting (46) of the drive shaft (36) including a medium-sized bore (50) for receiving a medium-sized spring (51) and a medium-sized retention ball (52), the large spring (48) in the large bore (47) of the drive shaft (36) biasing the large retention ball (49) to engage with the detent (37) in the square inner periphery (35) of the drive member (21), thereby recessing the ½' drive fitting (45) of the drive shaft (36) in the square inner periphery (35) of the drive member (21) and setting the ⅜" drive fitting (46) of the drive shaft (36) in position for releasably engaging with a fastener-driving element, the medium-sized spring (51) in the medium-sized bore (50) of the drive shaft (36) biasing the medium-sized retention ball (52) to press against one of the beveled faces (40) of the square flange (39) in the square inner periphery (35) of the drive member (21), thereby recessing the ⅜" drive fitting (46) of the drive shaft (36) in the square inner periphery (35) of the drive member (21) and setting the ½' drive fitting (45) of the drive shaft (36) in position for releasably engaging with a fastener-driving element; and a pawl mechanism mounted in the first end of the handle (10), the pawl mechanism including a pawl (24), the pawl (24) of the pawl mechanism being rotatably mounted in the pawl compartment (15) of the first end of the handle (10), the pawl (24) of the pawl mechanism including two inclined faces (26), the pawl (24) of the pawl mechanism further including two sets of lockup teeth (25) for selectively engaging with the gear teeth (22) of the drive member (21), the pawl (24) of the pawl mechanism further including two pressing faces (27) for selectively pressing against a wall of the pawl compartment (15) in the first end of the handle (10) when the drive member (21) is being turned, a spring member (28) and a friction ball (29) both being received in the inclined through hole (12) of the first end of the handle (10), the spring member (28) biasing the friction ball (29) to selectively butt against one of the two inclined faces (26) of the pawl (24); and the pawl (24) of the pawl mechanism further including an axial cylinder (30) formed on a top end thereof, the axial cylinder (30) of the pawl (24) including a top end (65) that is located in a position higher than a top face of the pear-shaped head (16), the top end (65) of the axial cylinder (30) of the pawl (24) being formed with an oblong portion (31) for fixedly mounting a switch lever (32) for turning the pawl (24) between tightening and loosening modes; and the ring element (20) including a restraining yoke (33) for restraining the axial cylinder (30) of the pawl (24) in the U-shaped section (18) of the drive housing (17) of the pear-shaped head (16) for stabilizing pivotal movement of the pawl (24) when the pawl (24) is being turned; and the handle (10) further including a second end, the second end of the handle (10) including a descended side (11'), the second end of the handle (10) further including an angled through opening (12') that is formed with a screw-mounting segment (13') for mounting a headless screw (14'), the second end of the handle (10) further including a cavity (15') that communicates with the angled through opening (12');

a teardrop head (16') extending from the second end of the handle (10), the teardrop head (16') including a rotator-receiving hole (17') that communicates with the cavity (15') of the second end of the handle (10), the rotator-receiving hole (17') of the teardrop head (16') further including a U-structure (18') that communicates with the cavity (15') of the second end of the handle (10), the teardrop head (16') further including a peripheral groove (19') in a top end for mounting a stabilizer ring (20'); and a rotator (21') rotatably mounted in the rotator-receiving hole (17') of the teardrop head (16'), the rotator (21') including a plurality of meshing teeth (22') in a peripheral wall (23'), the rotator (21') further including a flanged section (34') that is formed on a top end of the peripheral wall (23') for abutting against the stabilizer ring (20');

the rotator (21') further including a ¼' drive hexagonal bit holder (53) in a top end, the ¼' drive hexagonal bit holder (53) including a mini-groove (55) defined therein for partially receiving a double C retainer (56) for releasably holding a fastener-driving element, the rotator (21') further including a ¼' drive fitting (54) that is formed on a bottom end, the ¼' drive fitting (54) of the rotator (21') including a ball cavity (57) for receiving a spiral spring (58) and a socket-engaging ball (59) for releasably engaging with a fastener-driving element;

a ratcheting system mounted in the second end of the handle (10), the ratcheting system including a pivot member (24'), the pivot member (24') of the ratcheting system being rotatably mounted in the cavity (15') of the second end of the handle (10), the pivot member (24') of the ratcheting system including two sloped sides (26'), the pivot member (24') of the ratcheting system further including two sets of engaging teeth (25') for selectively engaging with the meshing teeth (22') of the rotator (21'), the pivot member (24') of the ratcheting system further including two abutting sides (27') for selectively pressing against a wall of the cavity (15') of the second end of the handle (10) when the rotator (21') is being turned, an elastic element (28') and a ball bearing (29') both being received in the angled through opening (12') of the second end of the handle (10), the elastic element (28') biasing the ball bearing (29') to selectively butt against one of the two sloped sides (26') of the pivot member (24'); and the pivot member (24') of the ratcheting system further including a cylindrical projection (30') formed on a top end thereof, the cylindrical projection (30') of the pivot member (24') including an upper end (65') that is located in a position higher than a top face of the teardrop head (16'), the upper end (65') of the cylindrical projection (30') of the pivot member (24') being formed with an oblong protrusion (31') for fixedly mounting a turn piece (32') for turning the pivot member (24') between tightening and loosening modes; and the stabilizer ring (20') including a yoke structure (33') for restraining the cylindrical projection (30') of the pivot member (24') in the U-structure (18') of the rotator-receiving hole (17') of the teardrop head (16') for stabilizing pivotal movement of the pivot member (24') when the pivot member (24') is being turned.

2. The ratchet wrench as claimed in claim 1, wherein the drive member (21) further includes an annular groove (60) defined in a bottom end of the outer periphery (23) and located in a position lower than a bottom face of the pear-shaped head (16), a C-retainer (61) is partially received in the annular groove (60) of the drive member (21) and abuts against the bottom face of the pear-shaped head (16) for preventing the drive member (21) from falling out of the drive housing (17) of the pear-shaped head (16).

3. The ratchet wrench as claimed in claim 1, wherein the rotator (21') further includes a O-structured groove (60') defined in a bottom end of the peripheral wall (23') and located in a position lower than a bottom face of the teardrop head (16'), a C-shaped ring (61') is partially received in the O-structured groove (60') of the rotator (21') and abuts against the bottom face of the teardrop head (16') for preventing the rotator (21') from falling out of the rotator-receiving hole (17') of the teardrop head (16').

4. The ratchet wrench as claimed in claim 1, wherein the drive member (21) further includes an annular furrow (601) defined in a bottom end of the outer periphery (23), the drive housing (17) of the pear-shaped head (16) further includes a O-contoured trench (602) that aligns with the annular furrow (601) of the drive member (21), a split ring (610) is partially received in the annular furrow (601) of the drive member (21) and partially received in the O-contoured trench (602) of the drive housing (17) of the pear-shaped head (16) for securing the drive member (21) in the drive housing (17) of the pear-shaped head (16) and allowing rotation of the drive member (21) in the drive housing (17) of the pear-shaped head (16).

5. The ratchet wrench as claimed in claim 1, wherein the rotator (21') further includes a circular recess (601') defined in a bottom end of the peripheral wall (23'), the rotator-receiving hole (17') of the teardrop head (16') further includes a O-grooved section (602') that aligns with the circular recess (601') of the rotator (21'), a retention C-ring (610') is partially received in the circular recess (601') of the rotator (21') and partially received in the O-grooved section (602') of the rotator-receiving hole (17') of the teardrop head (16') for securing the rotator (21') in the rotator-receiving hole (17') of the teardrop head (16') and allowing rotation of the rotator (21') in the rotator-receiving hole (17') of the teardrop head (16').

6. The ratchet wrench as claimed in claim 1, wherein the drive member (21) further includes a constraining shoulder (68) formed on a bottom end of the outer periphery (23), the drive member (21) further includes external threads (71) formed on the bottom end of the outer periphery (23) and located in a position just below the constraining shoulder (68) of the drive member (21), a threaded ring (70) includes internal threads (72) formed in an inner periphery and is mounted around the bottom end of the outer periphery (23) of the drive member (21) for abutting against the constraining shoulder (68) of the drive member (21), thereby removably mounting the drive member (21) in the drive housing (17) of the pear-shaped head (16) and allowing rotation of the drive member (21) in the drive housing (17) of the pear-shaped head (16).

7. The ratchet wrench as claimed in claim 1, wherein the rotator (21') further includes a ring-securing shoulder (68') formed on a bottom end of the peripheral wall (23'), the rotator (21') further includes outer peripheral threads (71') formed on the bottom end of the peripheral wall (23') and located in a position just below the ring-securing shoulder (68') of the rotator (21'), an unscrewable ring (70') includes inner peripheral threads (72') formed in an inner periphery and is mounted around the bottom end of the peripheral wall (23') of the rotator (21') for abutting against the ring-securing shoulder (68') of the rotator (21'), thereby removably mounting the rotator (21') in the rotator-receiving hole (17') of the teardrop head (16') and allowing rotation of the rotator (21') in the rotator-receiving hole (17') of the teardrop head (16').

8. The ratchet wrench as claimed in claim 1, wherein the drive member (21) further includes a constraining shoulder (68) formed on a bottom end of the outer periphery (23) and located in a position lower than a bottom face of the pear-shaped head (16), the drive member (21) further includes a ring-shaped groove (603) defined in the bottom end of the outer periphery (23) and located in a position below the constraining shoulder (68) of the drive member (21), a lockup ring (74) is mounted around the bottom end of the outer periphery (23) of the drive member (21) and includes a O-shaped recess (604) formed in an inner periphery for aligning with the ring-shaped groove (603) of the drive member (21), a C-member (611) is partially received in the ring-shaped groove (603) of the drive member (21) and partially received in the O-shaped recess (604) of the lockup ring (74) for permanently holding the lockup ring (74) in place and against the constraining shoulder (68) of the drive member (21), thereby retaining the drive member (21) in the drive housing (17) of the pear-shaped head (16) and allowing rotation of the drive member (21) in the drive housing (17) of the pear-shaped head (16).

9. The ratchet wrench as claimed in claim 1, wherein the rotator (21') further includes a ring-securing shoulder (68') formed on a bottom end of the peripheral wall (23') and located in a position lower than a bottom face of the teardrop head (16'), the rotator (21') further includes a ring-contoured recess (603') defined in the bottom end of the peripheral wall (23') and located in a position below the ring-securing shoulder (68') of the rotator (21'), an undetachable ring (74') is mounted around the bottom end of the peripheral wall (23') of the rotator (21') and includes a security O-groove (604') formed in an inner periphery for aligning with the ring-contoured recess (603') of the rotator (21'), a C-fastener (611') is partially received in the ring-contoured recess (603') of the rotator (21') and partially received in the security O-groove (604') of the undetachable ring (74') for permanently holding the undetachable ring (74') in place and against the ring-securing shoulder (68') of the rotator (21'), thereby retaining the rotator (21') in the rotator-receiving hole (17') of the teardrop head (16') and allowing rotation of the rotator (21') in the rotator-receiving hole (17') of the teardrop head (16').

10. The ratchet wrench as claimed in claim 1, wherein the drive member (21) further includes a constraining shoulder (68) formed on a bottom end of the outer periphery (23) and located in a position lower than a bottom face of the pear-shaped head (16), the drive member (21) further includes a ring-shaped groove (603) defined in the bottom end of the outer periphery (23) and located in a position below the constraining shoulder (68) of the drive member (21), a shoulder-abutting ring (73) is mounted around the bottom end of the outer periphery (23) of the drive member (21), a C-member (611) is partially received in the ring-shaped groove (603) of the drive member (21) and abuts against the shoulder-abutting ring (73), thereby sandwiching the shoulder-abutting ring (73) between the C-member (611) and the constraining shoulder (68) of the drive member (21) for retaining the drive member (21) in the drive housing (17) of the pear-shaped head (16) and allowing rotation of the drive member (21) in the drive housing (17) of the pear-shaped head (16).

11. The ratchet wrench as claimed in claim 1, wherein the rotator (21') further includes a ring-securing shoulder (68') formed on a bottom end of the peripheral wall (23') and located in a position lower than a bottom face of the teardrop head (16'), the rotator (21') further includes a ring-contoured recess (603') defined in the bottom end of the peripheral wall (23') and located in a position below the ring-securing shoulder (68') of the rotator (21'), a rotator-securing O-ring (73') is mounted around the bottom end of the peripheral wall (23') of the rotator (21'), a C-fastener (611') is partially received in the ring-contoured recess (603') of the rotator (21') and abuts against the rotator-securing O-ring (73'), thereby sandwiching the rotator-securing O-ring (73') between the C-fastener (611') and the ring-securing shoulder (68') of the rotator (21') for retaining the rotator (21') in the rotator-receiving hole (17') of the teardrop head (16') and allowing rotation of the rotator (21') in the rotator-receiving hole (17') of the teardrop head (16').

* * * * *